US011515638B2

(12) United States Patent
Franklin et al.

(10) Patent No.: US 11,515,638 B2
(45) Date of Patent: Nov. 29, 2022

(54) SQUARE APERTURE FREQUENCY SELECTIVE SURFACES IN FABRY-PEROT CAVITY ANTENNA SYSTEMS

(71) Applicant: Regents of the University of Minnesota, Minneapolis, MN (US)

(72) Inventors: Rhonda R. Franklin, Falcon Heights, MN (US); Aditya Dave, Minneapolis, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 216 days.

(21) Appl. No.: 16/920,132

(22) Filed: Jul. 2, 2020

(65) Prior Publication Data

US 2021/0005973 A1 Jan. 7, 2021

Related U.S. Application Data

(60) Provisional application No. 62/870,925, filed on Jul. 5, 2019.

(51) Int. Cl.

| | |
|---|---|
| ***H01Q 13/18*** | (2006.01) |
| ***H01Q 15/00*** | (2006.01) |
| ***H01Q 13/10*** | (2006.01) |
| ***H01Q 1/38*** | (2006.01) |

(52) U.S. Cl.

CPC ..... *H01Q 15/0026* (2013.01); *H01Q 1/38* (2013.01); *H01Q 13/106* (2013.01)

(58) Field of Classification Search

CPC .... H01Q 15/0026; H01Q 1/38; H01Q 13/106; H01Q 9/0407; H01Q 15/0013; H01Q 13/18; H01Q 13/10; H01Q 21/0006

See application file for complete search history.

(56) References Cited

U.S. PATENT DOCUMENTS

| | | | |
|---|---|---|---|
| 5,917,458 | A | 6/1999 | Ho et al. |
| 8,730,125 | B2 | 5/2014 | De Flaviis et al. |
| 10,777,901 | B2 * | 9/2020 | Franklin ..... H01Q 21/065 |

(Continued)

OTHER PUBLICATIONS

Burghignoli et al., "Highly Polarized, Directive Radiation From a Fabry-Perot Cavity Leaky-Wave Antenna Based on a Metal Strip Grating," IEEE Transactions on Antennas and Propagation, vol. 58, No. 12, Dec. 2010, 11 pp.

(Continued)

*Primary Examiner* — David E Lotter

(74) *Attorney, Agent, or Firm* — Shumaker & Sieffert, P.A.

(57) ABSTRACT

In some examples, an antenna system includes a source antenna and a frequency selective surface (FSS) comprising a first section including a first set of horizontally oriented unit cells, a second section including a second set of horizontally oriented unit cells, and a third section between the first section and the second section, the third section including a set of vertically oriented unit cells, wherein the first section is substantially square in shape, and wherein the second section is substantially square in shape. The source antenna is configured to emit one or more electromagnetic signals through the FSS, wherein the FSS causes the one or more signals to form at least a first beam corresponding to the first section, and wherein the FSS causes the one or more signals to form at least a second beam corresponding to the second section.

20 Claims, 42 Drawing Sheets

(56) References Cited

U.S. PATENT DOCUMENTS

| | | | | |
|---|---|---|---|---|
| 2005/0057432 | A1 | 3/2005 | Anderson | |
| 2013/0241785 | A1 | 9/2013 | De Flaviis et al. | |
| 2019/0115646 | A1* | 4/2019 | Chiu | H01Q 15/10 |

OTHER PUBLICATIONS

Casares-Miranda et al., "Vertical Microstrip Transition for Multilayer Microwave Circuits with Decoupled Passive and Active Layers," IEEE Microwave and Wireless Components Letters, vol. 16, No. 7, Jul. 2006, 3 pp.
Feresidis et al., "High gain planar antenna using optimized partially reflective surfaces," IEEE Proceedings—Microwaves, Antennas and Propagation vol. 148, No. 6, Dec. 2001, 6 pp.
Gardelli et al., "Array Thinning by Using Antennas in a Fabry-Perot Cavity for Gain Enhancement," IEEE Transactions on Antennas and Propagation, vol. 54, No. 7, Jul. 2006, 12 pp.
Ge et al., Broadband and High-Gain Printed Antennas Constructed from Fabry-Perot Resonator Structure using EBG or FSS Cover, Microwave and Optical Technology Letters, vol. 48, No. 7, Jul. 2006, 3 pp.
Godara, "Application of Antenna Arrays to Mobile Communications, Part II: Beam-Forming and Direction-of-Arrival Considerations," Proceedings of the IEEE, vol. 85, No. 8, Aug. 1997, 51 pp.
Gu et al., "Modeling and analysis of vias in multilayered integrated circuits," IEEE Transactions on Microwave Theory and Techniques, vol. 41, No. 2, Feb. 1993, 9 pp.
Han et al., "A Millimeter-Wave Fabry-Perot Antenna With High-Gain and Circular Polarization Operation," Proceedings of 2014 3rd Asia-Pacific Conference on Antennas and Propagation, Jul. 2014, 4 pp.
Hosseini et al., "A 63 GHz Single-feed Low-profile Fabry-Perot Cavity Antenna Using a Thick Metallic FSS," 2013 IEEE Antennas and Propagation Society International Symposium (APSURSI), Jul. 2013, 2 pp.
Hosseini et al., "A Highly-efficient Single-feed Planar Fabry-Perot Cavity Antenna for 60 GHz Technology," Proceedings of the 2012 IEEE International Symposium on Antennas and Propagation, Jul. 2012, 2 pp.
Jackson et al., "A Leaky-Wave Analysis of the High-Gain Printed Antenna Configuration," IEEE Transactions of Antennas and Propagation, vol. 36, No. 7, Jul. 1988, 6 pp.
Kelley et al., "Fluidic Tuning of a Frequency Selective Surface Based on a Four-arm Archimedean Spiral," 2013 IEEE Antennas and Propagation Society International Symposium (APSURSI), Jul. 2013, 2 pp.
Kelley et al., "Frequency reconfigurable patch antenna using liquid metal as switching mechanism," Electronic Letters, vol. 49, No. 22, Oct. 2013, 2 pp.
Kim et al., "A Wideband Fabry-Perot Cavity Antenna with Successively Tapered Meandering Loops," Proceedings of the 5th European Conference on Antennas and Propagation (EUCAP), Apr. 2011, 2 pp.
Kim et al., "Fabry-Perot Cavity Antenna With Lateral Metallic Walls for WiBro Base Station Applications," Electronics Letters, vol. 45, No. 3, Jan. 2009, 2 pp.
Konstantinidis et al., "Multilayer Partially Reflective Surfaces for Broadband Fabry-Perot Cavity Antennas," IEEE Transactions on Antennas and Propagation, vol. 62, No. 7, Jul. 2014, 8 pp.
Lee et al., "Analysis of Coplanar Waveguide Feedline Effect on Fabry-Perot Cavity Antenna System Performance," 2016 IEEE International Symposium on Antennas and propagation (SPSURSI), Jun. 2016, 2 pp.
Lee et al., "Comparative Analysis of Frequency Selective Surface Geometry Effect in Fabry-Perot Cavity Antenna Design" 2015 IEEE 16th Annual Wireless and Microwave Technology Conference (WAMICON), Apr. 2015, 4 pp.
Lee et al., "Design of Near-Field Beam-Splitting Frequency Selective Surfaces for Fabry-Perot Cavity Antenna Systems," 2016 46th European Microwave Conference (EuMC), Oct. 2016, 4 pp.
Lee et al., "Fabry-Perot Cavity Antenna System with Beam-Splitting of Near-Field Radiation," 2016 IEEE International Symposium on Antennas and Propagation (APSURSI) Jun. 2016, 2 pp.
Lee et al., "Fluidic Switching and Tuning of Fabry-Perot Antenna" 2015 IEEE International Symposium on Antennas and Propagation USNC/URSI National Radio Science Meeting, Jul. 2015, 2 pp.
Lee et al., "Microfluidic Near-Field Beam-Splitting Frequency Selective Surface for Fabry-Perot Cavity Antenna System," 2017 IEEE International Symposium on Antennas and Propagation & USNC/URSI national radio Science Meeting, Jul. 2017, 2 pp.
Lee et al., "Parametric Study of Near- and Far-Field Performance of the Fabry-Perot Cavity Antenna System," 2016 IEEE 17th Annual wireless and Microwave Technology Conference (WAMICON), Apr. 2016, 3 pp.
Lee et al., "Reconfigurable Frequency Selective Surface for Fabry-Perot Cavity Antenna System," 2017 IEEE International Symposium on Antennas and Propagation & USNC/URSI national radio Science Meeting, Jul. 2017, 2 pp.
Liu et al., "Power consumption estimation in CMOS VLSI chips," IEEE Journal of Solid-State Circuits, vol. 29, No. 6, Jun. 1994, 8 pp.
Lu et al., "Design and Implementation of Broadband Partially Reflective Surface Antenna," 2011 IEEE International Symposium on Antennas and propagation (APSURSI), Jul. 2011, 4 pp.
Mateo-Segura et al., "Analysis of Broadband Highly-Directive Fabry-Perot Cavity Leaky-Wave Antennas with Two Periodic Layers," 2010 IEEE Antennas and Propagation Society International Symposium, Jul. 2010, 4 pp.
Murray et al., "Frequency tunable annular slot antenna," 2013 IEEE Antennas and Propagation Society International Symposium (APSURSI), Jul. 2013, 2 pp.
Pavuluri et al., "Integration of Microfluidic Channels with Frequency Selective Surfaces for Sensing and Tuning," The 8th European Conference on Antennas and Propagation (EuCAP 2014), Apr. 2014, 4 pp.
Saghati et al., "A Microfluidically-Tuned Dual-Band Slot Antenna," 2014 IEEE Antennas and Propagation Society International Symposium (APSURSI), Jul. 2014, 2 pp.
Sarabandi et al., "A Frequency Selective Surface with Miniaturized Elements," IEEE Transactions on Antennas and Propagation, vol. 55, No. 5, May 2007, 7 pp.
Shrestha et al., "Two Antenna Arrays for Remote Sensing Applications," 2017 IEEE Aerospace Conference, Mar. 2017, 9 pp.
Theodorou et al., "Transition Properties of a Vertical Conductor Connecting Two Microstrip Lines at Different Planes," IEEE Transactions on Microwave Theory and Techniques, vol. 42, No. 12, Dec. 1994, 8 pp.
Yanfei et al., "A Novel Design for a Low Profile High Directivity Fabry-Perot Cavity Antenna," 2009 IEEE Antennas and Propagation Society International Symposium, Jun. 2009, 4 pp.
Zhou et al., "Fabry-Perot Resonator Antenna with High Aperture Efficiency Using a Double-Layer Nonuniform Superstrate," IEEE Transactions on Antennas and Propagation, vol. 66, No. 4, Apr. 2018, 6 pp.
"Users Manual & Setup Guide—Desktop Antenna Measurement System (DAMS) x000, x100, and x250 Series," Diamond Engineering, 2013, 104 pp. (Applicant points out, in accordance with MPEP 609.04(a), that the year of publication, 2013, is sufficiently earlier than the effective U.S. filing date, so that the particular month of publication is not in issue.).
"User's Guide—High Frequency Structure Simulator (HFSS)," Version 10, Ansoft Corporation, Jun. 2005, 801 pp. (Uploaded in 2 parts).
Prosecution History from U.S. Appl. No. 16/269,957, dated Feb. 8, 2019 through May 28, 2020, 12 pp.
Dave et al., "Development of High Gain Virtual-Element Arrays with Fabry-Perot Cavity Antenna Systems," IEEE, 2019 IEEE International Symposium on Antennas and Propagation and USNC-URSI Radio Science Meeting, Jul. 7-12, 2019, 2 pp.

(56) References Cited

OTHER PUBLICATIONS

Dave et al., "Development of High Aperture Efficiency Fabry-Perot Cavity Antenna System," IEEE, 2019 IEEE International Symposium on Antennas and Propagation and USNC-URSI Radio Science Meeting, Jul. 7-12, 2019, 2 pp.

* cited by examiner

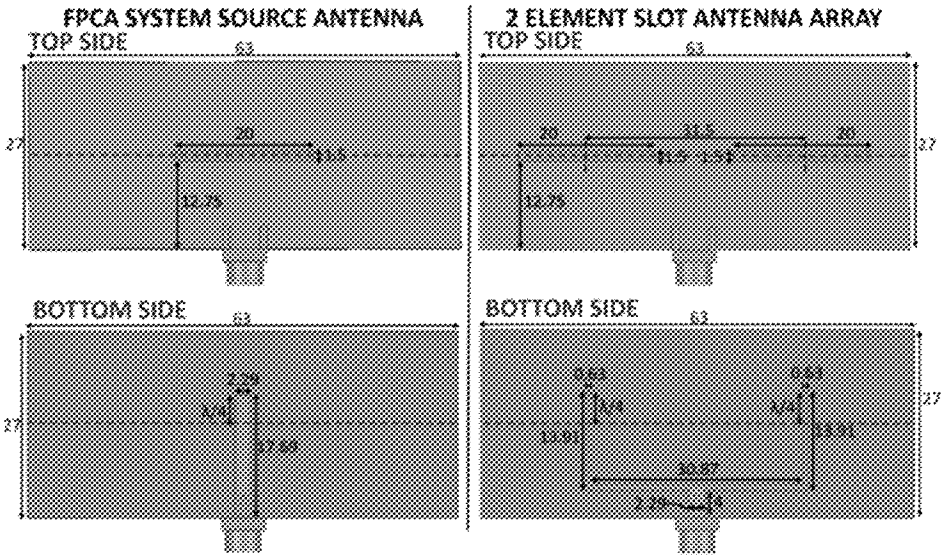
FIG. 1a
FIG. 1b
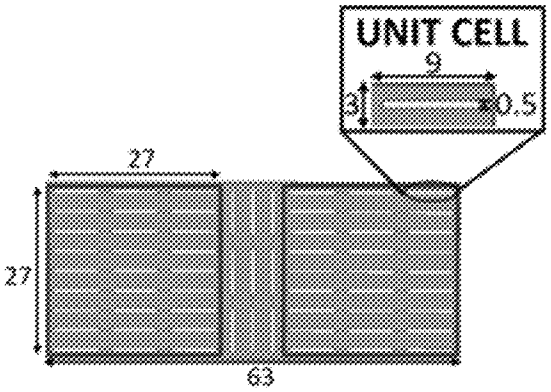
FIG. 1c
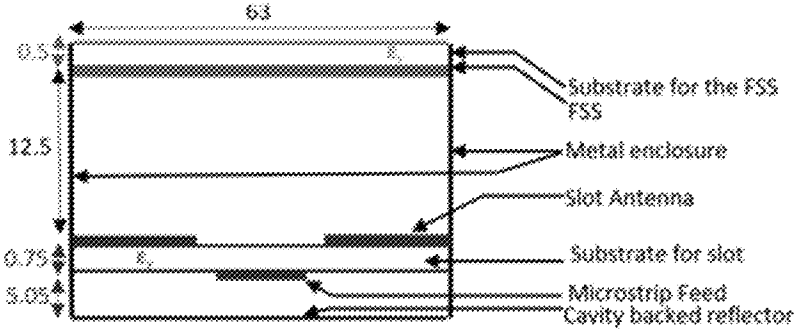
FIG. 1d
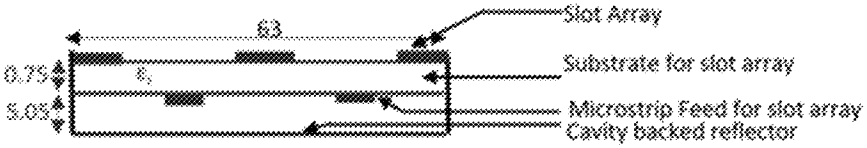
FIG. 1e

| Aperture size | Unit Cell |
|---|---|
| 27mmX27mm |   |
| 45mmX45mm |   |
| 63mmX63mm |   |
| 81mmX81mm |   |

SQUARE APERTURE FREQUENCY SELECTIVE SURFACES IN FABRY-PEROT CAVITY ANTENNA SYSTEMS

This application claims the benefit of U.S. Provisional Patent Application No. 62/870,925, filed on Jul. 5, 2019, the entire content of which is incorporated herein by reference.

GOVERNMENT INTEREST

This invention was made with government support under ECCS-1509543 awarded by the National Science Foundation. The government has certain rights in the invention.

TECHNICAL FIELD

The disclosure relates to antenna systems.

BACKGROUND

Trends to provide users with ubiquitous access to multiple radio terminals in wireless communication have been growing. As a result, reconfigurable radio platforms are being developed and advanced to address this need. In addition, as system complexity increases, efforts to create more energy efficient designs are desired. Fabry-Perot Cavity (FPC) antenna systems offer the ability to beam-form a source signal.

SUMMARY

The present disclosure describes one or more techniques for generating one or more beams using a Fabry-Perot Cavity Antenna (FPCA) system approach. The FPCA system may include a source antenna that emits electromagnetic signals and a frequency selective surface (FSS) that forms the electromagnetic signals into the one or more beams. In some examples, the FPCA system may be used in applications such as 5G. Additionally, in some examples, the FPCA system may be used in applications such as space (e.g., nano-satellites), communications, (e.g., Internet of Things (IoT) and Internet of Space), imaging (millimeter wave to THz spectroscopy), diagnostics (e.g., spectroscopy), and 3D chip power splitting, to name only a few examples. The FPCA system may be configured to generate the one or more beams while preserving a high aperture efficiency, a high gain value, and a substantially uniform phase response associated with signals that are emitted from the source antenna.

The techniques of this disclosure may provide one or more advantages. For example, the FSS may include one or more square sections each having a set of horizontally oriented unit cells, where the one or more square sections increase an aperture efficiency associated with the FPCA system and produce uniform circular near-field beams. In some examples, the FSS may include a single square section facing the source antenna, where the single square section forms a single circular beam from signals emitted from the source antenna, the single square section preserving a high aperture efficiency and a high gain value associated with signals emitted from the source antenna. Additionally, in some examples, the FSS may include a first section, a second section, and a third section between the first section and the second section, where the first section and the second section are substantially square in shape. As the source antenna emits electromagnetic signals within a metal enclosure, the third section, which includes a set of vertically oriented unit cells, may reflect one or more portions of the electromagnetic signals back into the metal enclosure. The first section and the second section may allow one or more portions of the electromagnetic signals to pass outside of the metal enclosure and form a first uniform beam corresponding to the first section and a second uniform beam corresponding to the second section. In this way, the FPCA system including the FSS may enable a single source antenna to produce one or more uniform near-field beams while preserving aperture efficiency, antenna gain, and signal phase.

In some examples, an antenna system includes a source antenna and a frequency selective surface (FSS) that has a first section including a first set of horizontally oriented unit cells, a second section including a second set of horizontally oriented unit cells, and a third section between the first section and the second section, the third section including a set of vertically oriented unit cells, wherein the first section is substantially square in shape, wherein the second section is substantially square in shape, wherein the FSS is separated from the source antenna by a defined distance. The source antenna is configured to emit one or more electromagnetic signals through the FSS, wherein the FSS causes the one or more signals to form at least a first beam corresponding to the first section, and wherein the FSS causes the one or more signals to form at least a second beam corresponding to the second section. Additionally, the antenna system includes an enclosure that is configured to partially or entirely enclose the source antenna and the FSS.

In some examples, a method includes emitting, using a source antenna of an antenna system, one or more electromagnetic signals through a frequency selective surface (FSS) comprising a first section including a first set of horizontally oriented unit cells, a second section including a second set of horizontally oriented unit cells, and a third section between the first section and the second section, the third section including a set of vertically oriented unit cells, wherein the first section is substantially square in shape, wherein the second section is substantially square in shape, wherein the FSS is separated from the source antenna by a defined distance, and wherein an enclosure is configured to at least partially enclose the source antenna and the FSS, forming, by the FSS based on the one or more signals, at least a first beam corresponding to the first section, and forming, by the FSS based on the one or more signals, at least a second beam corresponding to the second section.

In some examples, an antenna system includes a source antenna and a frequency selective surface (FSS) comprising a set of horizontally oriented unit cells, wherein the FSS is substantially square in shape, wherein the FSS faces the source antenna, wherein the FSS is separated from the source antenna by a defined distance, and wherein the source antenna is configured to emit one or more electromagnetic signals through the FSS, wherein the FSS causes the signals to form one or more beams.

The summary is intended to provide an overview of the subject matter described in this disclosure. It is not intended to provide an exclusive or exhaustive explanation of the systems, device, and methods described in detail within the accompanying drawings and description below. Further details of one or more examples of this disclosure are set forth in the accompanying drawings and in the description below. Other features, objects, and advantages will be apparent from the description and drawings, and from the claims.

BRIEF DESCRIPTION OF DRAWINGS

FIGS. 1*a*-1*e* illustrate one or more examples of an antenna system, in accordance with one or more techniques of this disclosure.

DETAILED DESCRIPTION

Figure 2A:
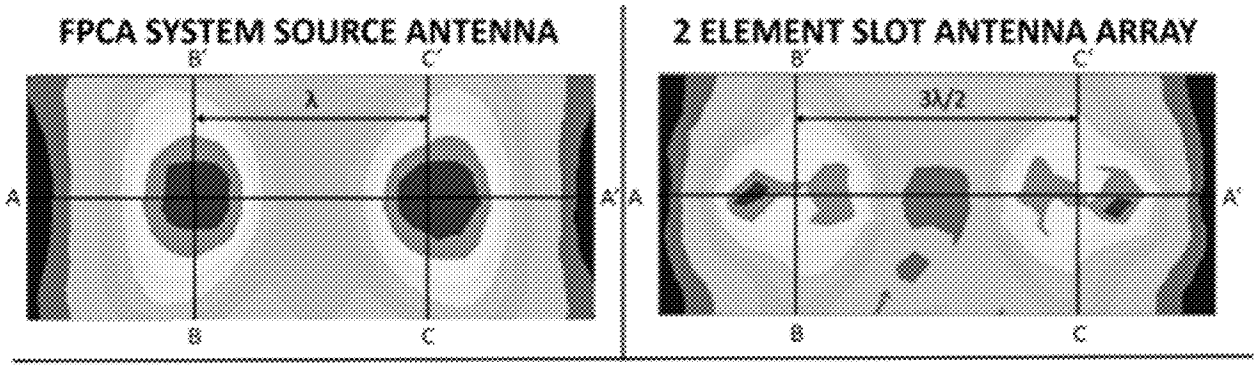
FIGS. 2*a*-2*c* illustrate a simulated comparison between a Fabry Perot-Cavity Antenna (FPCA) system and a 2-element array system, in accordance with one or more techniques of this disclosure.

Currently, the number of elements in an array of a specific antenna are used to determine its gain. To increase the gain, the number of elements may be increased. When the number of elements increases, two things may occur. First, the overall size of the antenna aperture may increase. Second, the necessary feedlines and their layout configuration complexity may increase, which leads to higher loss. As a result, array performance may be degraded due to losses associated with elements and feedline complexity and require additional losses associated with electronics (e.g., amplifiers) to compensate for these losses.

According to certain techniques of the present disclosure, a high-gain array using virtual-element Fabry Perot-Cavity Antenna (VE-FPCA) with near field split-beam that emulates a multi-element (e.g., two-element) slot array is presented. A novel frequency selective surface (FSS) design may be used to split the source antenna beam into two or more beams in the near field. Each beam may substantially circular and generated by a square aperture of horizontal slots within the FSS, according to various examples. As further described below, comparison of electric field magnitude, phase and beam separation may be made between the FPCA system and 2-element slot array in the near field. Feedline loss is also compared between both systems. The FPCA may, in various cases, provide a 5 dB far-field gain improvement over the 2-element array and constant E-field phase in the E-plane, which is the result of an increased aperture efficiency.

Compact arrays are increasing in demand because of their great beam-forming and beam-steering capabilities for wireless and mobile applications. They are also extensively used in remote sensing applications where side lobe levels need to be controlled. Despite these benefits, array designs introduce complex feeding mechanisms as the size of the array increases. FPCA systems have been shown to achieve similar directivities as arrays with fewer elements. As a leaky wave antenna system, the system uses a single source and an FSS in place of the conventional antenna arrays and associated feedline networks.

FPCA systems use the FSS to control radiation leakage and distribution based on the unit cell design. An aperture with uniform FSS cells can be optimized to enhance gain. However, to achieve similar far-field beam shaping to n×m element (e.g., n columns by m rows) array performance, the FSS design complexity may increase to control the source amplitude distribution across the FSS. Near-field beam splitting has been demonstrated with uniform rectangular unit cells. If the near field beams can be manipulated to emulate the location and behavior of elements in arrays, design complexity can be reduced considerably using FSS designs.

This application presents the design of a VE-FPCA array that achieves symmetry and placement control of two or more near field beams that emulate the behavior of a multi-element (e.g., two-element) slot array. The design for the FSS, feed lines and the source antennas used in the arrays is described herein. Antenna systems described herein may, in some examples, be configured to transmit signals having frequencies of up to 3 Terahertz (THz).

FIGS. 1*a*-1*e* illustrate one or more examples of an antenna system, in accordance with one or more techniques of this disclosure. For example, FIG. 1*a* illustrates a VE-FPCA source slot antenna with aperture coupled microstrip feed, FIG. 1*b* illustrates a 2-element linear array source antenna having 2 slots with aperture coupled microstrip feed, FIG. 1*c* illustrates a Virtual element FSS design, FIG. 1*d* illustrates a side view for the FPCA system, and FIG. 1*e* illustrates a side view for the 2-element array. All dimensions illustrated in FIGS. 1*a*-1*e* are in millimeters. Although antenna systems of this disclosure, in some cases, include one or more microstrips for feeding a source antenna, antenna systems of this disclosure may additionally or alternatively include a coplanar waveguide for feeding a source antenna.

Modelled E-field magnitude and phase in the near field for both designs are compared followed by measured far-field gain plots and aperture efficiency comparison. The VE-FPCA source antenna and two element slot array design with feedlines are shown in FIG. 1*a* and FIG. 1*b*, respectively. The VE-FPCA shown in FIG. 1*a* uses one air-cavity-backed slot antenna and 50Ω aperture coupled microstrip feedline. The two-element slot array, which is also air-cavity-backed, is fed by individual 100Ω aperture coupled microstrip lines that split from a 50Ω microstrip feedline. The $\lambda_g/4$ aperture coupled feedline is also used as a tuning element for matching. Each element of the array is the same slot antenna as the FPCA source antenna for fair comparison. For this reason, the pitch for the array elements is $3\lambda_o/2$. The FSS design with beam splitting capability is shown in FIG. 1*c*.

The cross-section of the FPCA system with the FSS is shown in FIG. 1*d*, where the FSS is located at $\lambda_0/2$ above the slot to form an air cavity layer. The metal of the FSS points towards the slot. FIG. 1*e* shows the cross-section for the 2-element array design that includes two cavity-backed slot elements with aperture coupled feedlines (FIG. 1*c*). The cavity backing is located $\lambda_g/4$ below the metal surface of the slot. The antennas and FSS substrates have height of 0.75 millimeters (mm) and 0.51 mm, respectively, on Rogers Duroid5880 ($\varepsilon_r$=2.2, 1 oz Cu).

The FSS unit cells in FIG. 11 cover the physical dimensions of the antenna substrate. The FSS has two square apertures of horizontal slots that are separated by a region of vertically oriented slots. The square aperture consists of 3 by 9 rectangular unit cell arrays and the vertically oriented region consist of 3 by 3 rectangular unit cell arrays. The square aperture generates circular beams and the vertically oriented region is responsible for splitting the beams. Each unit cell is 9 mm by 3 mm with slot dimensions of 7 mm by 0.5 mm. In some examples, the design shown in FIG. 1 may be expanded to split the source antenna beam into more than two beams (e.g., four beams, six beams) in the near field (e.g., utilizing multiple instances of the structure shown in FIG. 1 in parallel).

In some non-limiting examples, a surface area of a first one of the two square apertures is within a range from 30 millimeters squared ($mm^2$) to 10,000 $mm^2$, a surface area of a second one of the two square apertures is within a range from 30 $mm^2$ to 10,000 $mm^2$, and a surface area of the vertically oriented region is within a range from 10 $mm^2$ to 3,000 $mm^2$. In some examples, the surface area of the first one of the two square apertures is 729 $mm^2$, the surface area of the second one of the two square apertures is 729 $mm^2$, and the surface area of the vertically oriented region is 243 $mm^2$.

The simulations were performed with Ansys HFSS and antenna and FSS designs were fabricated with a LPKF Protomat S103 Milling Machine. A 3-dimensional (3D) printed fixture was used to house the system and to increase alignment accuracy.

Figure 2C:
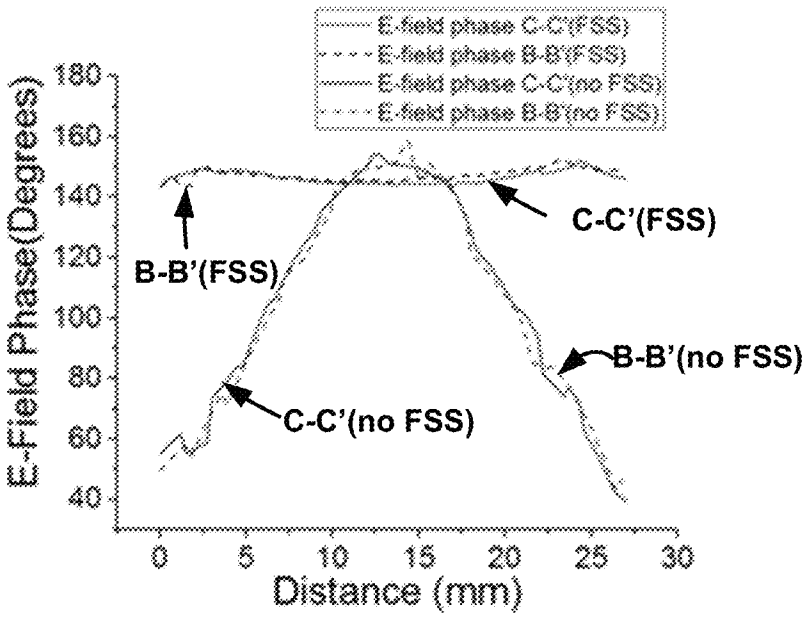
Figure 2B:
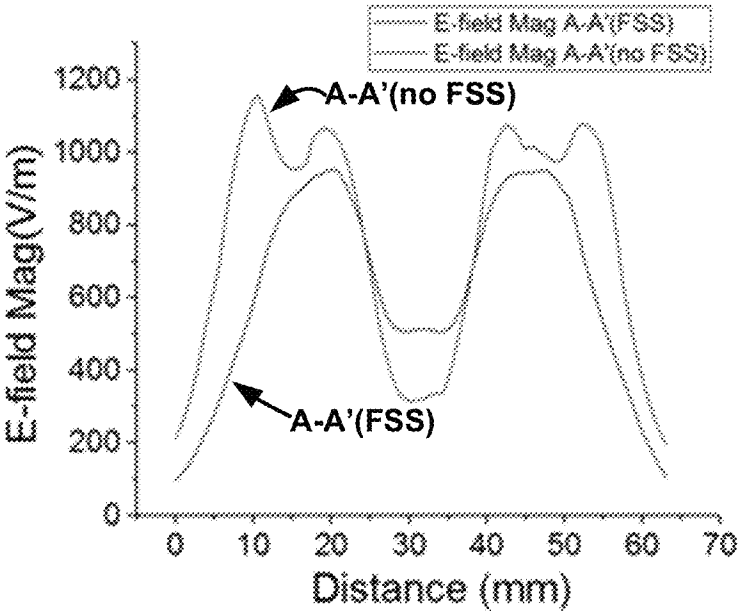

FIGS. 2*a*-2*c* illustrate a simulated comparison between an FPCA system and a 2-element array system, in accordance with one or more techniques of this disclosure. For example, FIG. 2*a* illustrates beam separation, FIG. 2*b* illustrates E-field magnitude comparison along A-A', and FIG. 2*c* illustrates E-field phase comparison along B-B' and C-C'.

Anritsu 37369D VNA and DAMS software was used to measure the antennas in an anechoic chamber. FIG. 2*a* compares the beam separation for both the cases. The VE-FPCA beam pitch is $\lambda_0$ and the 2-element pitch is $3\lambda_0/2$. FIG. 2*b* shows the peak near field E-field magnitude along the H-plane cut (A-A') at 5 mm above the surface. The peak near field E-field magnitude for the VE-FPCA beams is similar. For the 2-element array, other than having a peak magnitude that is slightly higher than the VE-FPCA, its beams have a null near the peak values and are not well spread out. There is also a strong null present between the beams. As a result, the VE-FPCA aperture is used much more efficiently than the 2-element array aperture.

Figure 3:
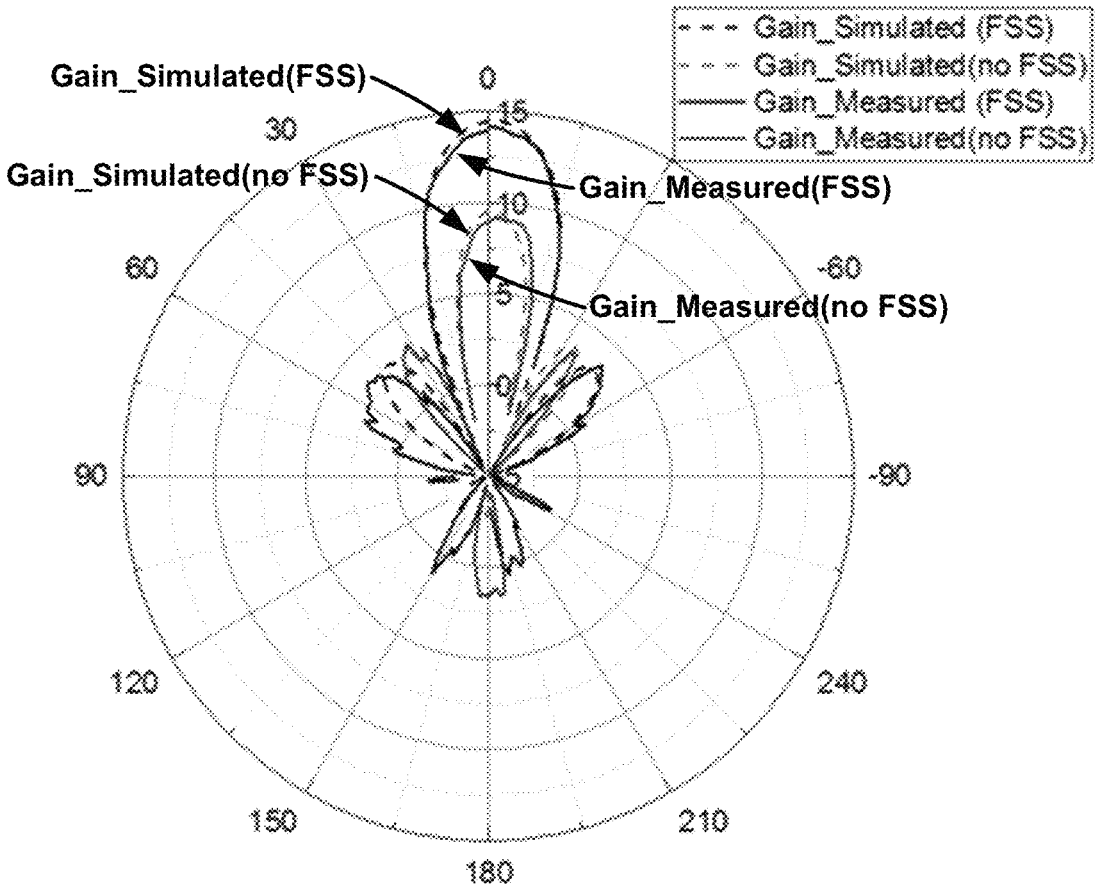
FIG. 3 illustrates a gain comparison between a virtual-element FPCA (VE-FPCA) system (12 GHz) and a 2-element array system for VE-FPCA (14.2 GHz), in accordance with one or more techniques of this disclosure.

A direct consequence is seen in the E-field phase plots along E-plane cuts B-B' and C-C' in FIG. 2*c*. The 2-element array has a sinusoidal phase variation of about 90°. For the VE-FPCA, however, the phase variation along the E-plane cut reduces considerably to approximately 10° and is consistent at other E-plane cut locations across the FSS aperture. This results in a VE-FPCA peak gain of 14.5 dB, approximately 5 dB higher than the 2-element array gain as seen in FIG. 3. This peak gain improvement for VE-FPCA is attributed to the low phase value and uniformity in the E-plane direction across the FSS. The feedline loss observed in VE-FPCA design is 0.7 dB, which is a reduction of 44% over the loss of 1.25 dB for the two-element array. Side-lobe levels remain similar in both designs, which indicates that the mutual coupling between the beams is similar.

FIG. 3 illustrates a gain comparison between a VE-FPCA system (12 GHz) and a 2-element array system for VE-FPCA (14.2 GHz), in accordance with one or more techniques of this disclosure. Solid lines are measured; dashed are modelled.

Aperture efficiency is given by the following equation.

$$\varepsilon_{ap} = \frac{G\lambda^2}{4\pi A_{ph}}$$

G is the gain of the antenna, $\lambda$ is the free space wavelength and $A_{ph}$ is the physical area. $A_{ph}$ is 63 mm×27 mm. Using the peak gain and frequency values from FIG. 3, the aperture efficiency of the VE-FPCA is 84.6% and 28% for the 2-element array, an increase of 56.6%.

The design of a virtual-element FPCA system array is presented. The VE-FPCA performance is compared to a linear 2-element slot array. The VE-FPCA design produces two circular and symmetrically placed beams in near field with similar magnitudes. The VE-FPCA system phase is nearly constant over the E-plane and across the FSS aperture, which leads to higher aperture efficiencies, and thus higher far-field gain. The side lobe powers were similar in both cases, illustrating that the FSS can independently boost the main beam level thereby increasing the Side Lobe Level (SLL).

A Fabry-Perot cavity antenna (FPCA) system with high efficiency is proposed. The design consists of a source antenna with an FSS. The source antenna is an aperture coupled microstrip slot antenna with cavity backing. The FSS is a square aperture with rectangular unit cells. The E-field in the near and far field is compared for the FPCA system and the source antenna without the FSS (i.e. source antenna only). The FPCA has low phase variation of approximately 100 in the E-plane compared to high sinusoidal phase variation of 90° of the source antenna. The far-field gain of the FPCA system is 11.3 dB, which is a 4.5 dB improvement of the source antenna gain. The aperture efficiency of the FPCA system is 84% compared to the source antenna efficiency of 30%.

Emerging mobile applications that require miniaturization of systems has created an increasing demand for compact directional antennas. Examples include nano-satellites, 5G applications, complementary metal-oxide-semiconductor (CMOS) applications, and applications that use communications like Internet of Things, Internet of Space, imaging, biomedical diagnostics, and/or and 3D chip power splitting. These types of systems typically utilize highly directive antennas, such as arrays. Arrays employed for this purpose can require many elements that can introduce challenges for managing feedline complexity and large sizes. Fabry-Perot Cavity (FPC) antenna systems offer the potential to create low complexity high gain antenna systems compared to conventional antenna array systems. This leaky wave antenna system uses a single source and FSS in place of multiple antenna array elements and associated feedline networks and circuitry. Fabry-Perot cavity systems are also easy to design and integrate.

High frequency operation of Fabry-Perot Cavity antenna is a viable solution for applications like 5G. Beam forming can be achieved by optimizing the signal distribution across the FSS. It can also be obtained by selecting an optimum design of the FSS unit cells to shape beams in the far-field in place of n-element arrays.

This application identifies the near-field behavior of an FPC antenna with uniform FSS unit cells and its impact on far-field performance (e.g. gain). The designs for the unit cell, the FSS aperture and the source antenna are described. Simulations of the near field beam over the aperture is shown. Next, modelled electric field magnitude and phase are compared at a similar reference location above the FPCA and source antenna without FSS. Finally, simulated and measured far-field gains are compared and the impact of the FSS design on aperture efficiency is discussed.

Figure 4A:
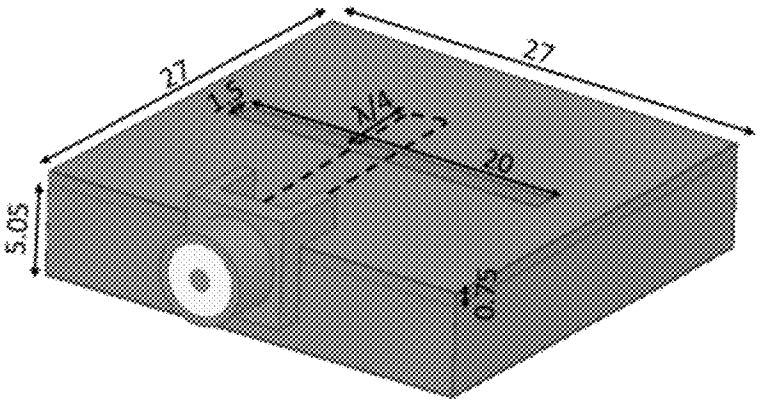
FIGS. 4*a*-4*c* illustrate an example of a design of source antenna and a frequency selective surface (FSS), in accordance with one or more techniques of this disclosure.
Figure 4C:
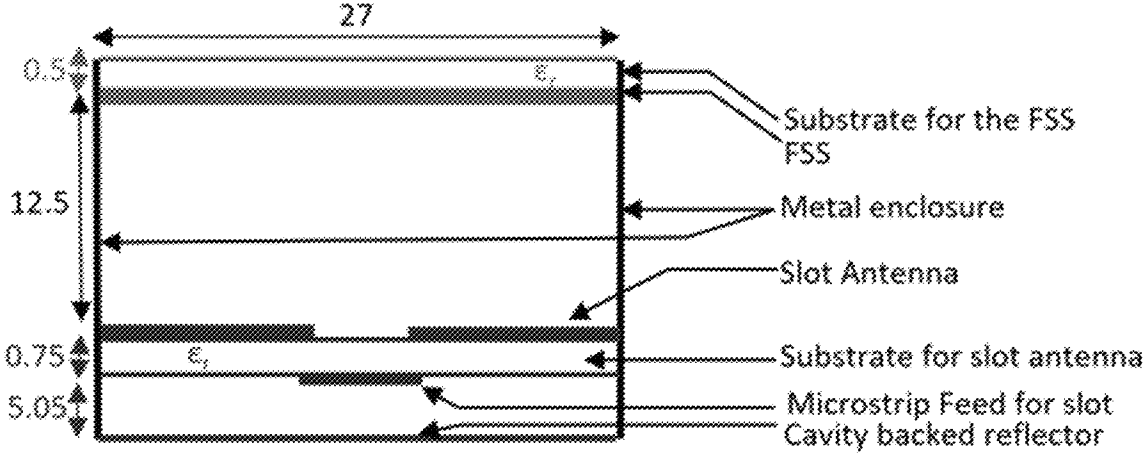
Figure 4B:
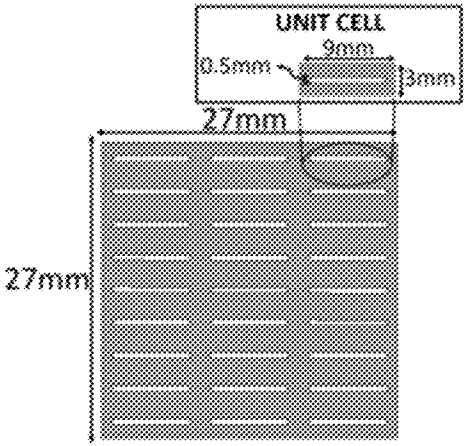

Design of the FPCA antenna system is carried out in, e.g., three stages. First is the design of the source antenna. The second is design of the unit cell and last is the arrangement of the unit cells in the FSS aperture layer. FIG. 4*a* shows the layout for the source antenna. It consists of a slot antenna that is fed using an aperture coupled microstrip line. The antenna is cavity-backed to avoid leakage. FIG. 4*b* shows the design of the unit cell and the FSS arrangement. The FSS consists of rectangular unit cells arranged horizontally. The complete FPCA system cross-section is shown in FIG. 4*c*. The FSS is placed above the source antenna with cavity-backed antenna to form an air cavity.

The cavity backed antenna design is a slot fed by an aperture coupled microstrip line with length of 18.04 mm and width of 2.29 mm. FIG. 4*a* shows all other dimensions. The cavity height below the slot is $\lambda_g/4$ at the design frequency. This guided wavelength value includes the duroid and air below the metal of the slot. The air layer height is 5.05 mm. The distance between the FSS and the antenna form an air cavity and is $\lambda_0/2$ at 12 GHz. The FSS aperture has 3 by 9 rectangular unit cells and is square. Each unit cell is 9 mm by 3 mm with a slot aperture dimension of 7 mm by 0.5 mm. The metal side of the FSS points into the air cavity.

FIGS. 4*a*-4*c* illustrate an example of a design of source antenna and an FSS, in accordance with one or more techniques of this disclosure. For example, FIG. 4*a* illustrates a design of rectangular aperture source antenna with cavity backing, FIG. 4*b* illustrates a design of unit cell and arrangement to form FSS, and FIG. 4*c* illustrates an FPCA system. All dimensions illustrated in FIGS. 4*a*-4*c* are in millimeters. In some examples, the value of $\varepsilon_r$ is 2.2.

In certain examples, the substrate is Rogers RT/Duroid5880 ($\varepsilon_r$=2.2) with a copper cladding of 35 μm. The antenna and FSS substrate thickness is 0.75 mm and 0.51 mm, respectively. The designs were simulated using Ansys HFSS and fabricated using LPKF Protomat S103 Milling Machine. In the assembly, a 3D printed fixture is used for placement and alignment accuracy. All side walls are enclosed with metal for shielding. Anritsu 37369D VNA was used with DAMS Software Studio in the anechoic chamber to obtain far-field measurements.

Figure 5A:
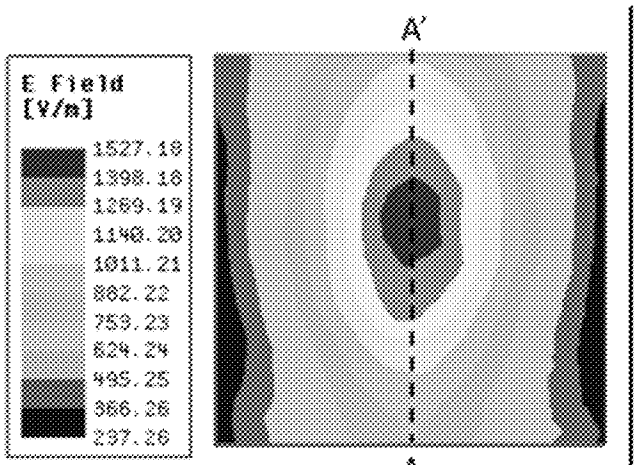
FIGS. 5*a*-5*d* shows the simulated results for the electric field magnitude located 5 mm above the aperture, in accordance with one or more techniques of this disclosure.
Figure 5B:
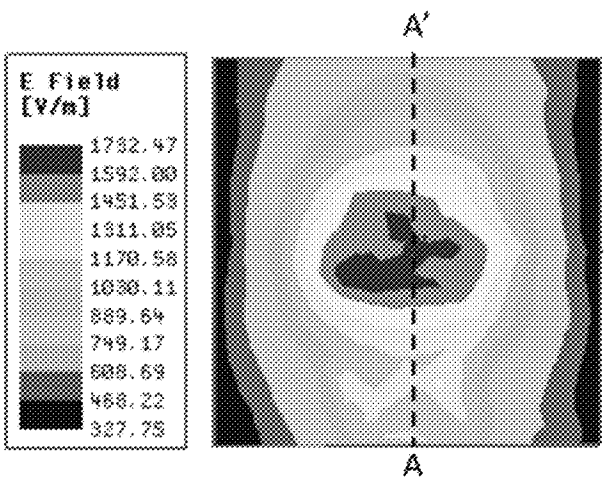
Figure 5C:
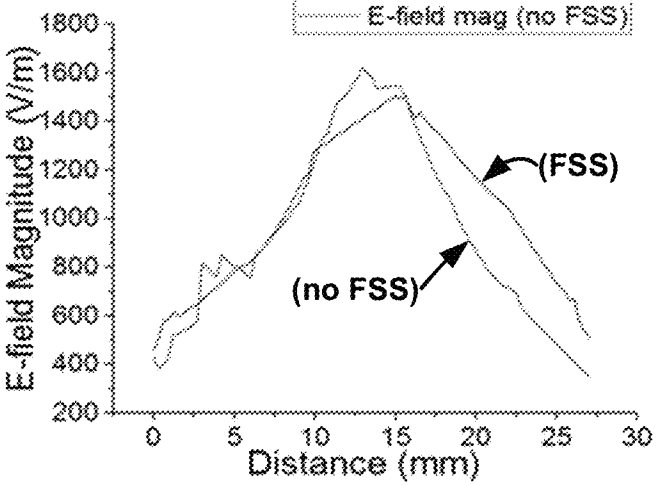

FIGS. 5*a*-5*d* shows the simulated results for the electric field magnitude located 5 mm above the aperture, in accordance with one or more techniques of this disclosure. FIG. 5*a* shows the FPCA beam. It is symmetrical and utilizes a large region of the aperture area. FIG. 5*c* shows the peak magnitude of the field for both FPCA and reference antenna. The FPCA is 1527 V/m. While the magnitude for the source antenna without FSS is marginally higher, the beam is narrower and less symmetrical as shown in FIG. 5*b*.

Figure 5D:
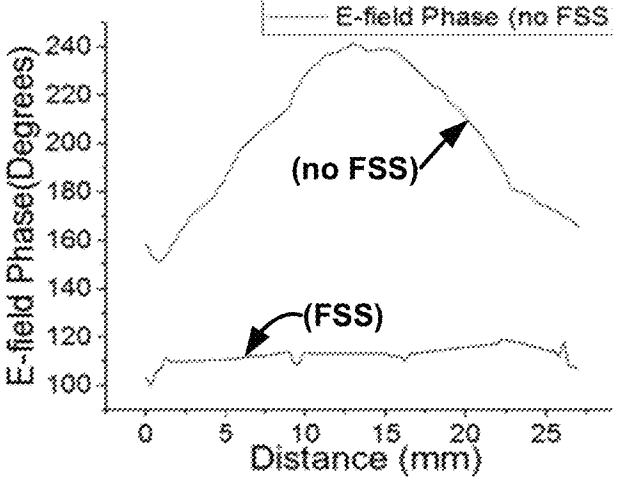
Figure 6:
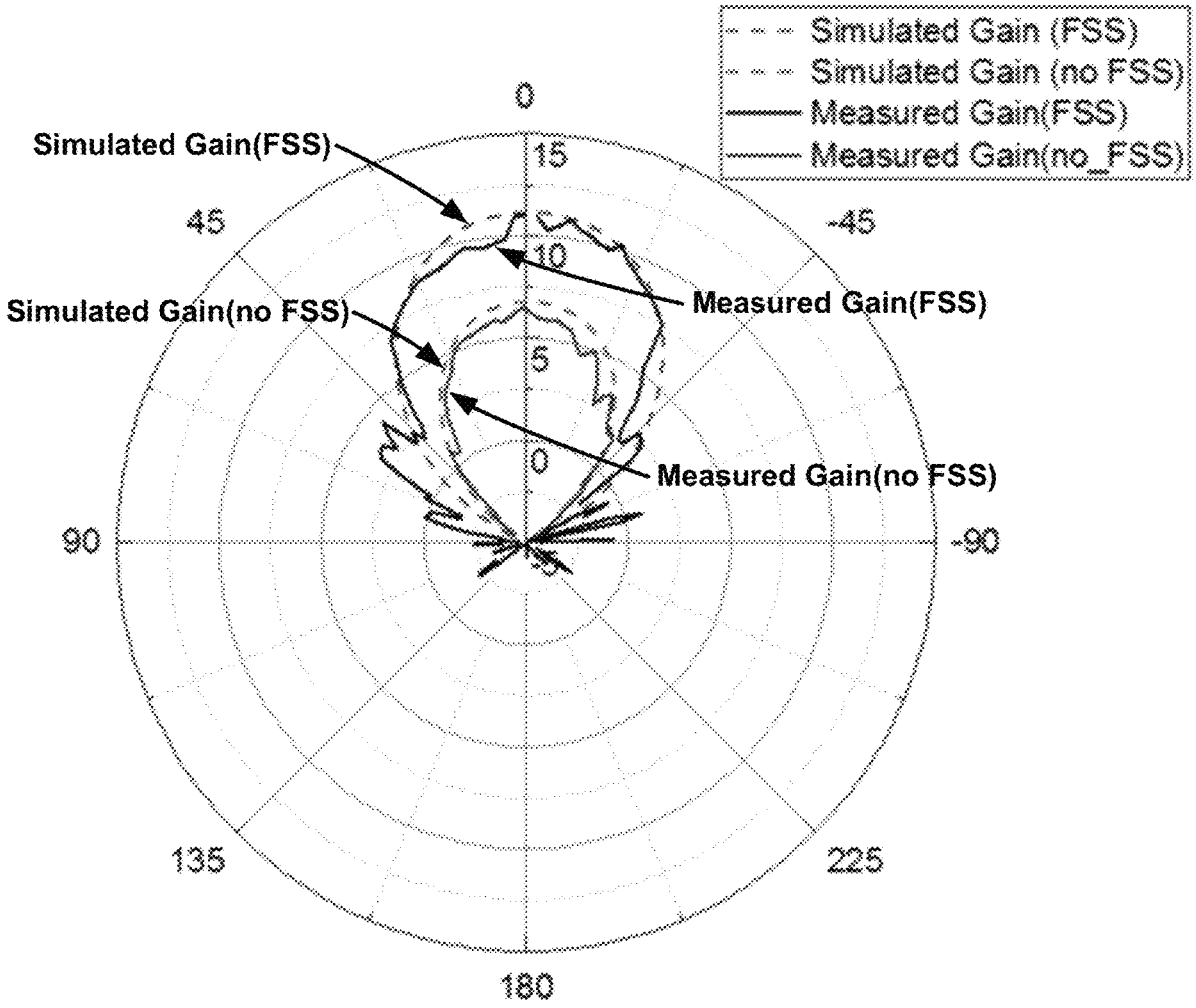
FIG. 6 illustrates a far-field gain comparison FPCA (source antenna with FSS) and source antenna without FSS, in accordance with one or more techniques of this disclosure.

One advantage of using FSS is evident when the phase of electric field is compared. FIG. 5*d* shows the phase comparison over the E-plane cut, A-A'. The phase variation for the FPCA is approximately 10° and consistent for other E-plane cut locations. In the reference antenna without FSS, the phase varies from 150° to 240° which is almost 90° over A-A'. This indicates that the aperture is not used efficiently compared to the FPCA design and can result in lower far-field gain. A gain comparison for the two cases is shown in FIG. 6. The gain for the FPCA system is 11.3 dB, which is approximately 4.5 dB higher than the reference source antenna.

The aperture efficiency is computed for the FPCA and source antenna using the equation below where G is the gain of the antenna, λ is the free space wavelength and $A_{ph}$ is the physical area. The value of $A_{ph}$ is $(27)^2$ mm$^2$. For the FPCA and source antenna, the gain is evaluated at 12.6 GHz and 13.2 GHz, respectively. The frequencies are different as observed in literature. Using the peak gain and frequency values from FIG. 6, the FPCA and source antenna aperture efficiencies are 84.5% and 30%, respectively, which is 2.8 times better.

$$\varepsilon_{ap} = \frac{G\lambda^2}{4\pi A_{ph}}$$

FIGS. 5*a*-5*d* illustrate a simulated E-field magnitude and phase comparison. FIG. 5*a* illustrates a near field beam of E-field magnitude 5 mm above the FSS in case of FPCA, FIG. 5*b* illustrates a near field beam of E-field magnitude 5 mm above the source antenna when no FSS is present, FIG. 5 illustrates a comparison of E-field magnitude along A-A', and FIG. 5*d* illustrates a comparison of E-field phase along A-A'.

FIG. 6 illustrates a far-field gain comparison FPCA (source antenna with FSS) and source antenna without FSS, in accordance with one or more techniques of this disclosure. The gain is measured in dB.

Near field magnitude and phase behavior were analyzed for FPCA system and source antenna without FSS. It shows that a square FSS aperture with optimized unit cells produce symmetrical near field beams with uniform phase in E-plane cut. The FSS effectively spreads the source antenna radiation over the physical area of the system. This increases the aperture efficiency to 84%, which leads to an increase in far-field gain.

Compact high-directivity antenna systems are needed for emerging applications like 5G, nano-satellite, Internet of Things etc. FPCA can fulfil this requirement. FPCA consists of a source antenna and an FSS. An FSS is a periodic arrangement of unit cells. It shapes near field radiation to use available aperture area more effectively. This increases aperture efficiency which in turn leads to higher antenna gain for similar physical area. This application provides design methodology for FPCA systems which produce a single concentrated beam in the near field of the antenna. Two types of source antennas are described—a microstrip fed patch antenna and an aperture coupled cavity backed slot antenna. The design is completely scalable in frequency. In certain examples, design variants resonate between 10-100 GHz (e.g., 12 GHz, 13.5 GHz, or 60 GHz). The best aperture efficiency obtained is 94% for slot antenna based FPCA system and 86% for patch antenna based FPCA system.

The slot antenna and patch antenna designs are discussed first with and without metallized side walls. This comparison gives an idea about the effect of side walls in introducing load on the antenna. Next, FPCA systems with slot and patch antenna are studied by considering three variations on the FSS:

1. The unit cell in the FSS is kept the same size but FSS aperture size is varied. This results in more unit cells in a single aperture as the FSS size increases;
2. The number of unit cells are kept the same as the size of the FSS aperture increases. This is done by increasing the size of the unit cell. The number of unit cells are determined by the configuration that results in best performance for different cases in variation 1; and
3. The separation between the FSS and the source antenna is changed for a fixed aperture size. It is hypothesized that as aperture size increases, the FSS might need to be placed higher above the source to illuminate the whole FSS efficiently.

The size of the source antenna is not changed while performing these studies. For all these three variations, reflection co-efficient ($S_{11}$) and gain is plotted against frequency. Polar plot for gain at resonance frequencies of each of these variations is also seen. Near-field electric field contours are also observed. The results are summarized in the conclusion.

Figure 7:
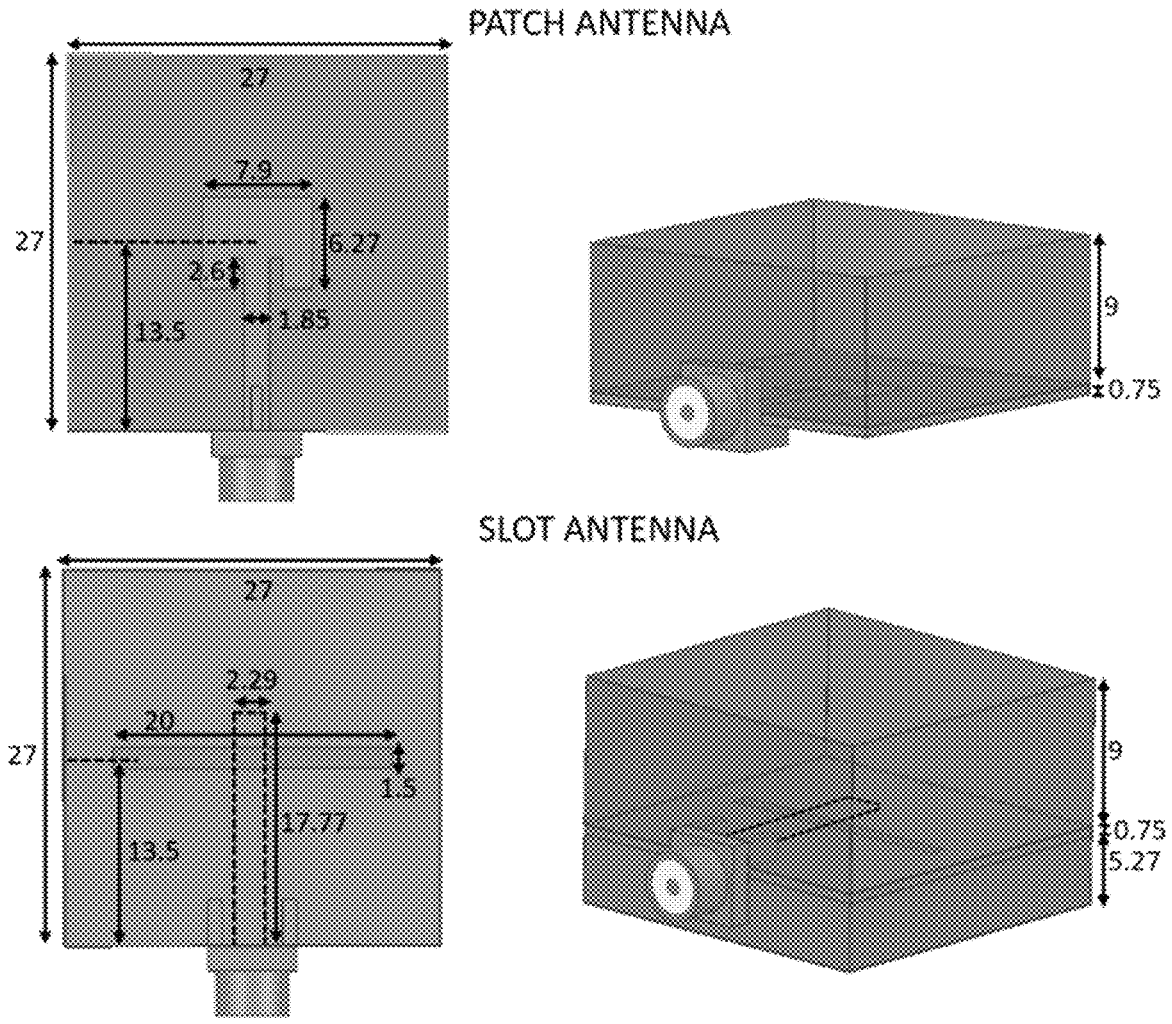
FIG. 7 is a schematic illustrating a slot antenna and a patch antenna, in accordance with one or more techniques of this disclosure.

FIG. 7 is a schematic illustrating a slot antenna and a patch antenna, in accordance with one or more techniques of this disclosure. All dimensions illustrated in FIG. 7 are given in millimeters. In some examples, the patch antenna is fed using a microstrip line. Additionally, in some examples, the slot antenna is fed using an aperture coupling with microstrip line on the reverse side. The antennas are made on Duroid substrate with a permittivity ($\varepsilon_r$) of 2.2. The slot antenna is cavity backed to direct all radiation towards the side where FSS will be placed. The copper thickness is 35 μm.

Figure 8B:
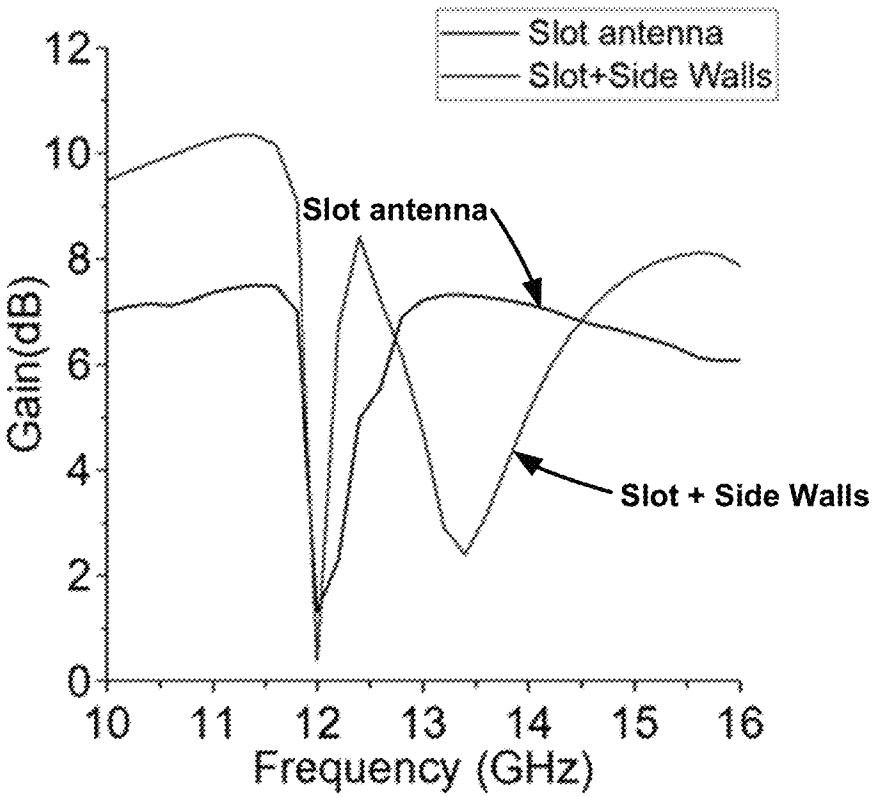
FIGS. 8*a*-8*b* show gain with respect to change in frequency for both patch and slot antenna when the structures are simulated with and without metallized side walls, in accordance with one or more techniques of this disclosure.
Figure 8A:
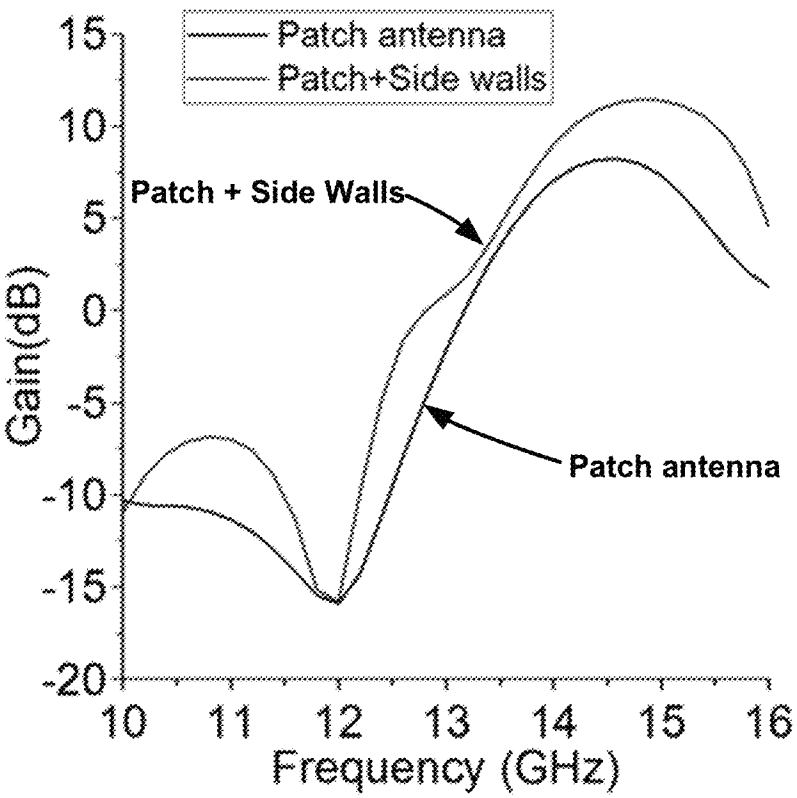

FIGS. 8*a*-8*b* show gain with respect to change in frequency for both patch and slot antenna when the structures are simulated with and without metallized side walls, in accordance with one or more techniques of this disclosure. The side-walls without presence of an FSS also increase the gain of the antenna. FIGS. 8*a*-8*b* illustrates simulated gain plotted against frequency for source antennas without FSS for two cases—with side walls and without side walls. FIG. 8*a* corresponds to patch antenna (14.8 GHz) and FIG. 8*b* corresponds to slot antenna (14.8 GHz). The gain increases due to confinement of radiation in a smaller angular range. Depending on the length of the side-walls, a cavity resonance is introduced which is seen by the dip in the simulated gain in FIGS. 8*a*-8*b*. This decreases the gain bandwidth. If the cavity-resonance coincides with the resonance frequency of the system, optimal performance won't result. The cavity resonance occurs at 13.3 GHz (shown by *) for the slot antenna which is simulated with side walls. The cavity resonance is not seen when side walls are not present. Due to this reason, the system is designed to operate at a frequency which is a different than the cavity resonance.

Figure 9B:
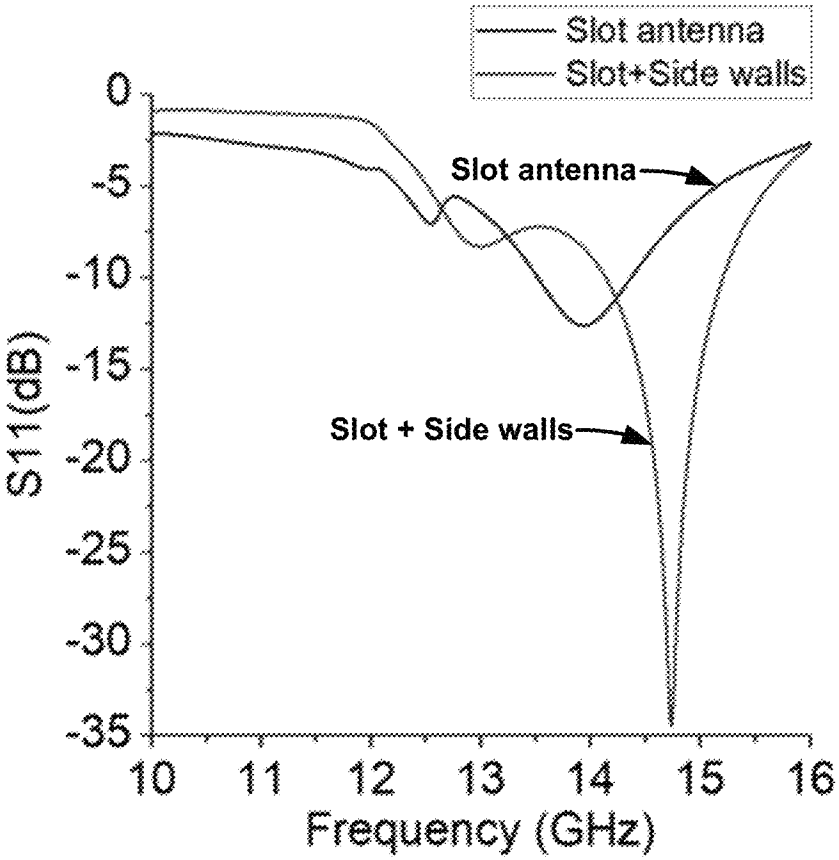
FIGS. 9*a*-9*b* is a plot of $S_{11}$ against frequency for both patch and slot antennas, in accordance with one or more techniques of this disclosure.
Figure 9A:
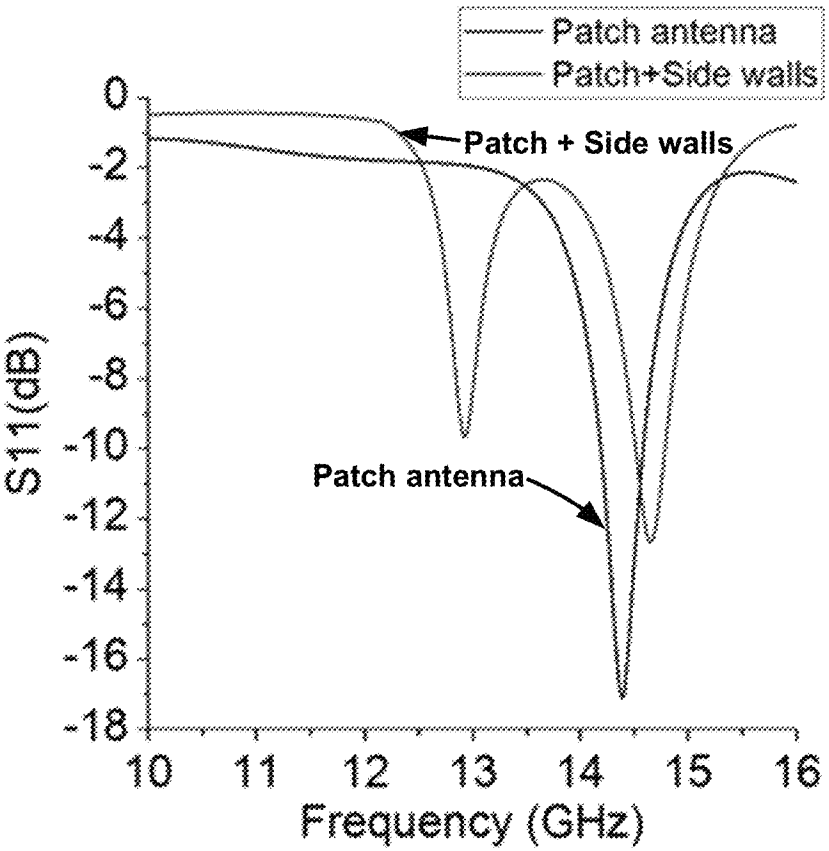

FIGS. 9*a*-9*b* is a plot of $S_{11}$ against frequency for both patch and slot antennas, in accordance with one or more techniques of this disclosure. FIGS. 9*a*-9*b* illustrate simulated S11 plotted against frequency for source antennas without FSS for two cases—with side walls and without side walls. FIG. 9*a* corresponds to a patch antenna, and FIG. 9*b* corresponds to a slot antenna. FIGS. 9*a*-9*b* show that inclusion of side walls shifts the resonance frequency by a small amount for Patch antenna. For the slot antenna, however, the shift is almost 1 GHz from 13.8 GHz to 14.8 GHz. This occurs because the ground plane size is altered when sidewalls are introduced. Slot antenna has a great reliance on the size of the ground plane, whereas, that is not the case for the patch antenna. Finally, after inclusion of sidewalls, the source antennas both resonate at 14.8 GHz. All changes in resonance and matching post this design are entirely due to inclusion of FSS.

The FSS is also known as partially reflective surface (PRS). It partly reflects the radiated electric field depending on the shape and size of the slots within the FSS. The geometry of slots are responsible for one or more beam formations in the near field of the FPCA structure (APS VE-FPCA). Only horizontally arranged slots in the FSS which align with the E-field direction radiated by the source antenna produce only a single beam in the near field.

Figure 10A:
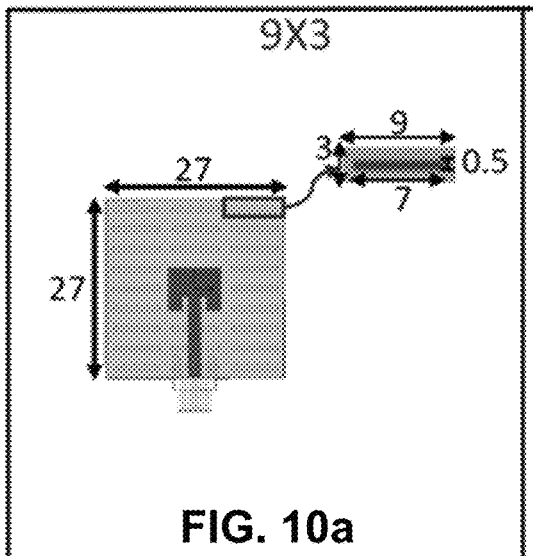
FIGS. 10*a*-10*d* illustrates FSS structures for a first parametric simulation shown relative to patch antenna for each case, in accordance with one or more techniques of this disclosure.

Square aperture for FSS is important to generate symmetric beams. An initial design with 9×3 horizontal unit cells was made as shown in FIG. 10*a*. As the FSS aperture is scaled for performing the first parametric simulations mentioned in the introduction, symmetric arrangement of unit cells is necessary. This involves an odd number of columns. Hence three other variations with 5, 7 and 9 columns were implemented by keeping the same unit cell size.

Figure 10B:
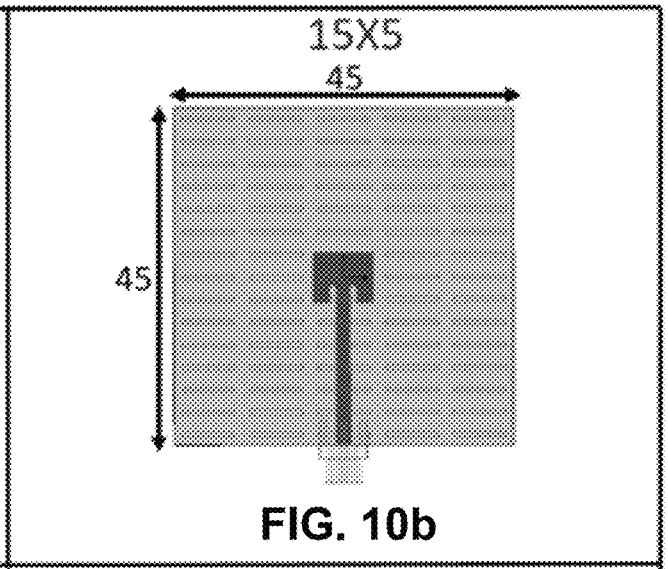
Figure 10C:
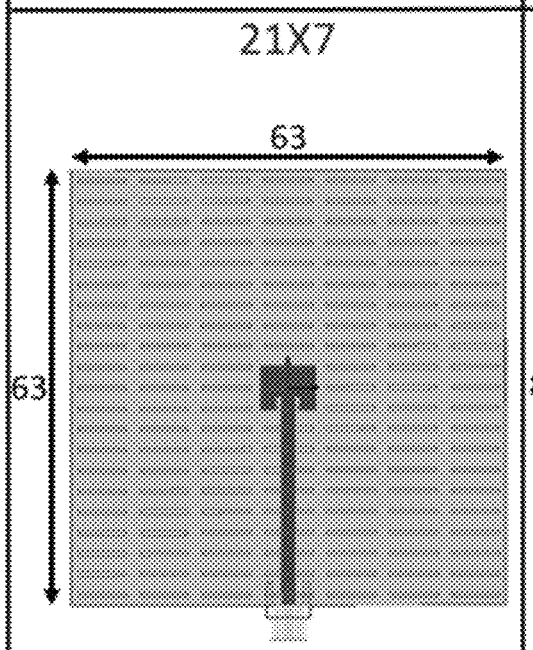
Figure 10D:
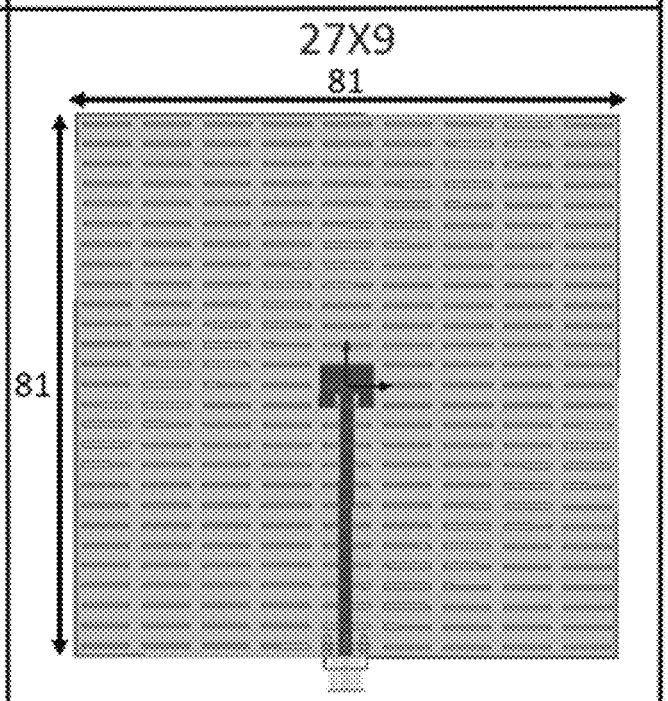

FIGS. 10*a*-10*d* illustrates FSS structures for $1^{st}$ parametric simulation shown relative to patch antenna for each case, in accordance with one or more techniques of this disclosure. All dimensions illustrated in FIGS. 10*a*-10*d* are in millimeters. FIG. 10*a* illustrates unit cell size indicated along with 27 mm×27 mm aperture, FIG. 10*b* illustrates an 45 mm×45 mm aperture, FIG. 10*c* illustrates a 63 mm×63 mm aperture, and FIG. 10*d* illustrates an 81 mm×81 mm aperture.

Figure 11A:
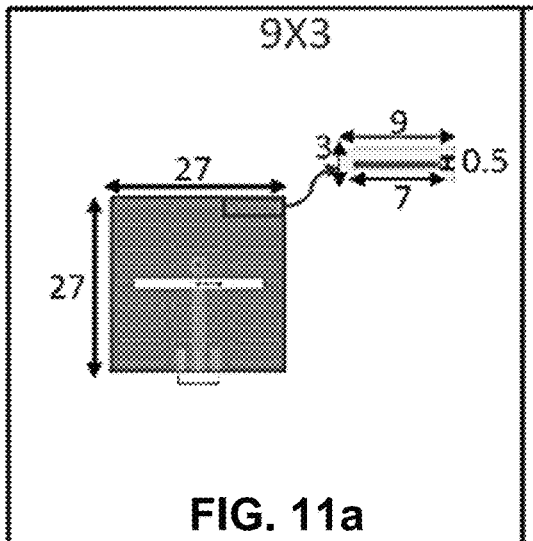
FIGS. 11*a*-11*d* illustrates FSS structures for varying aperture sizes for a fixed unit cell size shown relative to slot antenna for each case, in accordance with one or more techniques of this disclosure.
Figure 11B:
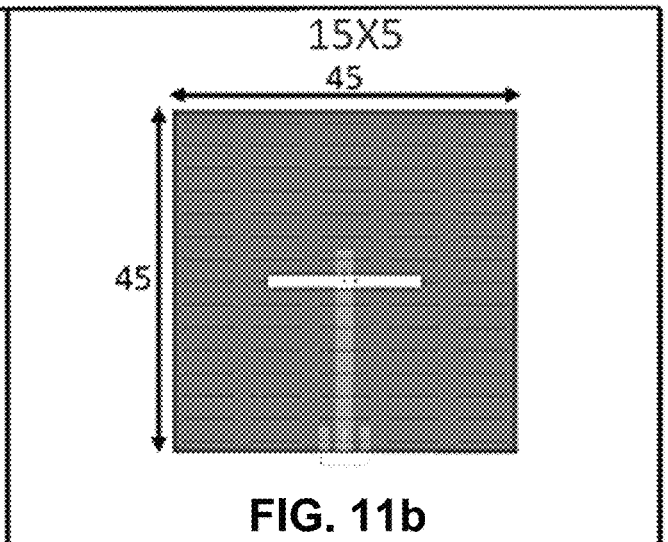
Figure 11C:
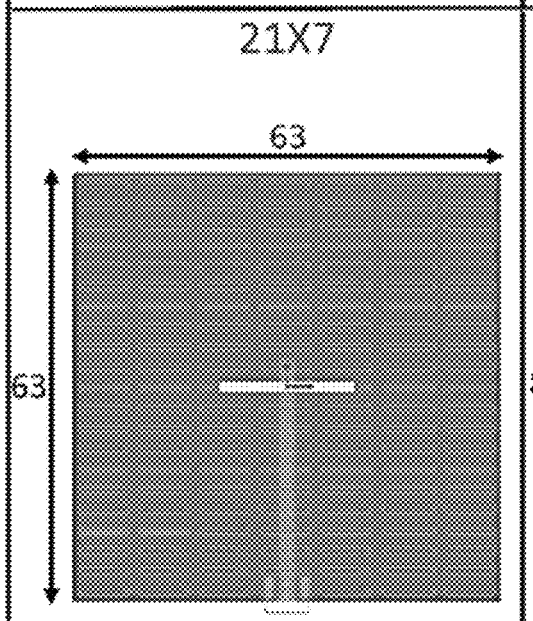
Figure 11D:
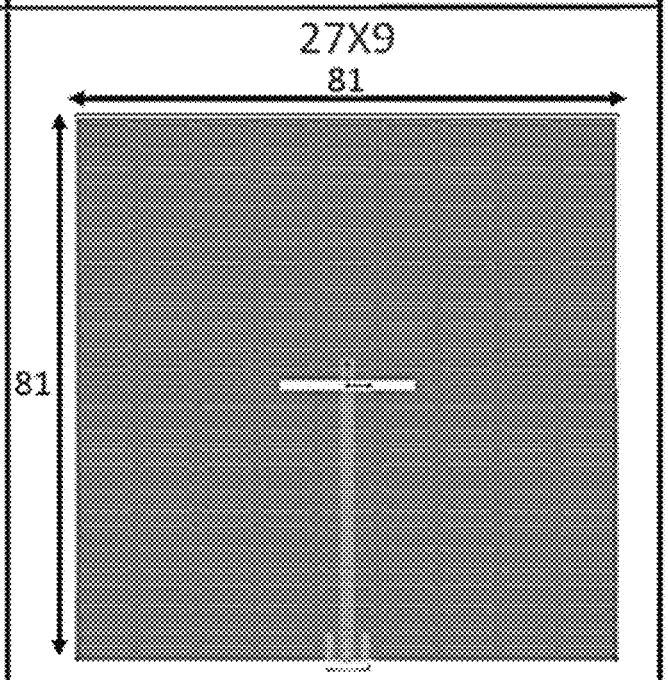

FIGS. 11*a*-11*d* illustrates FSS structures for varying aperture sizes for a fixed unit cell size shown relative to slot antenna for each case, in accordance with one or more techniques of this disclosure. 11*a*-11*d* are in mm. FIG. 11*a* illustrates unit cell size indicated along with 27 mm×27 mm aperture, FIG. 11*b* illustrates a 45 mm×45 mm aperture, FIG. 11*c* illustrates a 63 mm×63 mm aperture, and FIG. 11*b* illustrates an 81 mm×81 mm aperture.

To maintain square nature of aperture, the aspect ratio of rows and columns must be kept the same. Hence, the different apertures finally contain 15×5, 21×7 and 27×9 unit cells shown in FIG. 10*b*, FIG. 4*c* and FIG. 4*d* respectively. FIG. 11 shows a similar case of different aperture sizes with respect to slot antenna. All the FSS structures are made on Duroid with $\varepsilon_r$ of 2.2 and thickness of 0.5 mm. The patch antenna and slot antenna are highlighted in the background to indicate the relative antenna area to FSS area. FIG. 10*a* and FIG. 11*a* have the highest ratio of antenna area to FSS aperture area.

The 9×3 unit cell configuration in FIG. 10*a* and FIG. 11*a* results in highest aperture efficiency for both source antennas. This will be shown in the next section which deals with discussion of the first parametric simulation.

Figure 12:
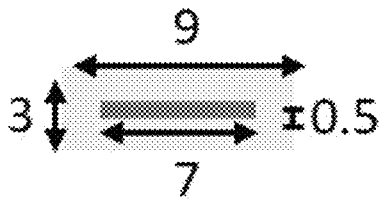
FIG. 12 is a table illustrating unit cell sizes of different FSS aperture sizes, in accordance with one or more techniques of this disclosure.
Figure 12:
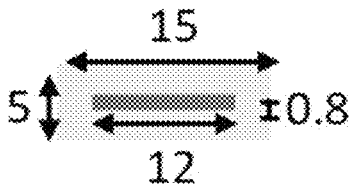
Figure 12:
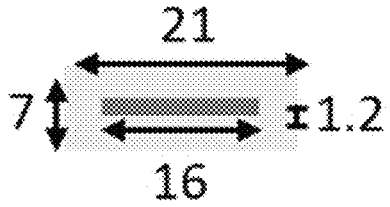
Figure 12:
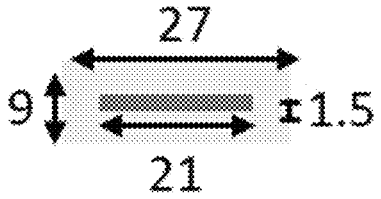

Fixed array. For the second parametric simulation, 9×3 configuration of slots is hence kept intact as the size of the aperture is changed to 45 mm×45 mm, 63 mm×63 mm and 81 mm×81 mm. FIG. 12 shows the modified unit cell size for each aperture size to maintain the 9×3 unit cell configuration.

FIG. 12 is a table illustrating unit cell sizes of different FSS aperture sizes, in accordance with one or more techniques of this disclosure. All dimensions are in millimeters. Since the unit cell size is changed, it is necessary to perform Floquet mode analysis on each of the unit cells. The Floquet mode analysis gives an indication of amount of radiation leaked and amount of radiation reflected by the unit cell. It also shows the self-resonance frequency of the unit cell using $S_{11}$ measurement. The self-resonance frequency is the point where the FSS acts transparent. FIG. 12 shows the $S_{11}$ plot vs frequency for each of the unit cells. Results indicate that a good design is obtained when the leakage is less than 5%. All structures are measured form 11 GHz to 16 GHz. FIG. 12 indicates that when the unit cell length is 15 mm, the self-resonance frequency lies within this range. In rest of the three cases, the amount of leakage in 11 GHz to 16 GHz is similar even though operation is on different sides of the self-resonance null. In some examples, the size of the aperture may be inversely related to a frequency of electromagnetic signals emitted by the FSS. For example, it may be beneficial to decrease the apertures size in response to an increase in the frequency of signals emitted by the FSS and it may be beneficial to increase the apertures size in response to a decrease in the frequency of signals emitted by the FSS. In some examples, the inverse relationship between the size of the aperture and the frequency is proportional. That is, as one non-limiting example, if the frequency increases by a factor of 5, the aperture size may decrease by a factor of five.

Figure 13:
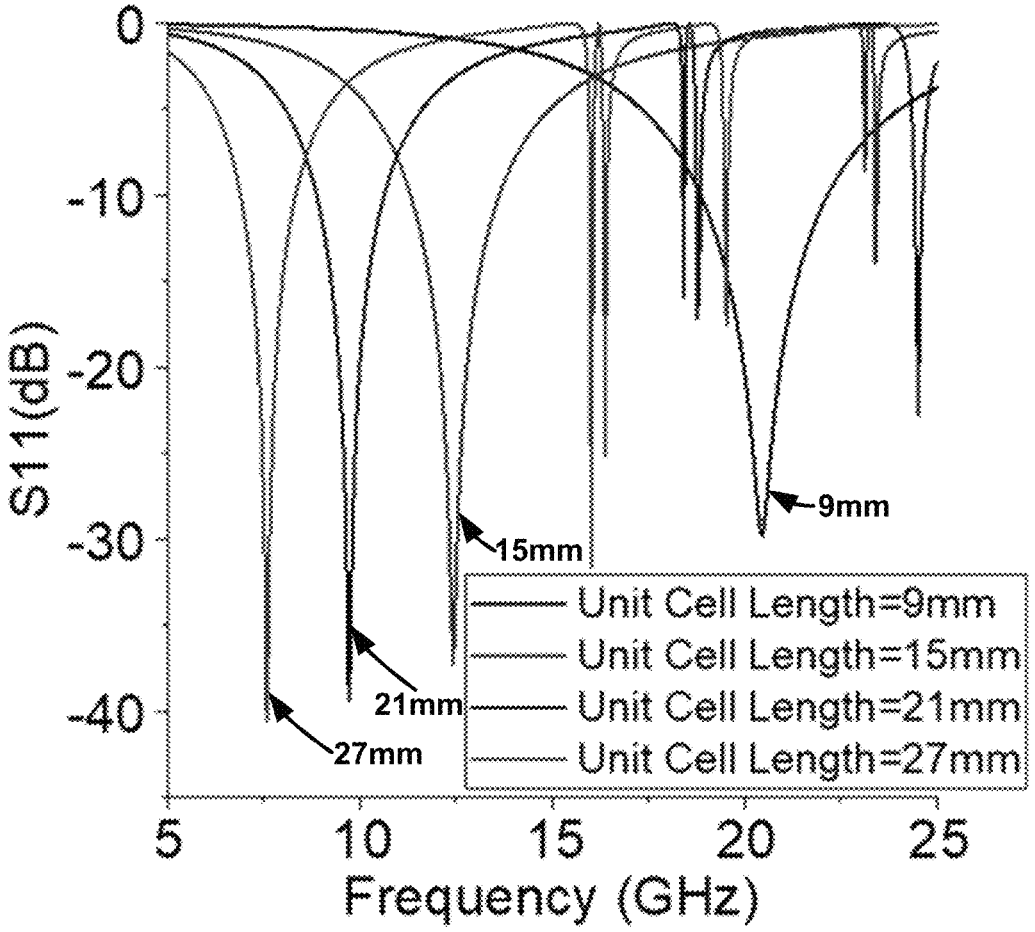
FIG. 13 is a plot diagram illustrating $S_{11}$ vs Frequency for each unit cell configuration in FIG. 12, in accordance with one or more techniques of this disclosure.

FIG. 13 is a plot diagram illustrating $S_{11}$ vs Frequency for each unit cell configuration in FIG. 12, in accordance with one or more techniques of this disclosure. Nulls indicate self-resonance frequency. Patch antenna and slot antenna were used with four different aperture sizes mentioned in the previous section. The unit cell size was kept the same for all the different apertures. This unit cell is shown in FIG. 10*a* and FIG. 11*a*. Both the source antennas without FSS resonate at 14.8 GHz as seen in FIGS. 9*a*-9*b*. Placing the FSS, however, has a different loading effect on each of the source antenna.

Figure 14:
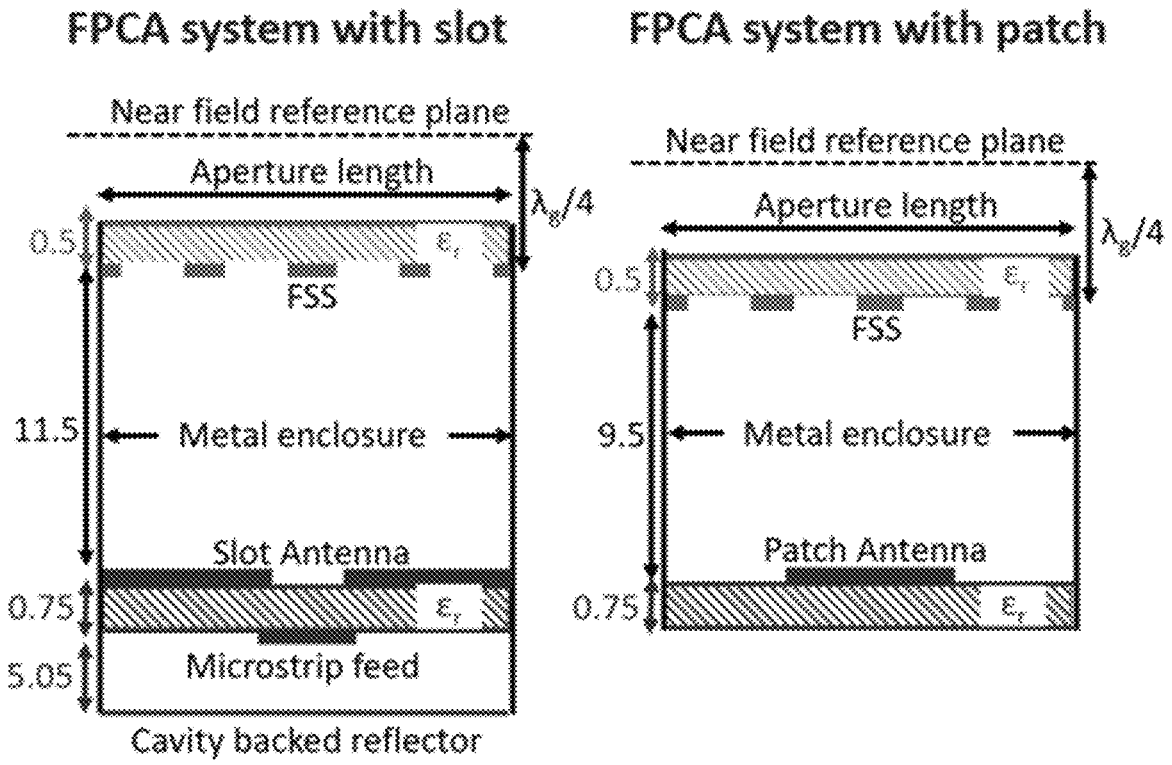
FIG. 14 illustrates the 2D cross-section of the FPCA system using slot antenna and patch antenna, in accordance with one or more techniques of this disclosure.

FIG. 14 illustrates the 2D cross-section of the FPCA system using slot antenna and patch antenna, in accordance with one or more techniques of this disclosure. FIG. 14 illustrates a 2D cross-section of the FPCA system with both source antennas. All dimensions are in millimeters. Value of $\varepsilon_r$ is 2.2. Aperture length can be 27 mm, 45 mm, 63 mm or 81 mm. The distance between the FSS and source antenna is different in both cases. In the FPCA implementation using slot antenna, the distance is 11.5 mm. In the FPCA implementation using patch antenna, the distance is 9.5 mm. This discrepancy is due to different resonance frequencies of both structures which results due to different loading effect of the FSS. This is explained below.

Figure 15:
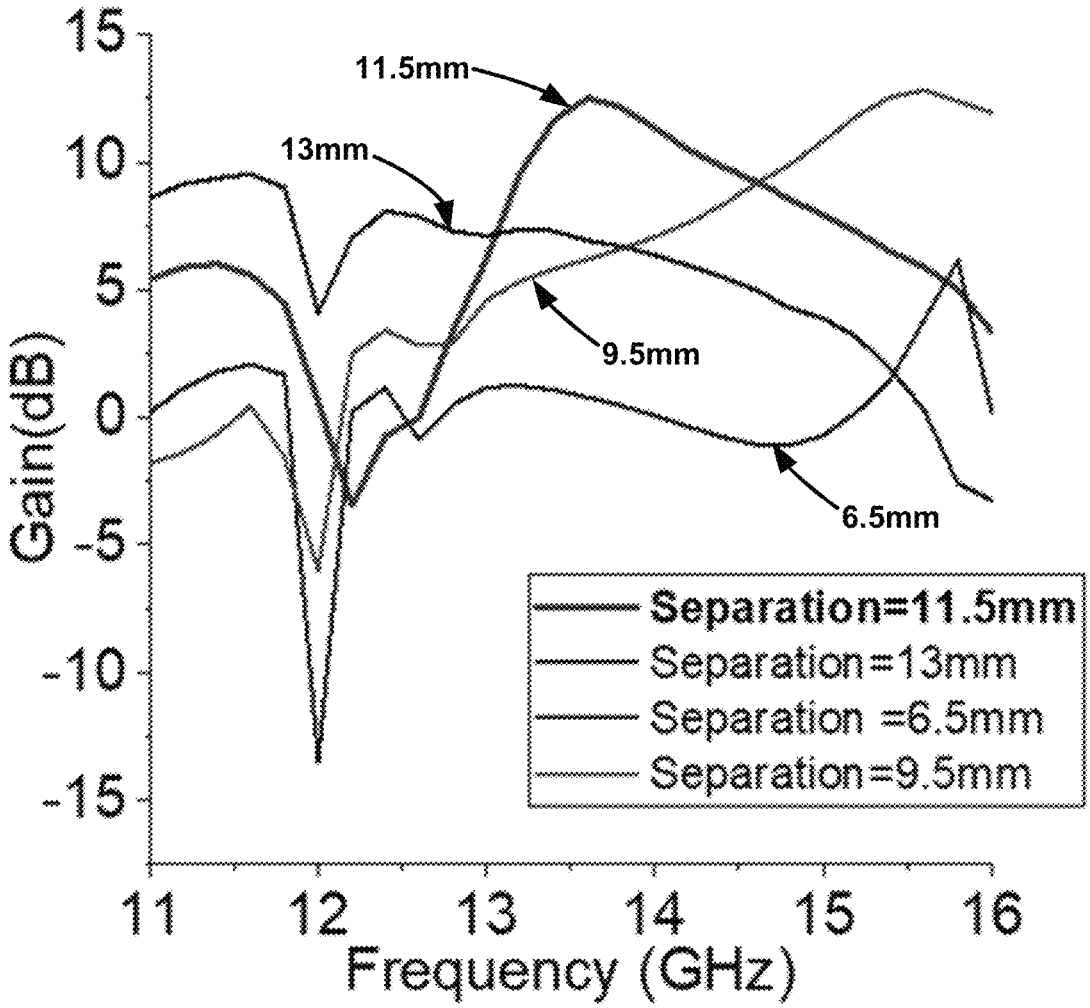
FIG. 15 is a plot diagram illustrating gain vs frequency curve for FPCA system with slot antenna as the source and aperture size of 27 mm×27 mm, in accordance with one or more techniques of this disclosure.

The slot antenna system with aperture measuring 27 mm×27 mm was first analyzed. Recall that this aperture has 9×3 unit cell configuration. The distance between the FSS and antenna was varied until the best result was achieved. FIG. 15 shows plot of gain vs frequency for different separation values between FSS and slot antenna. Separation of 11.5 mm between the slot antenna and FSS results in the highest gain for the system. The gain is 12.5 dB at 13.6 GHz. On further analysis, it is seen that 11.5 mm is $\lambda_0/2$ away from the source antenna at 13.6 GHz.

FIG. 15 is a plot diagram illustrating gain vs frequency curve for FPCA system with slot antenna as the source and aperture size of 27 mm×27 mm, in accordance with one or more techniques of this disclosure. Separation values are the distance between FSS and source antenna.

Figure 16:
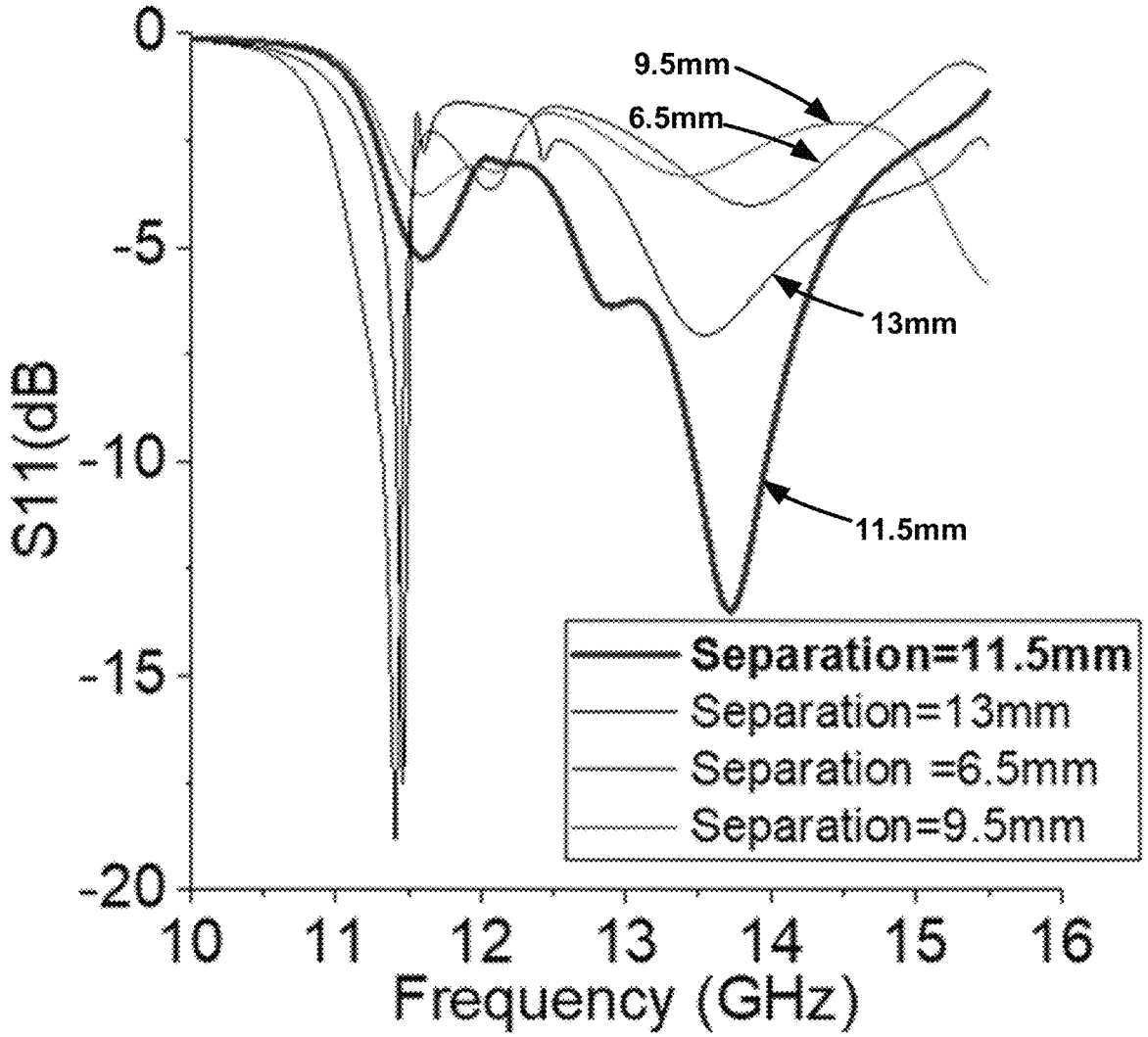
FIG. 16 is a plot diagram illustrating $S_{11}$ vs frequency curve for FPCA system with slot antenna as the source and aperture size of 27 mm×27 mm, in accordance with one or more techniques of this disclosure.

FIG. 16 is a plot diagram illustrating $S_{11}$ vs frequency curve for FPCA system with slot antenna as the source and aperture size of 27 mm×27 mm, in accordance with one or more techniques of this disclosure. Separation values are the distance between FSS and source antenna.

Even at other separation values, the peak gain is obtained at the frequency where the height is a factor of $\lambda_0/2$. For example, separation of 9.5 mm is $\lambda_0/2$ for 15.7 GHz. FIG. 15 shows that peak gain is obtained around 15.5 GHz at a separation of 9.5 mm. This validates the $\lambda_0/2$ theory. The gain at 15.5 GHz is around 12.5 dB and similar to the gain obtained at 13.6 GHz using separation of 11.5 mm between FSS and source antenna. For the system peaking in gain at 15.5 GHz, good matching is not obtained as seen by the $S_{11}$ curve in FIG. 16. On the contrary, the system, peaking in gain at 13.6 GHz is well matched (FIG. 16). Bad matching at 15.5 GHz does not allow the antenna to radiate effectively. Consequently, even though the gain performance is similar, the antenna is not as efficient as 13.6 GHz system. The measure of efficiency is given by the aperture efficiency ($\varepsilon_{ap}$) metric in the below equation.

$$\varepsilon_{AP} = \frac{10^{Gain(dB)} * \lambda_0^2}{4\pi * A_{ph}}$$

$A_{ph}$ is the physical area which in this case is 27 mm×27 mm. Table 1 indicates aperture efficiency for all four separation values. A similar analysis is performed for the patch antenna.

TABLE 1

Aperture efficiency for slot antenna based FPCA system with aperture of 27 mm × 27 mm for four separation values in FIG. 8 and FIG. 16.

| Separation Value | Aperture Efficiency using (1) | Frequency of calculation |
|---|---|---|
| 6.5 mm | 15.65% | 15.8 GHz |
| 9.5 mm | 72.68% | 15.5 GHz |
| 11.5 mm | 94.59% | 13.6 GHz |
| 13 mm | 67.36% | 11.8 GHz |

Figure 17:
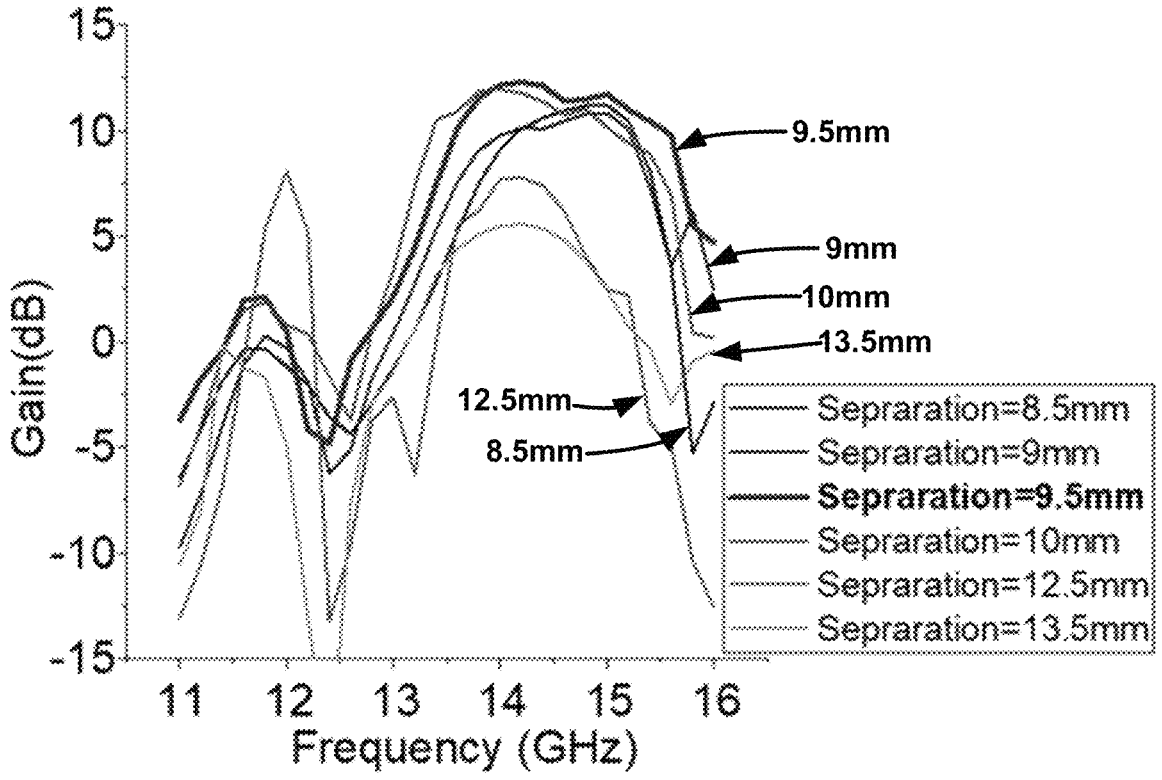
FIG. 17 is a plot diagram illustrating gain vs frequency curve for FPCA system with patch antenna as the source and aperture size of 27 mm×27 mm, in accordance with one or more techniques of this disclosure.

FIG. 17 is a plot diagram illustrating gain vs frequency curve for FPCA system with patch antenna as the source and aperture size of 27 mm×27 mm, in accordance with one or more techniques of this disclosure. Separation values are the distance between FSS and source antenna.

Figure 18:
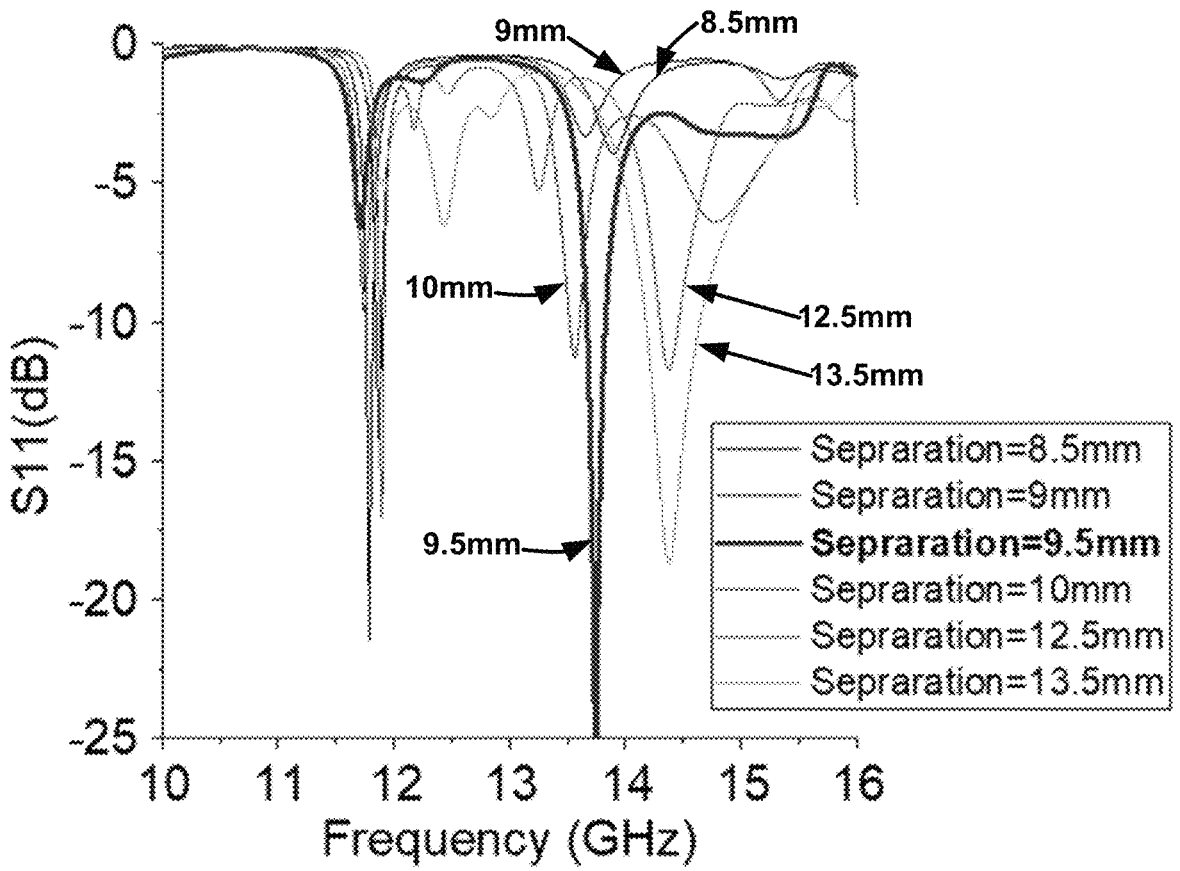
FIG. 18 is a plot diagram illustrating $S_{11}$ vs frequency curve for FPCA system with patch antenna as the source and aperture size of 27 mm×27 mm, in accordance with one or more techniques of this disclosure.

FIG. 18 is a plot diagram illustrating $S_{11}$ vs frequency curve for FPCA system with patch antenna as the source and aperture size of 27 mm×27 mm, in accordance with one or more techniques of this disclosure. Separation values are the distance between FSS and source antenna.

FIG. 17 and FIG. 18 show the plot of gain vs frequency and $S_{11}$ vs frequency respectively. Separation of 9.5 mm yields the best gain and the matching is around 14 GHz. Variation in separation distance between FSS and patch antenna does not shift the matching frequency as much as it does for the slot antenna. This indicates that the loading effect of FSS is less prominent for the patch antenna. Table 3 indicates the aperture efficiency for the Patch antenna. Separation of 9.5 mm give the highest aperture efficiency of 85%.

Both the optimally designed source antennas are then used for performing the three parametric simulations mentioned in the introduction. The first parametric simulation is discussed in the next section.

TABLE 2

Aperture efficiency for patch antenna based FPCA system with aperture of 27 mm × 27 mm for four separation values in FIG. 10 and FIG. 18.

| Separation Value | Aperture Efficiency using (1) | Frequency of calculation |
|---|---|---|
| 8.5 mm | 57.69% | 15 GHz |
| 9 mm | 52.83% | 15 GHz |
| 9.5 mm | 85.05% | 14 GHz |
| 10 mm | 78.46% | 14 GHz |
| 12.5 mm | 43.94% | 12 GHz |
| 13.5 mm | 17.72% | 14 GHz |

Figure 19:
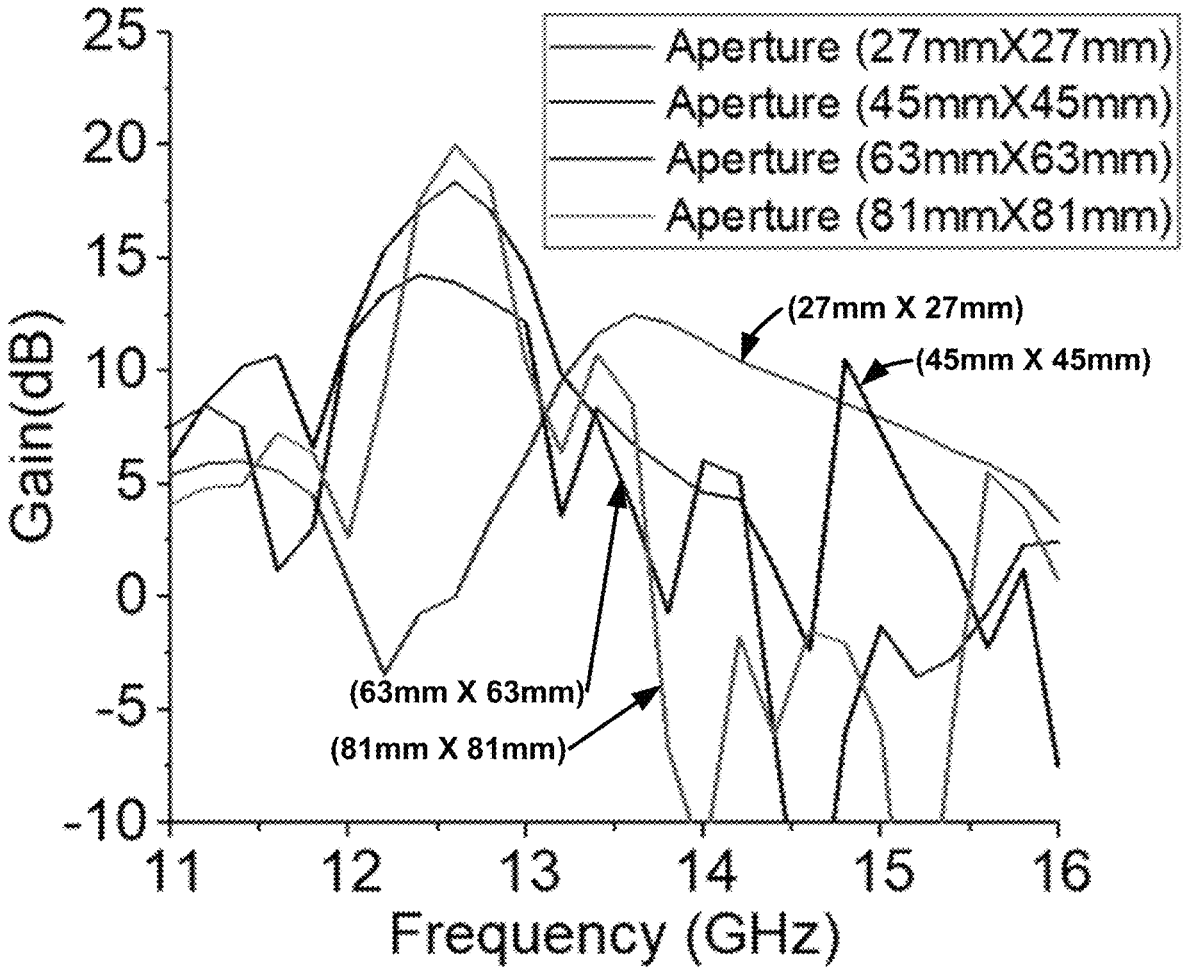
FIG. 19 is a plot diagram illustrating gain vs frequency curve for FPCA system with slot antenna as the source, in accordance with one or more techniques of this disclosure.

FIG. 19 is a plot diagram illustrating gain vs frequency curve for FPCA system with slot antenna as the source, in accordance with one or more techniques of this disclosure. Curves are plotted for different aperture sizes.

Figure 20:
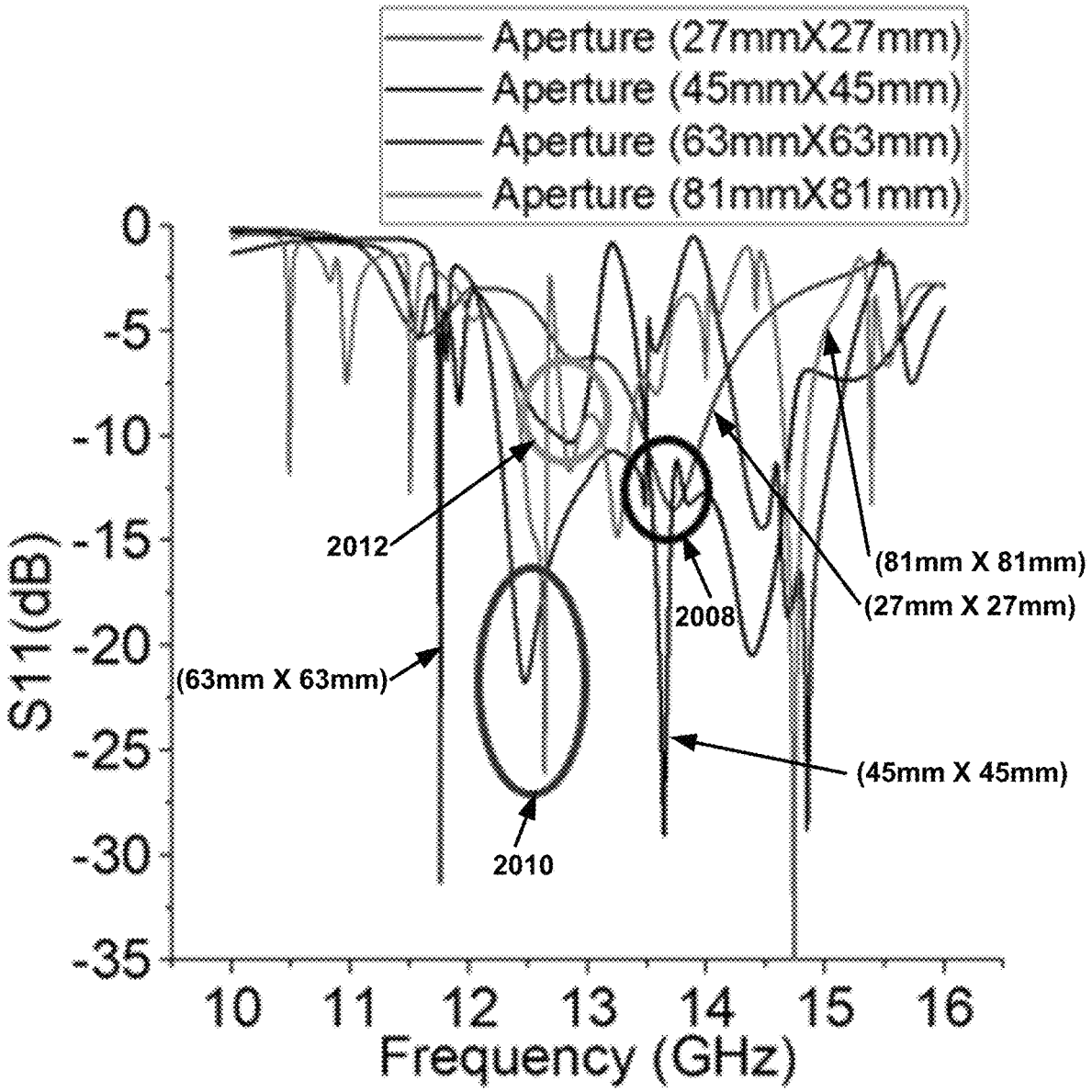
FIG. 20 is a plot diagram illustrating $S_{11}$ vs frequency curve for FPCA system with slot antenna as the source, in accordance with one or more techniques of this disclosure.

FIG. 20 is a plot diagram illustrating $S_{11}$ vs frequency curve for FPCA system with slot antenna as the source, in accordance with one or more techniques of this disclosure. Curves are plotted for different aperture sizes. Circles indicate matching points for different aperture sizes.

In case of slot antenna as the source, the 11.5 mm separation between slot antenna and the FSS was carried forward for the other three aperture sizes (45 mm×45 mm, 63 mm×63 mm and 81 mm×81 mm). Gain and $S_{11}$ is plotted against frequency for all the four aperture sizes in FIG. 19 and FIG. 20 respectively. As seen from FIG. 19, increasing aperture size does increase the gain as the antenna starts becoming electrically larger.

Aperture measuring 27 mm×27 mm has a peak gain at 13.4 GHz (FIG. 19) as shown earlier. It is also matched at that frequency (circle 2008 in FIG. 20). For all the three larger apertures, the resonance frequency is around 12.4 GHz. This frequency stabilization is a very important scaling result. As indicated by the circle 2010 in FIG. 20, good matching (>−20 dB) is achieved at for 63 mm×63 mm and 81 mm×81 mm apertures around 12.4 GHz. As indicated by the circle 2012, matching is not as good (−10 dB) and little higher in frequency for the 45 mm×45 mm aperture.

TABLE 3

Aperture efficiency and peak gain for all the four aperture sizes. The frequency at which the peak gain results and the value of the gain is also indicated.

| Aperture Size | Frequency | Peak Gain | Aperture Efficiency using (1) |
|---|---|---|---|
| 27 mm × 27 mm | 13.6 GHz | 12.5 dB | 94.59% |
| 45 mm × 45 mm | 12.3 GHz | 14.3 dB | 61.89% |
| 63 mm × 63 mm | 12.6 GHz | 18.4 dB | 78.03% |
| 81 mm × 81 mm | 12.6 GHz | 20 dB | 68.70% |

Table 3 shows that as the aperture size increases, the aperture efficiency drops to about 70%. For the aperture measuring 45 mm×45 mm, the efficiency is a little lower. This can be attributed to mismatch in the design. The electric field contours are observed in the near-field reference plane. The location of the plane for both the slot and patch antenna systems can be seen in FIG. 14.

Figure 21:
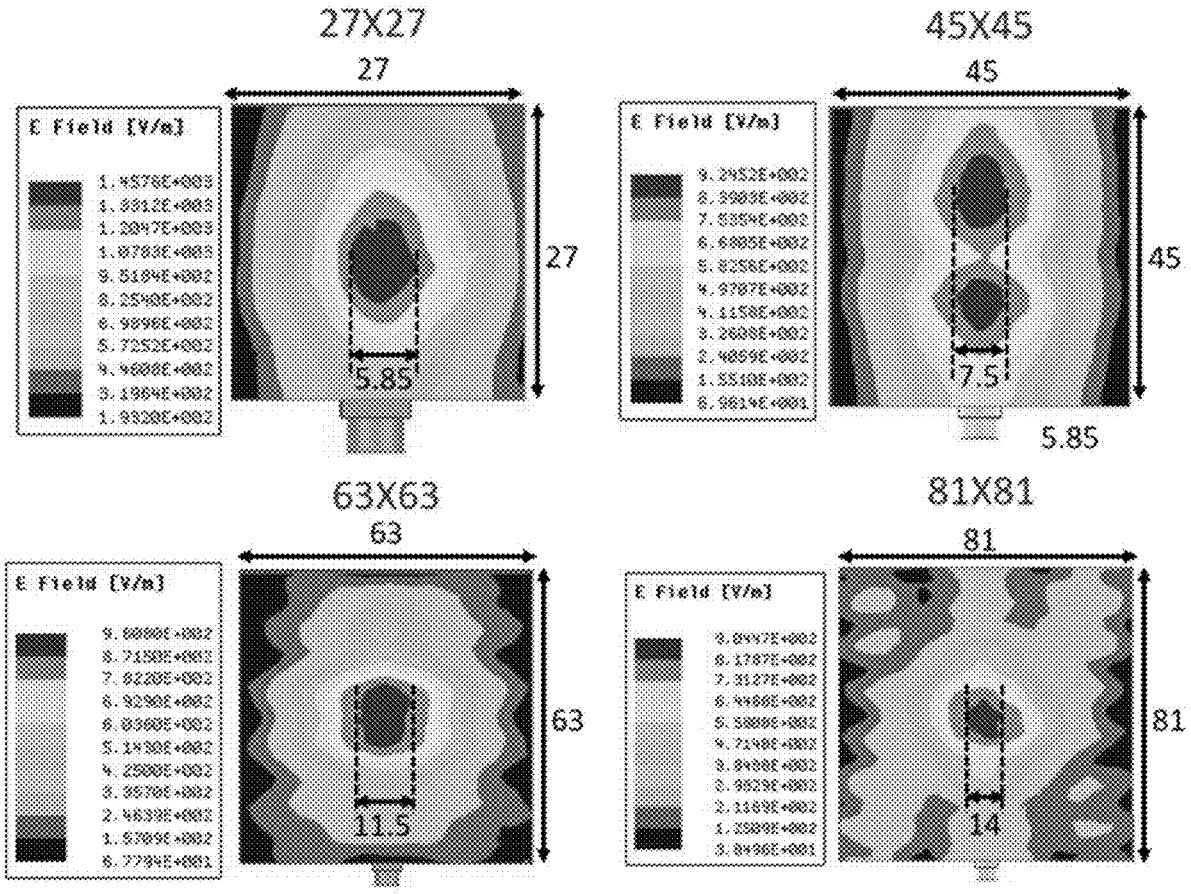
FIG. 21 illustrates near field E-field magnitude contours showing aperture illumination and width of the main beam for all four aperture sizes, in accordance with one or more techniques of this disclosure.

FIG. 21 illustrates near field E-field magnitude contours showing aperture illumination and width of the main beam for all four aperture sizes, in accordance with one or more techniques of this disclosure. All dimensions illustrated in FIG. 21 are in millimeters.

The magnitude of main beam is relatively high for the smallest aperture (27 mm×27 mm). The peak magnitude is ~1450V/m for the smallest aperture and around 950V/m for other three apertures. This shows that the beam for the smallest aperture is very concentrated. The darkest region is also the smallest indicating almost complete aperture illumination. The second aperture measuring 45 mm×45 mm did not achieve a convergent single beam at resonance frequency. The reference plane was moved to observe if the two beams converged at a height greater than λ/4. A convergence is achieved at 0.27λ but the beam was not uniform. Table 4 gives a ratio of the main beam width to aperture width for all the aperture sizes. This ratio has a similar trend to aperture efficiency (Table 3), thus acting as an important design guide.

Figure 22:
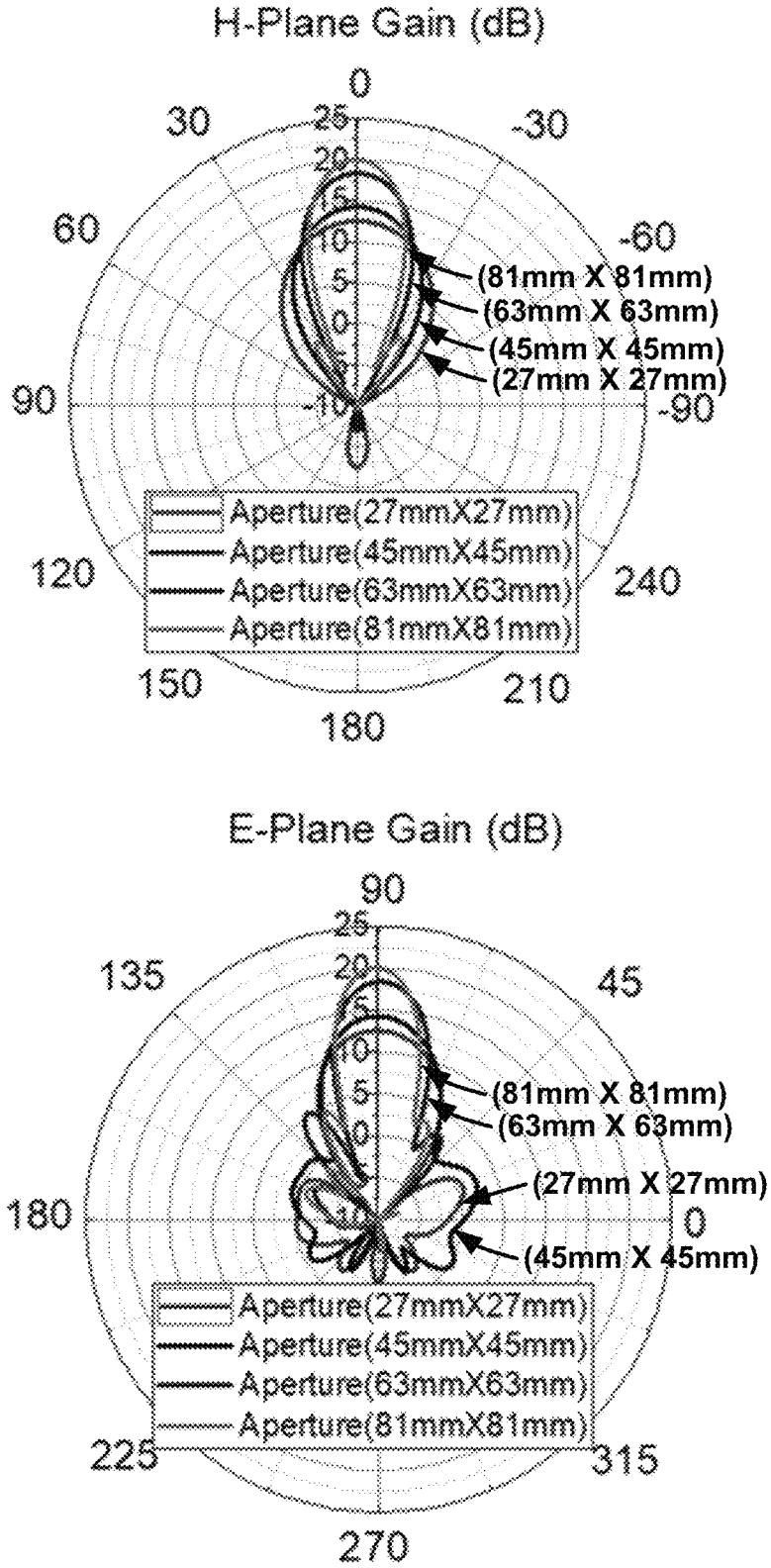
FIG. 22 illustrates polar plots for gain in E-Plane and H-Plane for FPCA system with slot antenna as the source, in accordance with one or more techniques of this disclosure.

FIG. 22 illustrates polar plots for gain in E-Plane and H-Plane for FPCA system with slot antenna as the source, in accordance with one or more techniques of this disclosure. Curves are plotted for different aperture sizes, in accordance with one or more techniques of this disclosure.

FIG. 22 shows the E-plane and H-plane far-field gain plots for all the four aperture sizes at frequencies indicated in Table 3 and Table 4. E-Plane and H-Plane gain plots show that the beam is directed boresight for all the apertures. E-Plane shows a greater amount of back-radiation than H-Plane.

TABLE 4

Ratio of main beam width to aperture width for slot antenna based FPCA system for all four aperture sizes.

| Aperture Size | Frequency | Main beam width/Aperture width |
|---|---|---|
| 27 mm × 27 mm | 13.6 GHz | 0.22 |
| 45 mm × 45 mm | 12.4 GHz | 0.16 |
| 63 mm × 63 mm | 12.6 GHz | 0.182 |
| 81 mm × 81 mm | 12.6 GHz | 0.17 |

Next sub-section provides a similar analysis or the FPCA system with patch antenna as the source.

Figure 23:
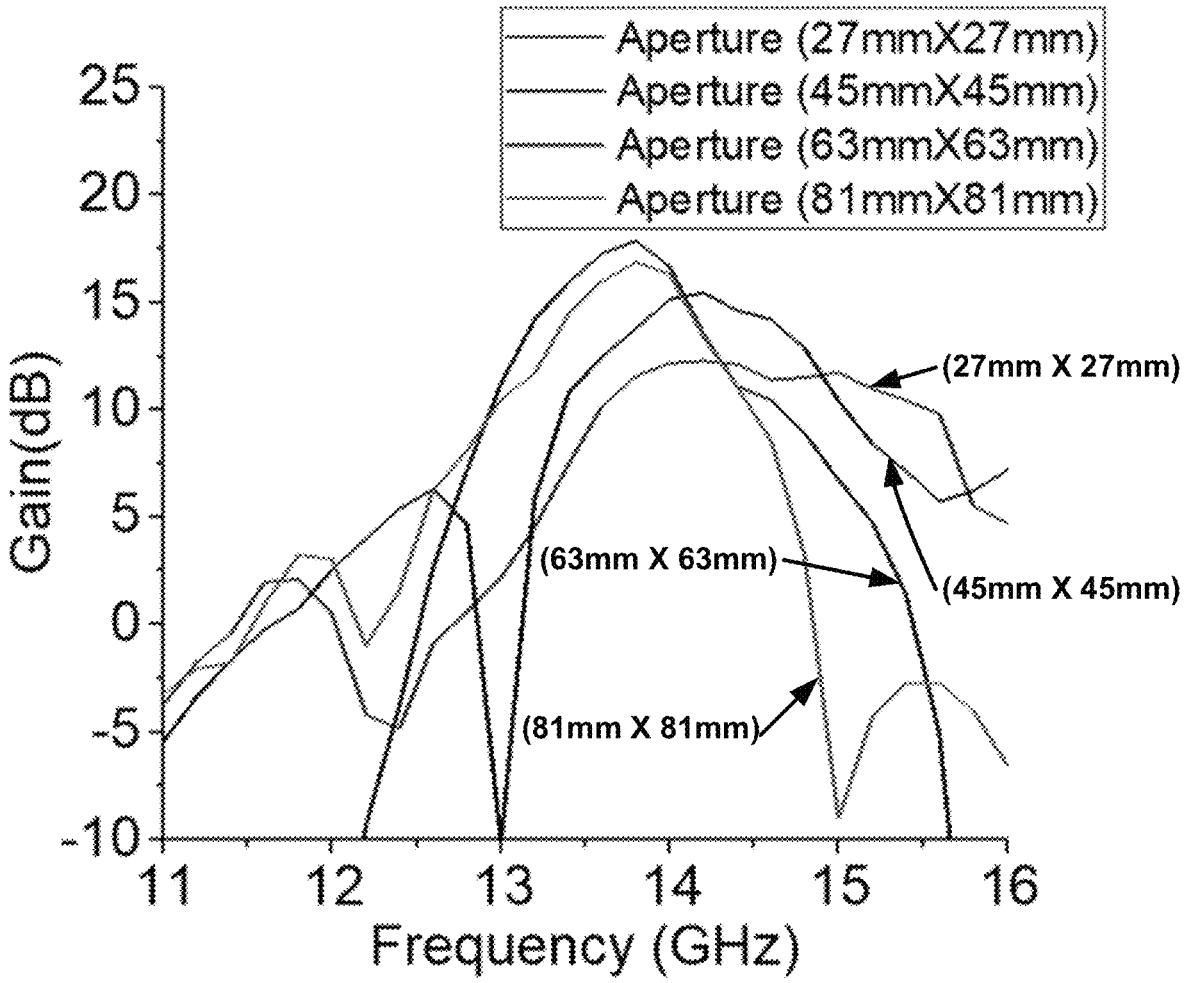
FIG. 23 is a plot diagram illustrating gain vs frequency curve for FPCA system with patch antenna as the source, in accordance with one or more techniques of this disclosure.

FIG. 23 is a plot diagram illustrating gain vs frequency curve for FPCA system with patch antenna as the source, in accordance with one or more techniques of this disclosure. Curves are plotted for different aperture sizes.

Figure 24:
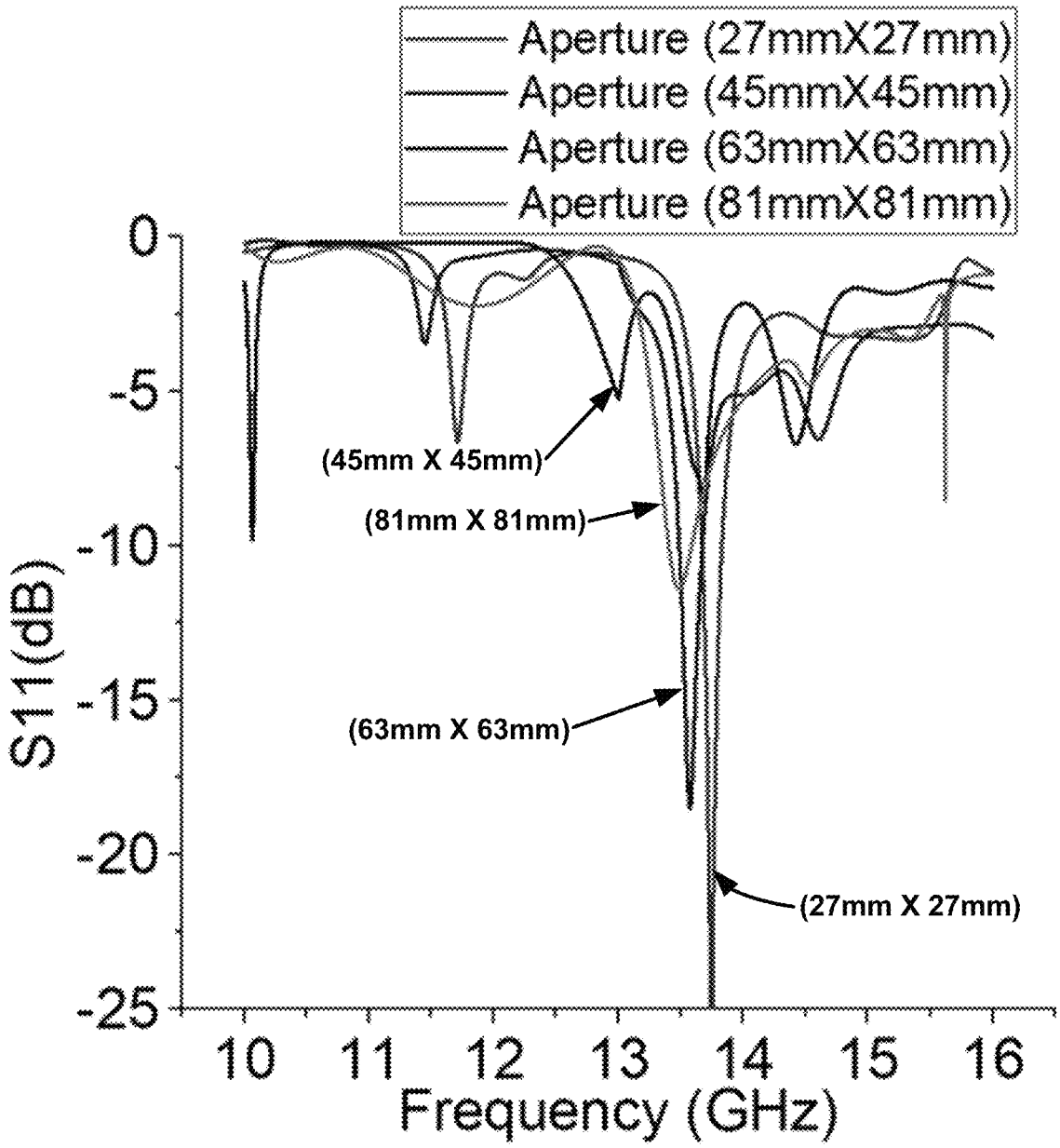
FIG. 24 is a plot diagram illustrating $S_{11}$ vs frequency curve for FPCA system with patch antenna as the source, in accordance with one or more techniques of this disclosure.

FIG. 24 is a plot diagram illustrating $S_{11}$ vs frequency curve for FPCA system with patch antenna as the source, in accordance with one or more techniques of this disclosure. Curves are plotted for different aperture sizes.

In case of patch antenna as the source, the 9.5 mm separation between patch antenna and the FSS was carried forward for the other three aperture sizes (45 mm×45 mm, 63 mm×63 mm and 81 mm×81 mm). Gain and $S_{11}$ is plotted against frequency for all the four aperture sizes in FIG. 23 and FIG. 24 respectively. As seen from FIG. 23, increasing aperture size does increase the gain as the antenna starts becoming electrically larger. For the aperture measuring 81 mm×81 mm however, the gain drops. This was not the case for the slot antenna based FPCA system (FIG. 19). The drop can be attributed to sizes of the antennas. Slot measures λ in length. In comparison, length of the patch is λ/2. This means that the slot antenna can illuminate a greater aperture size as compared to the patch antenna since the ratio of physical lengths of the antenna to the aperture is higher for the slot antenna. Table 5 shows a comparison of the ratios.

TABLE 5

Ratio of antenna length to aperture length for both source antennas.

| | Antenna length/Aperture length | |
|---|---|---|
| Aperture Size | Slot antenna | Patch antenna |
| 27 mm × 27 mm | 0.74 | 0.3 |
| 45 mm × 45 mm | 0.44 | 0.18 |
| 63 mm × 63 mm | 0.32 | 0.13 |
| 81 mm × 81 mm | 0.25 | 0.09 |

FPCA systems constructed using all the four aperture sizes are matched at similar frequencies between 13.5 GHz-13.9 GHz. As compared to the slot antenna-based systems, the variation in matching frequencies is minimal. This indicates that FSS does not have prominent loading effect on patch antenna as discussed earlier. 45 mm×45 mm aperture is not as well matched as the other three apertures. This was also the case with slot antenna-based system (FIG. 20). Table 6 shows the aperture efficiency and peak gain for all the four aperture sizes. The frequency at which the peak gain results and the value of the gain is also indicated.

TABLE 6

Aperture efficiency for patch antenna based FPCA system for all four aperture sizes.

| Aperture Size | Frequency | Peak Gain | Aperture Efficiency using (1) |
|---|---|---|---|
| 27 mm × 27 mm | 14 GHz | 12.5 dB | 85.05% |
| 45 mm × 45 mm | 14 GHz | 15.4 dB | 62.51% |
| 63 mm × 63 mm | 13.8 GHz | 17.9 dB | 59.73% |
| 81 mm × 81 mm | 13.8 GHz | 16.9 dB | 28.70% |

Table 6 shows that as the aperture size increases, the aperture efficiency drops to about 60% for the next two sizes. For the aperture measuring 81 mm×81 mm, the efficiency very low. This can be attributed to very small ratio of the antenna length to aperture length. The electric field contours are observed in the near-field reference plane. The location of the plane for both the slot and patch antenna systems can be seen in FIG. 14.

Figure 25:
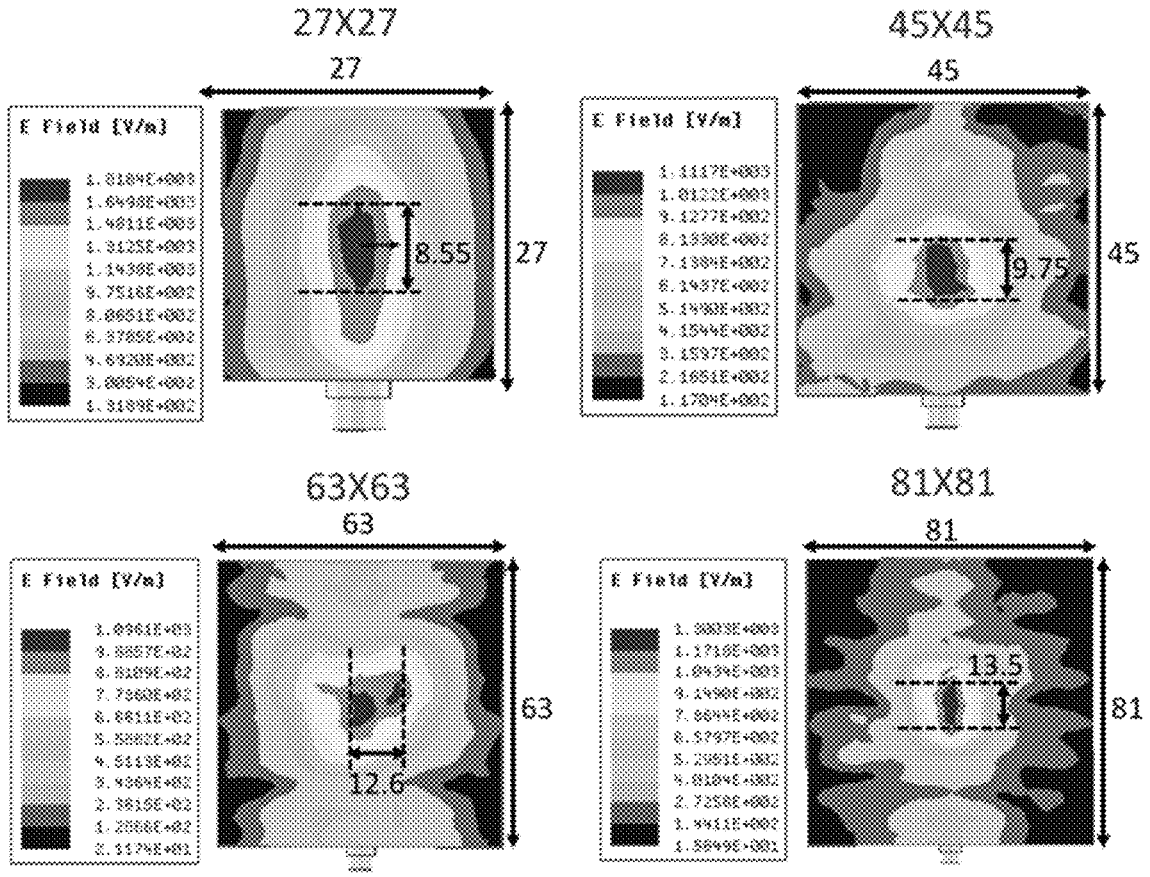
FIG. 25 illustrates near field E-field magnitude contours showing aperture illumination and width of the main beam for all four aperture sizes, in accordance with one or more techniques of this disclosure.

FIG. 25 illustrates near field E-field magnitude contours showing aperture illumination and width of the main beam for all four aperture sizes, in accordance with one or more techniques of this disclosure. All dimensions illustrated in FIG. 25 are in millimeters.

In FIG. 25, the magnitude of main beam is relatively high for the smallest aperture (27 mm×27 mm). The peak magnitude is ~1620V/m for the smallest aperture. This shows that the beam for the smallest aperture is very concentrated. The darkest region is also the smallest indicating almost complete aperture illumination.

The peak magnitude is around 1100V/m for 45 m×45 mm aperture and 63 mm×63 mm aperture and 1300V/m for 81 mm×81 mm aperture. The higher peak magnitudes indicate that although the near-field beam is more concentrated, radiation is not distributed over the aperture. This leads to greater amount of dark region in the contour. This explains the lower aperture efficiency observed for patch antenna based FPCA systems as compared to slot antenna based FPCA systems. A concentrated near-field beam though can be picked up more efficiently by a receiver in the near field. This concept is used in the vertical interconnect system which employs patch antenna for transmitting and receiving [Patent 1 supporting draft].

TABLE 7

Ratio of main beam width to aperture width for patch antenna based FPCA system for all four aperture sizes.

| Aperture Size | Frequency | Main beam width/Aperture width |
|---|---|---|
| 27 mm × 27 mm | 14 GHz | 0.32 |
| 45 mm × 45 mm | 14 GHz | 0.22 |
| 63 mm × 63 mm | 13.8 GHz | 0.20 |
| 81 mm × 81 mm | 13.8 GHz | 0.16 |

Figure 26:
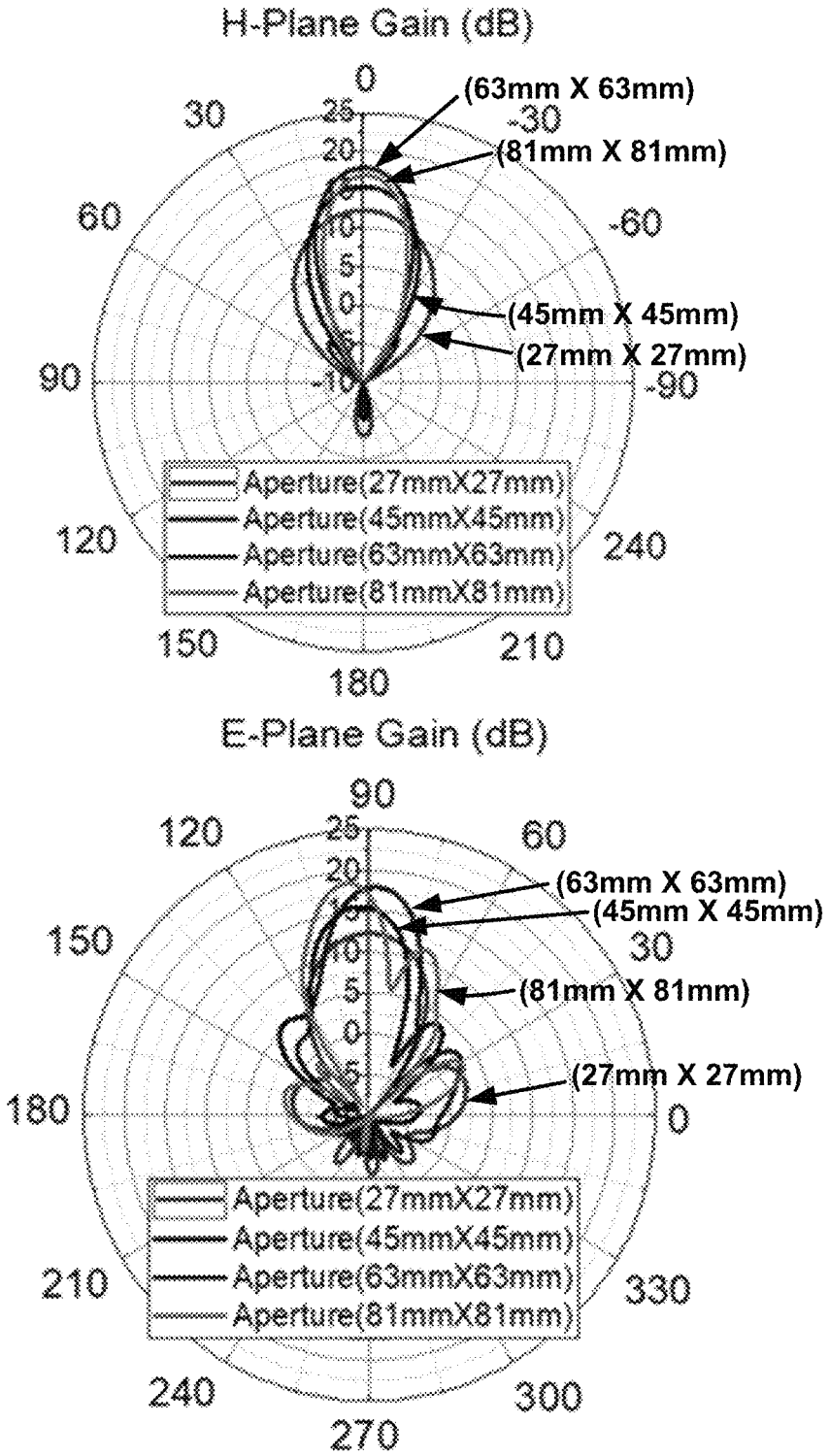
FIG. 26 shows polar plots for gain in E-Plane and H-Plane for FPCA system with patch antenna as the source, in accordance with one or more techniques of this disclosure.

FIG. 26 shows polar plots for gain in E-Plane and H-Plane for FPCA system with patch antenna as the source, in accordance with one or more techniques of this disclosure. Curves are plotted for different aperture sizes.

Table 7 gives a ratio of the main beam width to aperture width for all the aperture sizes. This ratio has a similar trend to aperture efficiency (Table 6), thus acting as an important design guide. FIG. 26 shows the E-plane and H-plane far-field gain plots for all the four aperture sizes at frequencies indicated in Table 6 and Table 7. H-Plane gain plots show that the beam is directed boresight for all the apertures. E-Plane however, shows tilt for the three larger apertures. E-Plane gain is boresight only for the 27 mm×27 mm aperture. E-Plane also shows a greater amount of back-radiation than H-Plane.

To summarize, even though larger apertures provide higher gain, they are not as efficient. A high efficiency for larger apertures would have pushed the gain obtained even higher. Since aperture efficiency refers to how much gain is extractable from a given aperture size, a high aperture efficiency is a superior performance metric. The ratio of slot antenna size to aperture size decreases as the aperture size increases. Hence the source antenna may not effectively illuminate the aperture at larger sizes. Comparison between the relative efficiencies of the slot based FPCA system to patch based FPCA systems (Table 3) validates this point. This can be further validated by seeing the electric field contours in FIG. 21 and FIG. 25.

The resonance frequency of structures made using Patch antenna and slot antenna differs. Since both source antennas are designed to operate at the same frequency, the shift can be attributed to the loading effect of FSS. The FSS which acts as a load matches at frequencies which are different than the patch and slot antenna radiating frequencies. However, once the source antenna is selected and aperture is scaled, resonance frequency of structures does not shift a lot. The shift is lesser for patch antenna FPCA than slot antenna FPCA.

The FSS geometry may be looked at carefully to determine how the loading effect can be altered. One intuitive solution may be to change the thickness of the dielectric or using a different permittivity of dielectric. The altered FSS structures should be able to present a different load value but have similar Floquet mode performance (FIG. 13). If the redesigned FSS matches the source antenna at its designed frequency, FPCA system could perform better.

Using patch antennas and slot antennas it is shown that the FPCA scaling is source antenna independent. This means that once a particular aperture size is used and FPCA system is designed for a source antenna, geometry scaling does not shift the resonance frequency by a great amount, and the system matching is maintained. There is however operating discrepancies if two different source antennas are used (Different resonance for Patch and slot based systems).

Since the 9×3 configuration in the 27 mm×27 mm aperture resulted in best performance, it is thought of scaling the apertures using that configuration. This would also change the unit cell size. Discussion on both source antenna based FPCA systems for these modified apertures forms the next section.

The modified unit cells are shown in FIG. 12. The unit cells have 9×3 configuration and represent scaled versions of FIG. 10*a* and FIG. 11*a*.

Figure 27:
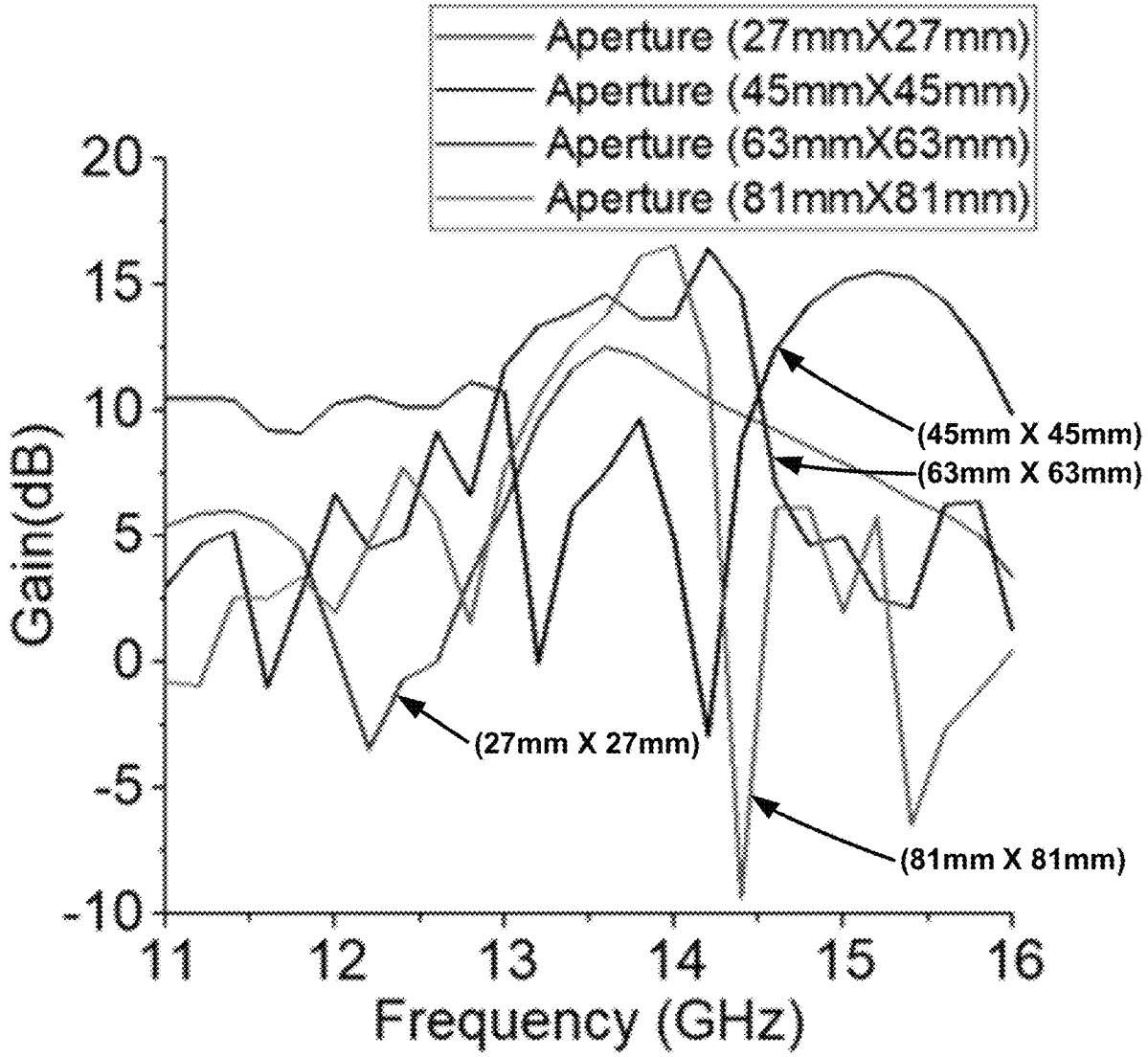
FIG. 27 is a plot diagram illustrating gain vs frequency curve for FPCA system with slot antenna as the source, in accordance with one or more techniques of this disclosure.

FIG. 27 is a plot diagram illustrating gain vs frequency curve for FPCA system with slot antenna as the source, in accordance with one or more techniques of this disclosure. Curves are plotted for different aperture sizes. Peak gains are listed in Table 8.

Figure 28:
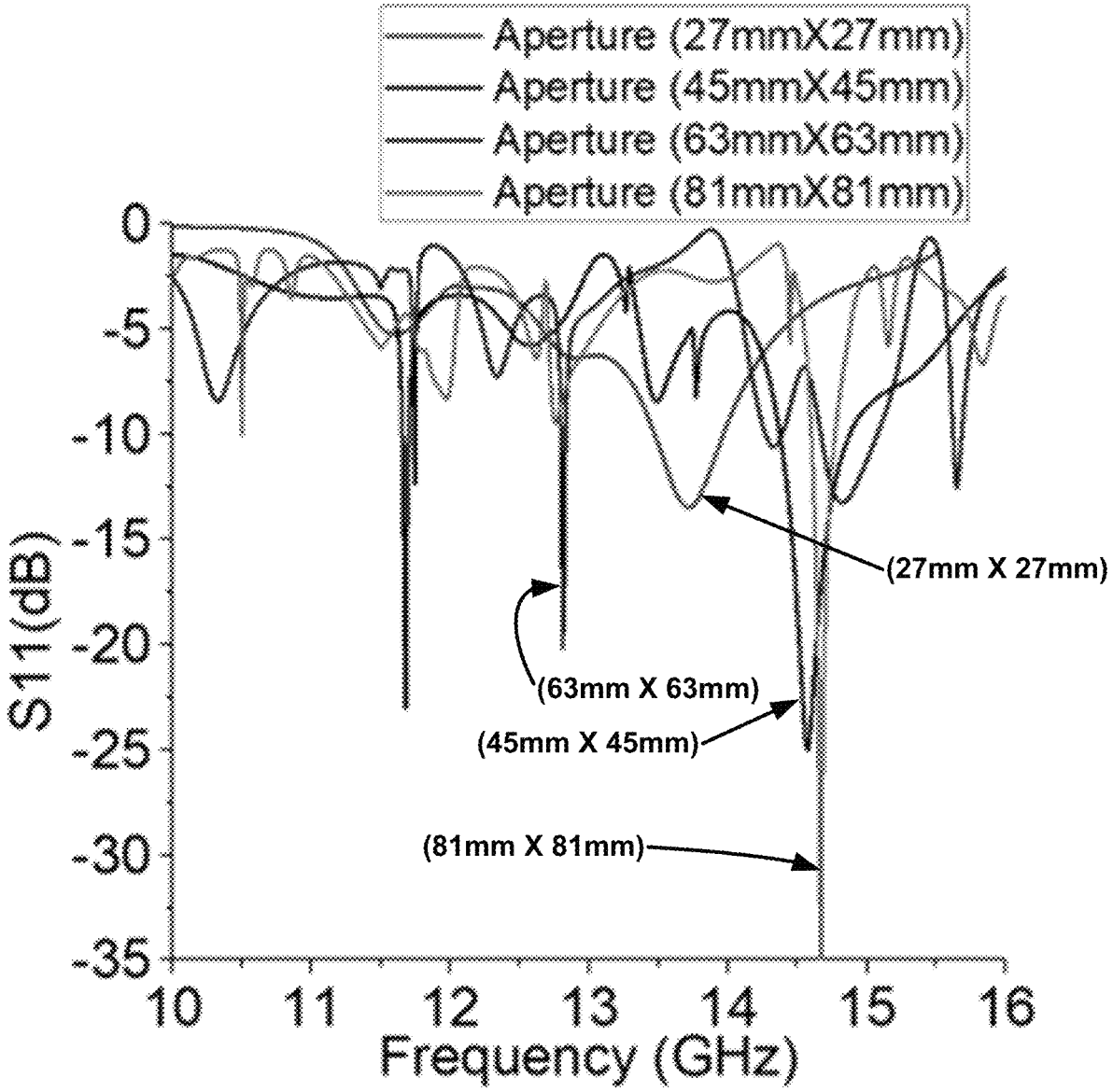
FIG. 28 is a plot diagram illustrating $S_{11}$ vs frequency curve for FPCA system with slot antenna as the source, in accordance with one or more techniques of this disclosure.

FIG. 28 is a plot diagram illustrating $S_{11}$ vs frequency curve for FPCA system with slot antenna as the source, in accordance with one or more techniques of this disclosure. Curves are plotted for different aperture sizes.

Separation between FSS and slot antenna is 11.5 mm. Recall that this was the optimized distance for the 9×3 unit cells in 27 mm×27 mm aperture. Since the number of unit cells are the same, same separation is used for the three other apertures. (45 mm×45 mm, 63 mm×63 mm and 81 mm×81 mm). Gain and $S_{11}$ is plotted against frequency for all the four aperture sizes in FIG. 27 and FIG. 28 respectively.

TABLE 8

Aperture efficiency for slot antenna based FPCA system for all four aperture sizes.

| Aperture Size | Frequency | Peak Gain | Aperture Efficiency using (1) |
|---|---|---|---|
| 27 mm × 27 mm | 13.6 GHz | 12.5 dB | 94.59% |
| 45 mm × 45 mm | 15.2 GHz | 15.5 dB | 54.27% |
| 63 mm × 63 mm | 14.2 GHz | 16.5 dB | 40.00% |
| 81 mm × 81 mm | 14 GHz | 16.6 dB | 25.43% |

Figure 29A:
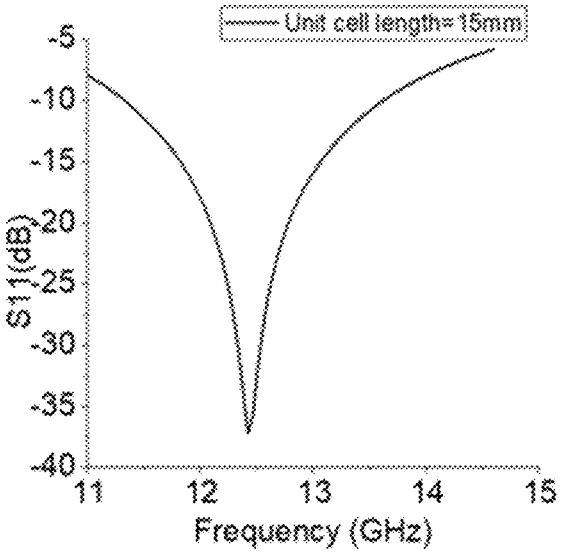
FIGS. 29*a*-29*d* are plot diagrams illustrating the effect of FSS leakage on gain performance, in accordance with one or more techniques of this disclosure.
Figure 29B:
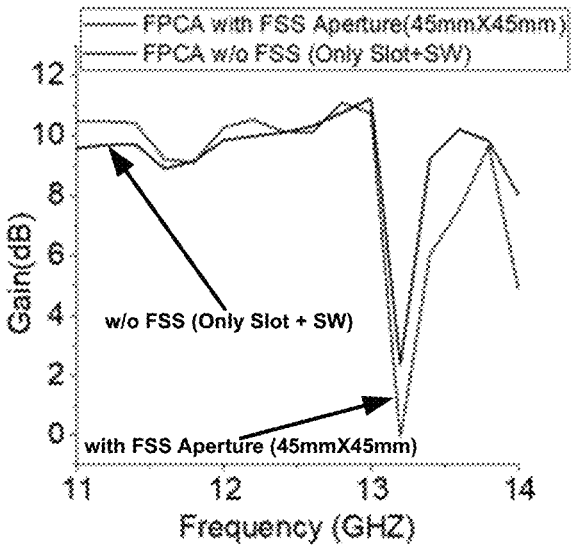
Figure 29C:
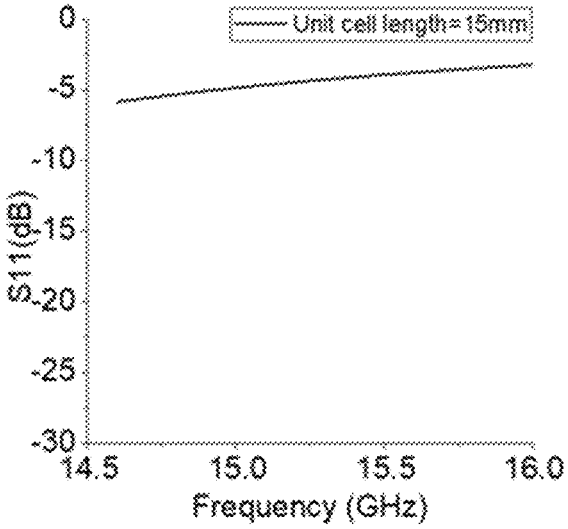
Figure 29D:
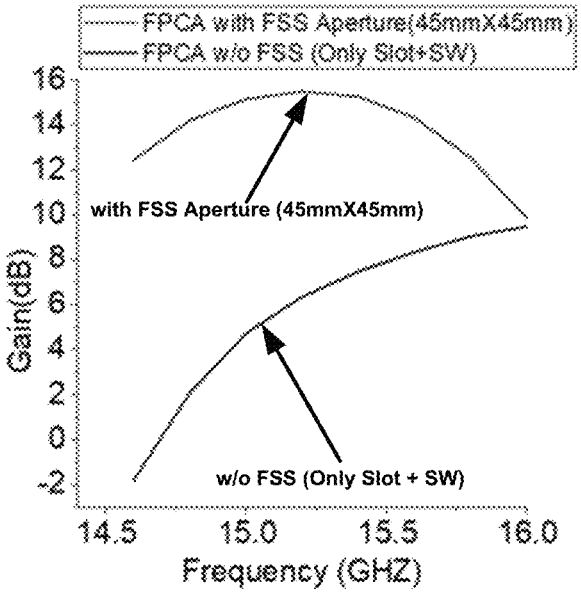

FIGS. 29*a*-29*d* are plot diagrams illustrating the effect of FSS leakage on gain performance, in accordance with one or more techniques of this disclosure. FIG. 29*a* is a plot diagram illustrating Floquet mode $S_{11}$ for unit cell length of 15 mm used in aperture of 45 mm×45 mm from 11 GHz-14.6 GHz. FIG. 29*b* is a plot diagram illustrating a gain comparison of FPCA system with 45 mm×45 mm FSS aperture to FPCA without the FSS from 11 GHz to 14 GHz. FIG. 29*c* is a plot diagram illustrating a Floquet mode $S_{11}$ for unit cell length of 15 mm used in aperture of 45 mm×45 mm from 14.6 GHz-16 GHz. FIG. 29*d* is a plot diagram illustrating a gain comparison of FPCA system with 45 mm×45 mm FSS aperture to FPCA without the FSS from 14.6 GHz to 16 GHz.

The aperture measuring 27 mm×27 mm was discussed in paragraphs [0106] to [0116]. Hence all curves for that aperture are the same. Looking at the 45 mm×45 mm aperture, the unit cell used for that aperture has its Floquet mode self-resonance at 12.5 GHz (FIG. 13). This can interfere with the performance of the system since the leakage changes rapidly around self-resonance as commented earlier. When the $S_{11}$ is lesser than −5 dB, it is observed that the FSS cannot perform efficiently since it leaks a lot of radiation. FIG. 13 (red curve) shows that between 11 GHz and 14.6 GHz, the $S_{11}$ value is lesser than −5 dB for 15 mm of unit cell length. This graph is also shown for the modified range in FIG. 29*a*. FIG. 29*b* compares the gain of the slot based FPCA system for 45 mm×45 mm aperture (FIG. 27) with 15 mm length of unit cell in FSS (FIG. 12) to slot antenna without FSS but with side walls (FPCA system without FSS).

FIG. 29*b* shows that the gain performance is almost identical. This indicates that the FSS is transparent in that range. FIG. 22*c* shows Floquet mode $S_{11}$ plot for 14.6 GHz to 16 GHz where leakage is greater than −5 dB. FIG. 29*d* compares the gain performance in this case with and without FSS. When the leakage is greater than −5 dB, FSS performs well and increases the gain.

For other two apertures, the corresponding unit cells operate on the other side of self-resonance. A good gain bandwidth and aperture efficiency is not attained as seen in FIG. 27 and Table 8. All larger apertures are however, well matched around 14.5 GHz. This shows that when number of unit cells are kept the same, FSS has a similar loading effect for each case. Recall that in the previous section, slot antenna based FPCA has varying matching frequencies for all cases. This was when unit cell size was kept constant and number of unit cells were increased as the aperture was scaled.

Figure 30:
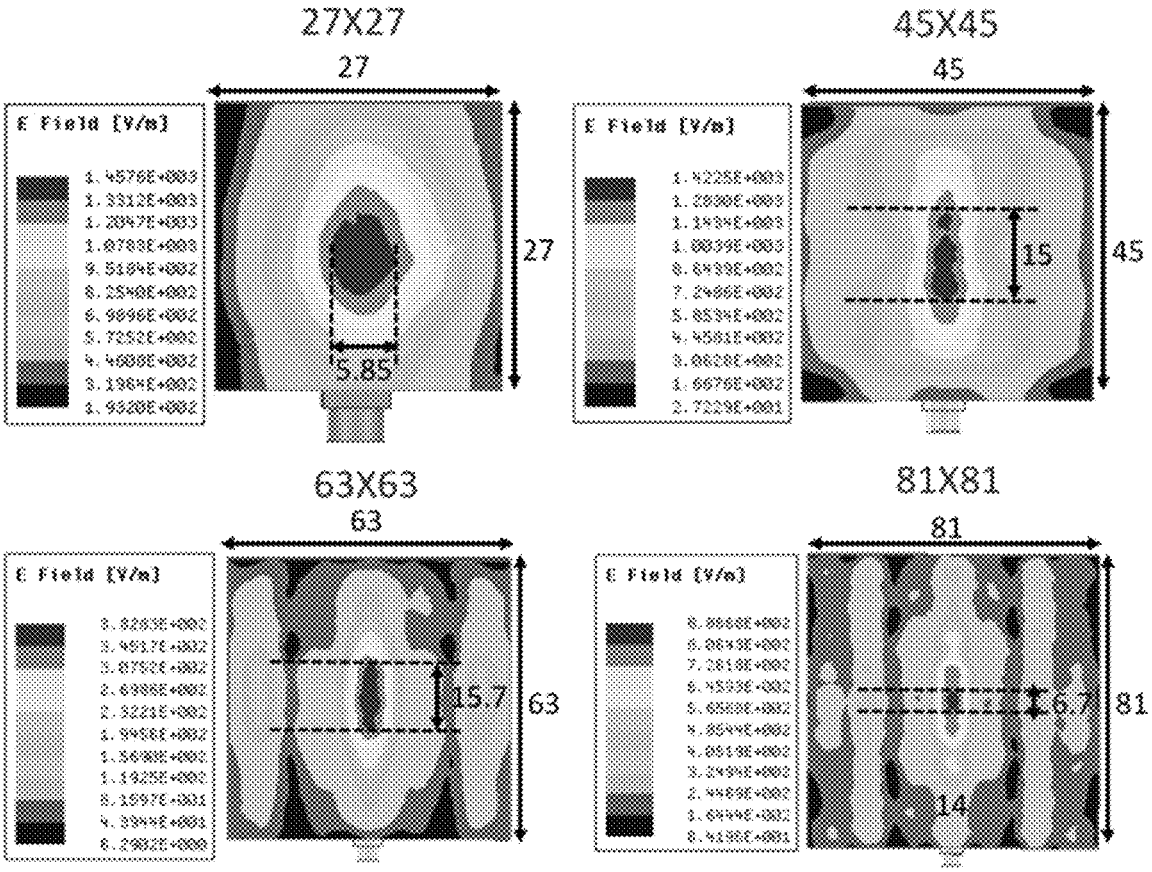
FIG. 30 illustrates near field E-field magnitude contours showing aperture illumination and width of the main beam for all four aperture sizes, in accordance with one or more techniques of this disclosure.

FIG. 30 illustrates near field E-field magnitude contours showing aperture illumination and width of the main beam for all four aperture sizes, in accordance with one or more techniques of this disclosure. All dimensions illustrated in FIG. 30 are in millimeters.

The E-field contour plots in FIG. 30 show an interesting behavior for larger apertures. The E-field forms definitive columns of higher radiation magnitudes separated by nulls. This may be because as the slot lengths in FSS unit cells start increasing, as the length crosses λ, a cancellation effect occurs because of changing phase of the radiation. This effect is also propagated to far-field. Looking at H-Plane plots for the larger apertures in FIG. 31, high side lobes are seen. The main beam starts becoming more oblong. This effect starts materializing in far-field E-plane plots. Because of the high radiation concentrated along the E-field, even though the far-field gain is not high, the beam width is small for the larger apertures.

Table 9 shows the ratio of main beam width to aperture widths. The pattern observed in Table 4 in the previous section regarding trends of aperture efficiency and Main beam width to Aperture width ratio is not observed here.

TABLE 9

Ratio of main beam width to aperture width for slot antenna based FPCA system for all four aperture sizes.

| Aperture Size | Frequency | Main beam width/Aperture width |
|---|---|---|
| 27 mm × 27 mm | 13.6 GHz | 0.22 |
| 45 mm × 45 mm | 12.4 GHz | 0.30 |
| 63 mm × 63 mm | 12.6 GHz | 0.25 |
| 81 mm × 81 mm | 12.6 GHz | 0.08 |

Figure 31:
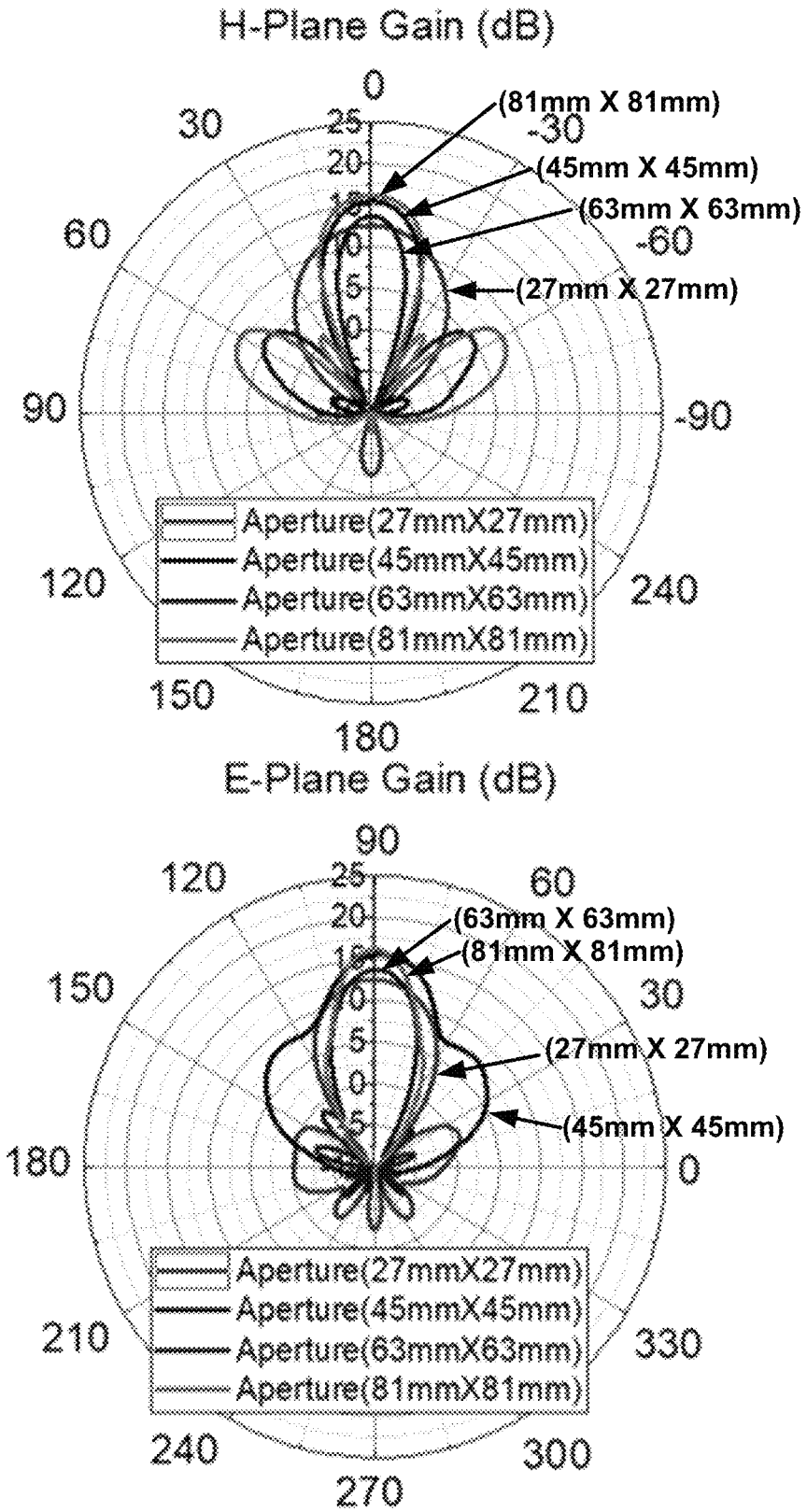
FIG. 31 illustrates polar plots for gain in E-Plane and H-Plane for FPCA system with slot antenna as the source, in accordance with one or more techniques of this disclosure.

FIG. 31 illustrates polar plots for gain in E-Plane and H-Plane for FPCA system with slot antenna as the source, in accordance with one or more techniques of this disclosure. Curves are plotted for different aperture sizes.

Figure 32:
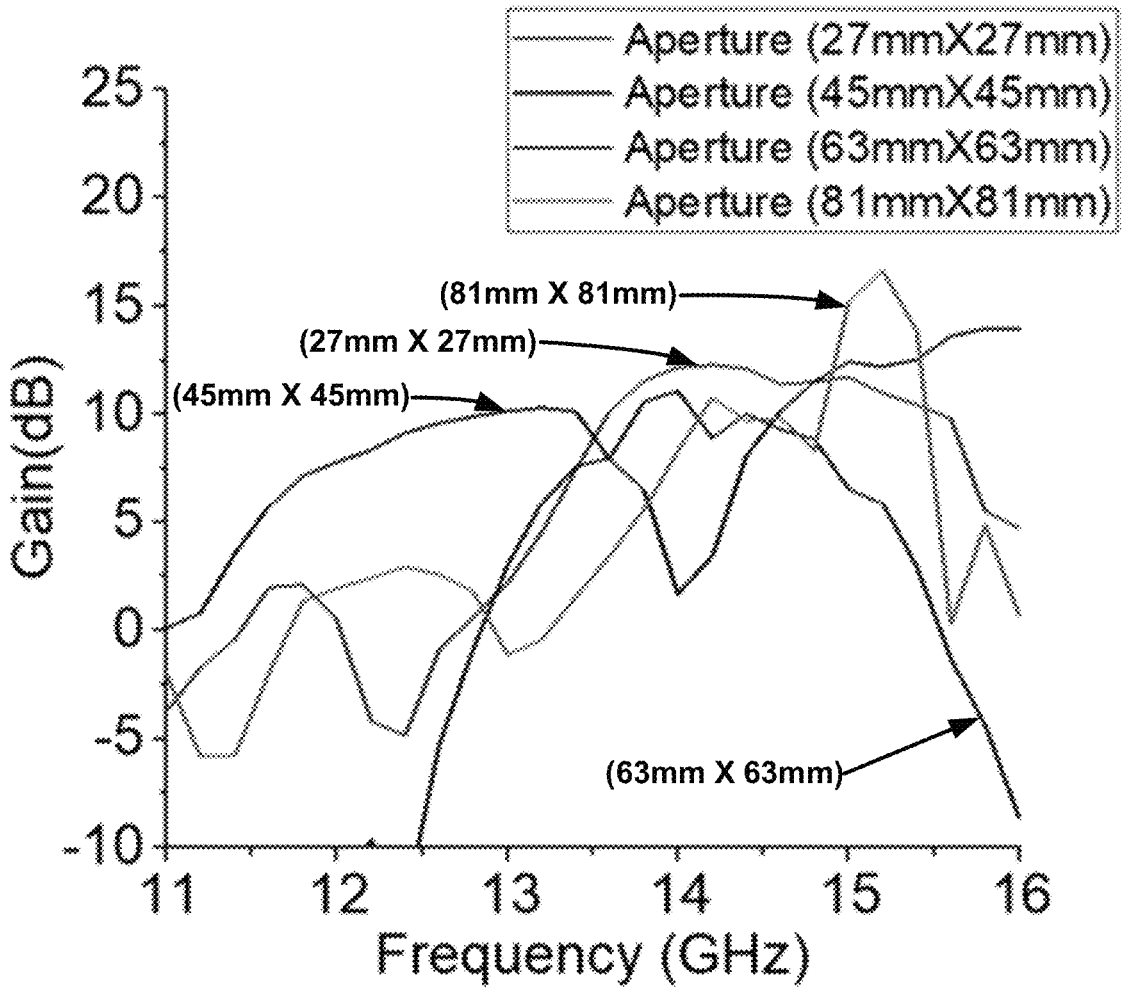
FIG. 32 is a plot diagram illustrating a gain vs frequency curve for FPCA system with patch antenna as the source, in accordance with one or more techniques of this disclosure.

Similar analysis is done for the Patch antenna based FPCA system in this section. FIG. 32 shows that the gain pots are not as coherent as the Patch antenna based FPCA system in the previous section (FIG. 23). The peak gain points vary in frequency for each aperture size, however, the latching is consistent around 14.5 GHz for the larger apertures. The value of $S_{11}$ nulls is strong indicating that FSS does not load the Patch very differently based on aperture size even in this case.

FIG. 32 is a plot diagram illustrating a gain vs frequency curve for FPCA system with patch antenna as the source, in accordance with one or more techniques of this disclosure. Curves are plotted for different aperture sizes. Curves are plotted for different aperture sizes.

Figure 33:
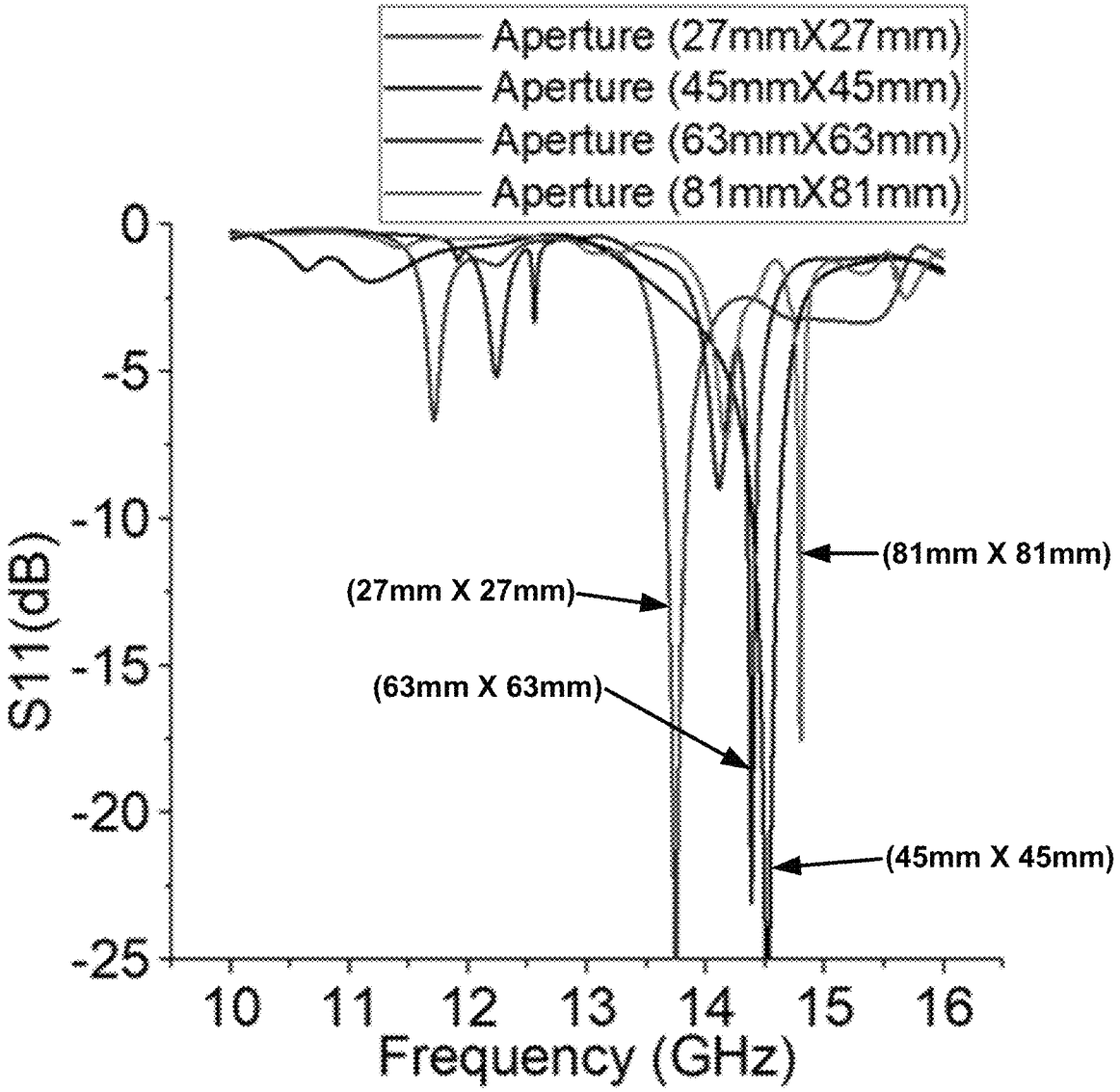
FIG. 33 is a plot diagram illustrating an $S_{11}$ vs frequency curve for FPCA system with patch antenna as the source, in accordance with one or more techniques of this disclosure.

FIG. 33 is a plot diagram illustrating an $S_{11}$ vs frequency curve for FPCA system with patch antenna as the source, in accordance with one or more techniques of this disclosure. Curves are plotted for different aperture sizes.

It is observed in Table 10 that the aperture efficiency is really poor. This indicates that modified unit cells do not work well to enhance performance. The E-field contours in FIG. 34 for 45 mm×45 mm aperture indicates that Feed-line effect is very strong. The concentrated near-field beam appears over the feedline instead of the patch. The reason is the mismatch of the antenna. Peak gain performance for the 45 mm×45 mm aperture results at 15.8 GHz, hence the contour is plotted at that frequency. However, the antenna is greatly mismatched at that point. This causes a large amount of reflection at the antenna-feedline interface. This radiation appears in the contour.

TABLE 10

Aperture efficiency for patch antenna based FPCA system for all four aperture sizes.

| Aperture Size | Frequency | Peak Gain | Aperture Efficiency using (1) |
|---|---|---|---|
| 27 mm × 27 mm | 14 GHz | 12.5 dB | 85.05% |
| 45 mm × 45 mm | 15.8 GHz | 14.0 dB | 35.63% |
| 63 mm × 63 mm | 14 GHz | 11.1 dB | 11.85% |
| 81 mm × 81 mm | 15 GHz | 15.2 dB | 16.06% |

Figure 34:
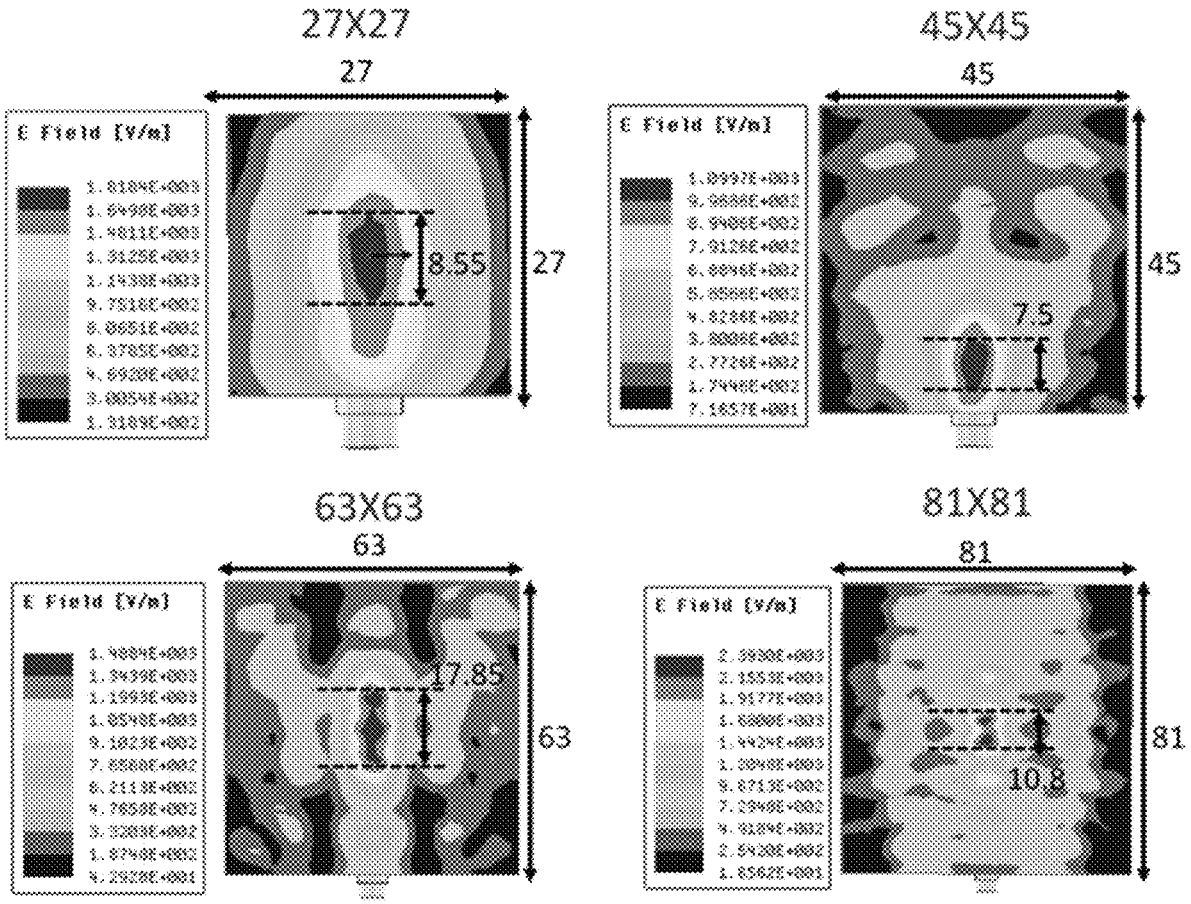
FIG. 34 illustrates near field E-field magnitude contours showing aperture illumination and width of the main beam for all four aperture sizes, in accordance with one or more techniques of this disclosure.

FIG. 34 illustrates near field E-field magnitude contours showing aperture illumination and width of the main beam for all four aperture sizes, in accordance with one or more techniques of this disclosure. All dimensions illustrated in FIG. 34 are in millimeters.

Figure 35:
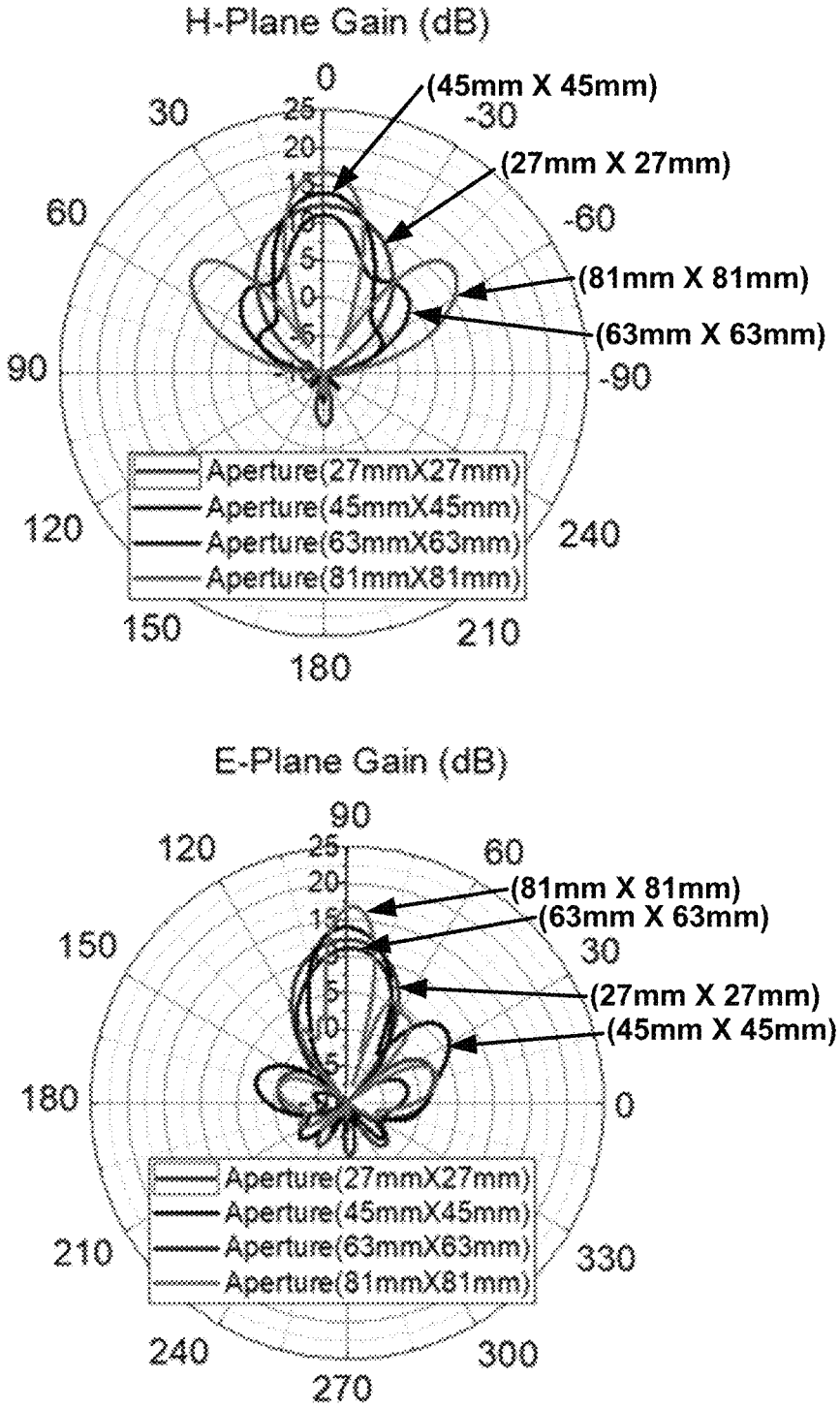
FIG. 35 illustrates polar plots for gain in E-Plane and H-Plane for FPCA system with patch antenna as the source, in accordance with one or more techniques of this disclosure.

In the case of the patch antenna based FPCA as well, the ratio of main beam width to aperture beam width in Table 11 and aperture efficiency trends do not hold. 63 mm×63 mm aperture has a higher ratio than 45 mm×45 mm but a lower aperture efficiency. FIG. 35 shows the far-field gain plots for the patch antenna based FPCA system. H-plane plots are boresight for all apertures but E-plane plot is a little tilted for 81 mm×81 mm aperture.

TABLE 11

Ratio of main beam width to aperture width for patch antenna based FPCA system for all four aperture sizes.

| Aperture Size | Frequency | Main beam width/Aperture width |
|---|---|---|
| 27 mm × 27 mm | 14 GHz | 0.32 |
| 45 mm × 45 mm | 15.8 GHz | 0.17 |
| 63 mm × 63 mm | 14 GHz | 0.28 |
| 81 mm × 81 mm | 15 GHz | 0.13 |

FIG. 35 illustrates polar plots or gain in E-Plane an H-Plane or FPCA system with patch antenna as the source, in accordance with one or more techniques of this disclosure. Curves are plotted for different aperture sizes.

To summarize, changing unit cell lengths for obtaining larger apertures does not enhance FPCA performance. A good aperture efficiency is not obtained in any of the cases. Unit cell leakage based on Floquet mode $S_{11}$ results is an important characterization of the FSS. Changing unit cells changes the performance and its reaction on the performance of the complete FPCA system cannot be predicted.

The following section deals with investigating separation between FSS and source antenna for larger apertures. Both types of apertures are considered herein. The two types are: larger apertures not having constant unit cell size but more unit cells, and larger apertures having the 9×3 unit cell configuration with modified unit cells. The reason is that 11.5 mm separation and 9.5 mm separation, even though were $\lambda_g/2$, they were determined for the 27 mm×27 mm aperture. It might be possible that some other fraction of half-wavelength holds good for the larger apertures. This will be part of the third parametric simulation in the next section.

Three parametric studies on the Fabry-Perot Cavity Antenna systems were carried out. The systems include two types of source antennas: slot antenna and patch antenna. The FSS has all horizontal slots and evaluated for four different aperture sizes—27 mm×27 mm, 45 mm×45 mm, 63 mm×63 mm and 81 mm×81 mm. The three parametric simulations are—1. FSS scaling with same unit cell size in FSS (increases number of unit cells with scaling) 2. FSS scaling with 9×3 unit cells (increases size of unit cells with scaling) 3. Changing separation height between FSS and source antenna for apertures other than 27 mm×27 mm. Studies indicate that keeping unit cell size is important for ensuring good FPCA system performance. Even though larger apertures provide more gain, aperture efficiency decreases. Scaling FSS under parameter 1 ensures similar frequency of operation for scaled structures and good $S_{11}$ matching at similar frequencies. This is provided that the same source antenna is used. If source antennas are changed, however, the loading effect of FSS changes. Hence each source antenna must be evaluated in the FPCA structure independently.

One or more FPCA systems described herein may have features including one or more of a square aperture, an enclosed cavity, uniform unit cells, a source antenna (e.g., a cavity backed slot antenna and/or a patch antenna), a microstrip feed, a SubMiniature version A (SMA) connector or 3D fed, and a printed circuit board (PCB) or integrated circuit (IC) implementation. Additionally, one or more parameters may be used to analyze one or more FPCA systems described herein, such as $S_{11}$ vs frequency, Near-field E-field contour, far field Gain vs Frequency, and a far field polar plot of gain at design frequency.

For emerging wireless and mobile applications such as 5G, compact high performance (e.g., high gain and high aperture efficiency) antennas are used. This disclosure describes one or more examples of a compact solution for arrayed antenna elements that have high gain. The resulting gain is due to a high aperture efficiency design. When compared to conventional array design performance, one or more systems of this disclosure achieve a similar performance in a much smaller footprint.

Commercial applications that could benefit from the techniques described herein may include 5G, Internet of Things, Internet of Space, Nano-satellites, imaging, medical diagnostics, or any combination thereof. Products or services that could be based on one or more techniques of this disclosure may include antenna designs and integrated antennas with IC chips.

In some examples described herein, a system may include a single element. Additionally, in some examples described herein, a system includes an arrayed element.

In some examples, one or more systems described herein may be used for 60 GHz and higher as well as integrated circuit design approaches that can create seamless integration with integrated circuits. In various examples, designs described herein may be used for 12 GHz. At higher frequencies, the integration approach may be implemented for the reduced design size in addition to the modifications in the measurement system to accommodate miniature connections to the antenna measurement system.

Power generation reduces at millimeter wave frequencies for emerging system applications, such as 5G. Thus, loss presents many design challenges for complex integrated system design. One or more techniques described herein may alleviate loss associated with vertical interconnects used in such systems. For example, a wireless equal split 3D vertical power divider may offer very low loss. Two near field beams, produced by one source element and a novel frequency selective surface (FSS), may be detected by individual receive elements of the same type. This design is scalable, and in various non-limiting examples, the design may be modeled at 13.5 GHz and 60 GHz. A 13.5 GHz scale model is demonstrated for validation. Simulated insertion loss coefficient at 13.5 GHz is 3.24 dB, with bandwidth of 5.5%. In some examples, the 5G protocol is compatible with frequencies within a range from 24 GHz to 100 GHz, but this is not required. The 5G protocol may be compatible with other frequencies or frequency ranges as well.

Increased integration of on-chip technologies for system level integration requires the ability to power one or more chips in a low power manner. While multi-chip systems offer advanced functionality and compactness, they can suffer from high loss and increase fabrication complexity when via based interconnect technology is used. One or more techniques described herein may reduce loss and integration complexity such as wireless interconnects with millimeter wave antennas.

Intra-chip wireless channels impact wireless Network on Chip (NoC) designs. This confirms that radiation in on-chip environments is present in some cases. For direct line of sight communication, examples exist but suffer from near field effects and high path loss. The path loss of 60 GHz on-chip wireless interconnects can vary from 3 dB in close proximity to 23 dB in distance communications. Although viable, they suffer from considerable radiation loss when antenna beams are not focused. To compensate, an active wireless interconnect can be used in exchange for additional power consumption. For simultaneous power to two or more chips, on-chip wireless interconnects used as equal split power dividers, has demonstrated insertion loss of ~10 dB. However, for millimeter and sub-millimeter wave applications where power levels are considerably lower, solutions are needed that offer low loss, output port isolation and broader bandwidth.

In some examples, a wireless equal split 3D vertical power divider offers low loss, high isolation that is scalable. In non-limiting examples, the design method is presented for 13.5 GHz and 60 GHz operation. Modelled s-parameter results are discussed and near field behavior is shown.

Figure 36:
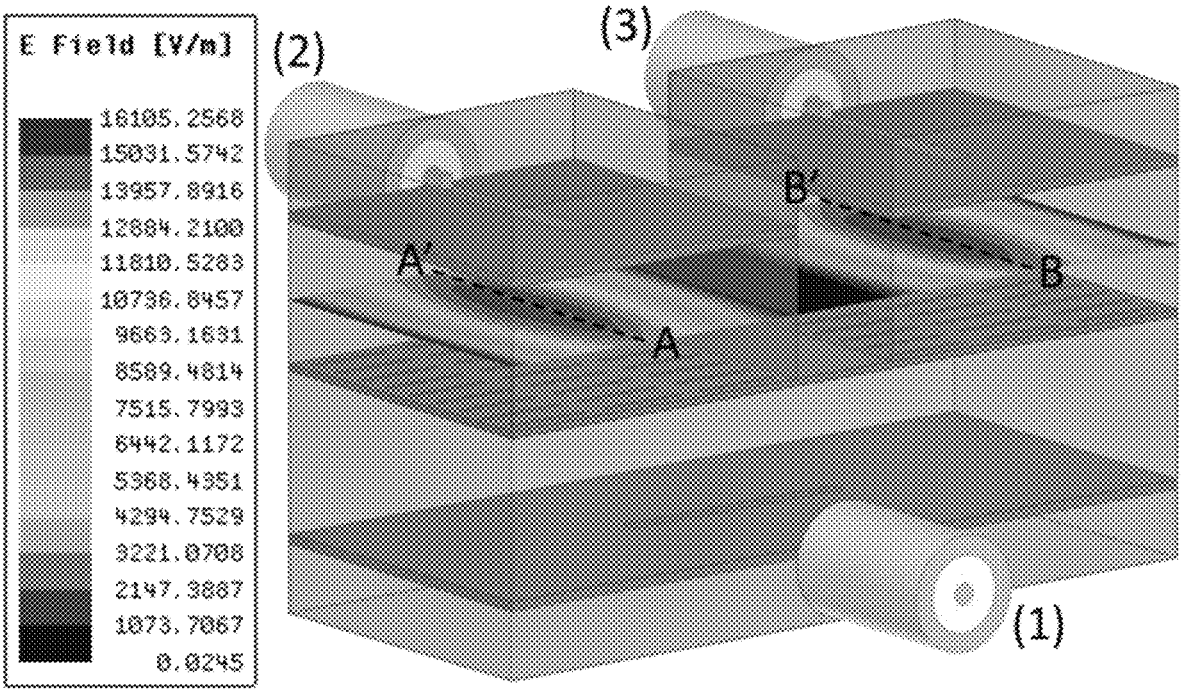
FIG. 36 illustrates a 3D view of the equal split 3D vertical power divider with two equal near field beams in the reference plane, in accordance with one or more techniques of this disclosure.

FIG. 36 illustrates a 3D view of the equal split 3D vertical power divider with two equal near field beams in the reference plane, in accordance with one or more techniques of this disclosure. FIG. 36 shows an illustration of the wireless equal split 3D vertical power divider. It is comprised of a single source element and FSS designs to create two near field beams that are detected by two receive antennas and converted into guided wave signals. The approach for the near field beam formation is based on the concepts in.

Figure 37:
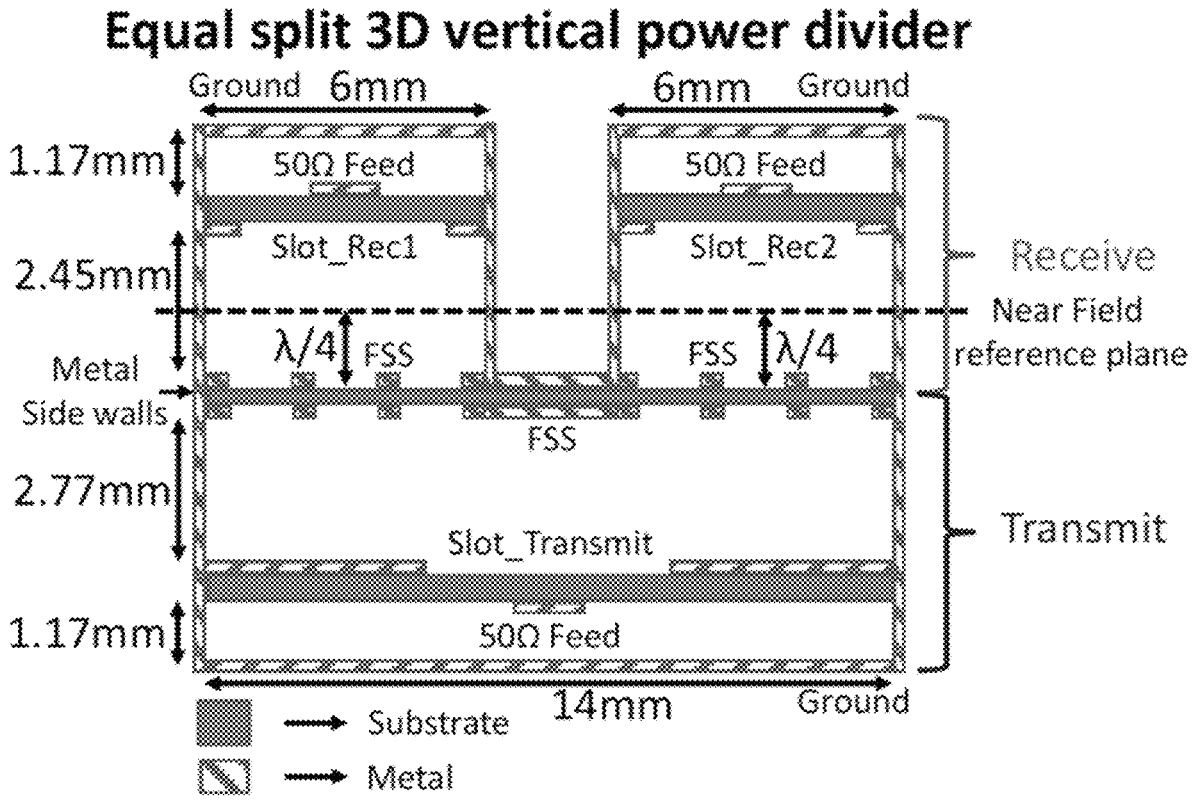
FIG. 37 illustrates 2D cut showing equal split 3D vertical power divider, in accordance with one or more techniques of this disclosure.

FIG. 37 illustrates 2D cut showing equal split 3D vertical power divider, in accordance with one or more techniques of this disclosure. The copper thickness is 35 m. Substrate thickness is 0.17 mm for transmit and receive antennas and 0.11 mm for the FSS. FIG. 37 shows a cross-section of the dimensions of the 3D vertical power divider shown in FIG. 36 which operates at 60 GHz. Metallized sidewalls help to shield the structure. The layers are separated by an air cavity. Transmit and receive elements point towards the FSS metal. Microstrip feed is used on the reverse side to feed the slot elements.

Figure 38A:
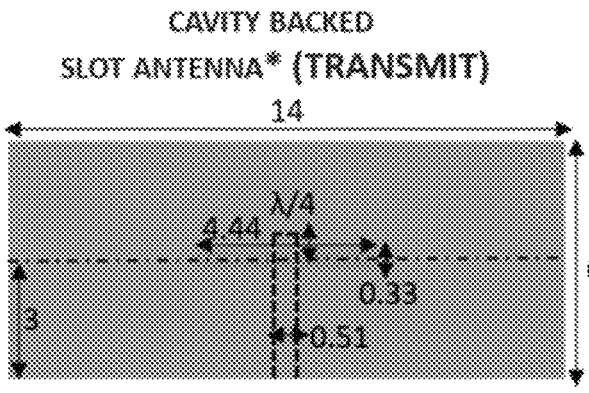
FIGS. 38*a*-38*b* illustrate elements of transmit FPC section of two-way equal split 3D power divider, in accordance with one or more techniques of this disclosure.
Figure 38B:
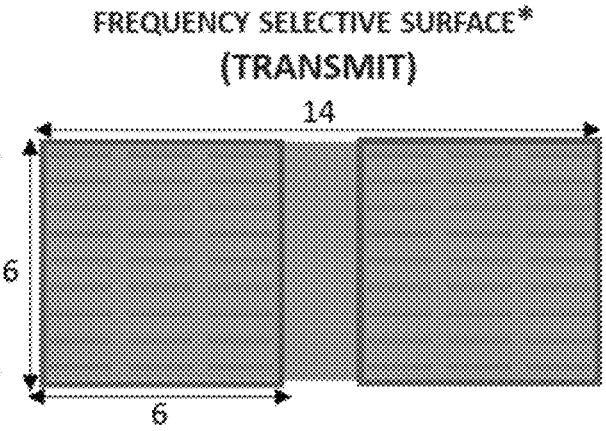

FIGS. 38*a*-38*b* illustrate elements of transmit FPC section of two-way equal split 3D power divider, in accordance with one or more techniques of this disclosure. For example, FIG. 38*a* illustrates a transmit slot antenna and FIG. 38*b* illustrates a beam splitting FSS. All dimensions are in millimeters (mm).

Figure 39A:
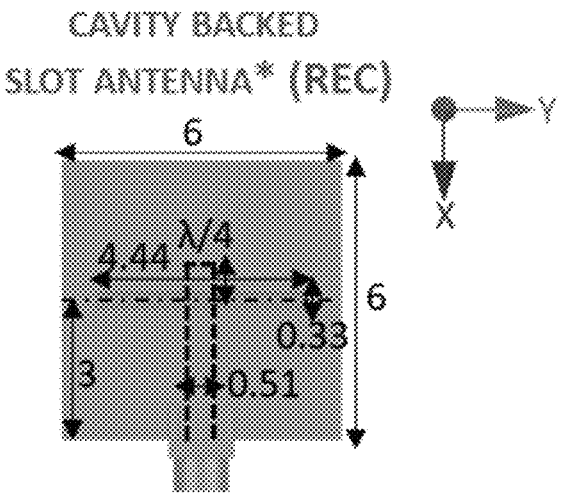
FIGS. 39*a*-39*b* illustrate elements of a receive FPC section of a two-way equal split 3D power divider, in accordance with one or more techniques of this disclosure.
Figure 39B:
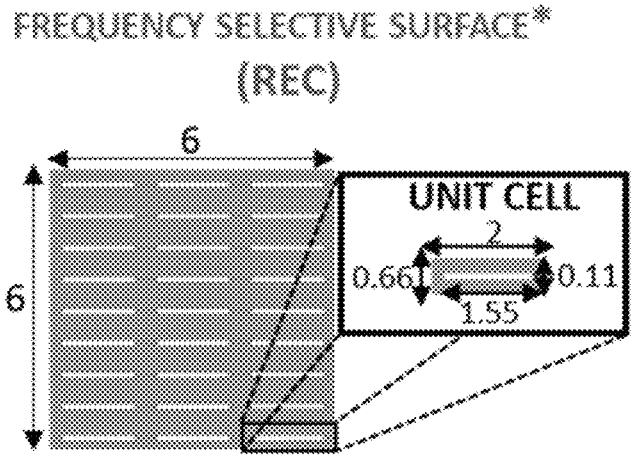

FIGS. 39*a*-39*b* illustrate elements of a receive FPC section of a two-way equal split 3D power divider, in accordance with one or more techniques of this disclosure. FIG. 39*a* illustrates a receive slot antenna. FIG. 39*b* illustrates an FSS. All dimensions are in millimeters (mm).

The wireless 3D power divider design elements are shown in FIGS. 38*a*-38*b* and FIGS. 39*a*-39*b*. The design is based on the Fabry-Perot Cavity (FPC) concept. For the transmitter, the source element and beam splitting FSS designs are shown in FIGS. 38*a*-38*b*, respectively. The source element antenna is a cavity-backed slot design with a total area of 6×14 $mm^2$. The FSS has three regions: two FSS sub-aperture regions and a solid metal strip. The FSS sub-aperture is described with the receiver design. This combination produces two equal near-field beams in the reference plane as shown in FIG. 36.

For the receiver, the receive element and FSS designs are shown in FIGS. 39*a*-39*b*, respectively. The receive antenna is a cavity backed slot design with a total area of 6×6 $mm^2$. The FSS design contains unit cells comprised of 9×3 horizontal slots with unit cell size described in FIG. 39*b*. The receiver FSS is also the beam splitting FSS sub-aperture and has total area of 6×6 $mm^2$. For the power divider, two identical receive antenna/FSS units are used to detect the near field beams produced by the beam splitting FSS. Center-to-center separation between the two receive ports (FIG. 36) is 8 mm. This is based on structural geometry since the ports are in the center of each square receive antenna (FIG. 39*a*).

Figure 40A:
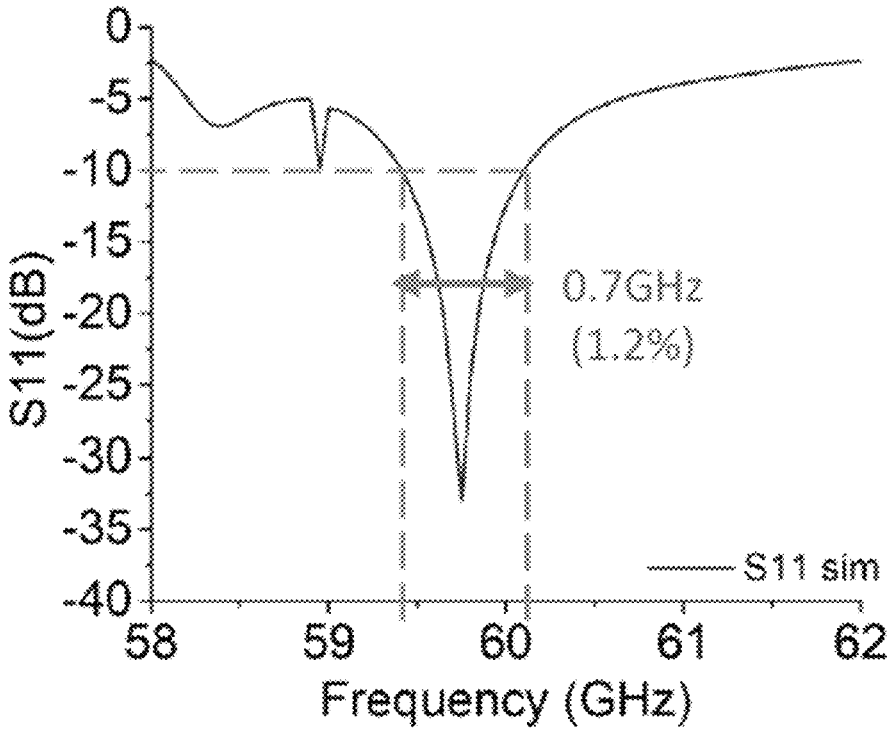
FIGS. 40*a*-40*b* illustrate simulated S-parameters for a two-way equal split 3D vertical power divider, in accordance with one or more techniques of this disclosure.
Figure 40B:
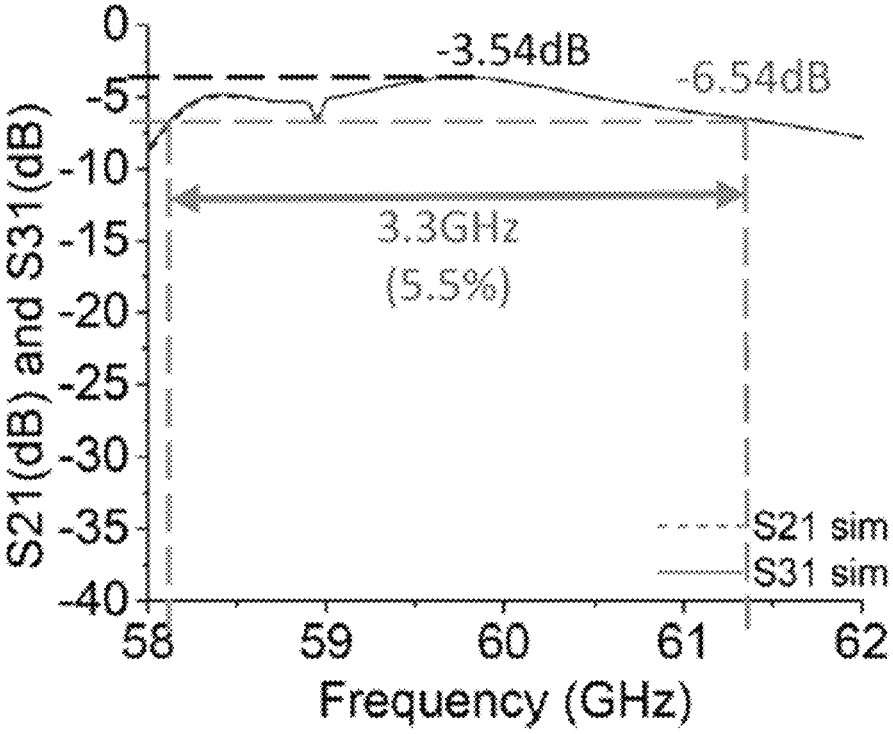

FIGS. 40*a*-40*b* illustrate simulated S-parameters for a two-way equal split 3D vertical power divider, in accordance with one or more techniques of this disclosure. FIG. 40*a* illustrates an $S_{11}$ plot. FIG. 40*b* illustrates an $S_{21}$ and $S_{31}$ plot. Both are exactly identical in range of operation of the 3D power divider.

All 3D structures are modelled using Ansys Electronics Desktop studio. Included are conductor and dielectric loss and models for a V-connector interface. The S-parameters and near field response are obtained for all designs.

FIGS. 40*a*-40*b* shows the s-parameter results for the 60 GHz design. The S11 response is shown in FIG. 40*a* with a 10 dB bandwidth of 1.2%. The insertion loss for S21 and S31, shown in FIG. 40*b*, is −3.45 dB in both cases. The insertion loss per path is 0.54 dB higher than the ideal −3 dB value, which is associated with the V-connector and the microstrip line. The 6 dB S21 bandwidth is approximately 5.5% at 60 GHz.

Figure 41A:
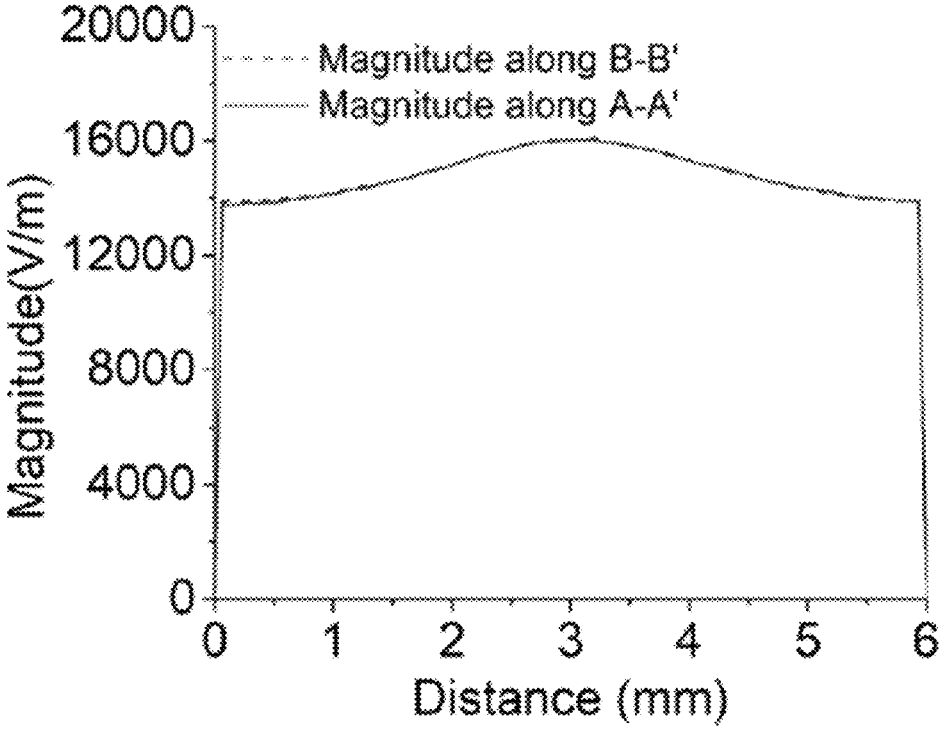
FIGS. 41*a*-41*b* illustrate near field results in reference plane, in accordance with one or more techniques of this disclosure.
Figure 41B:
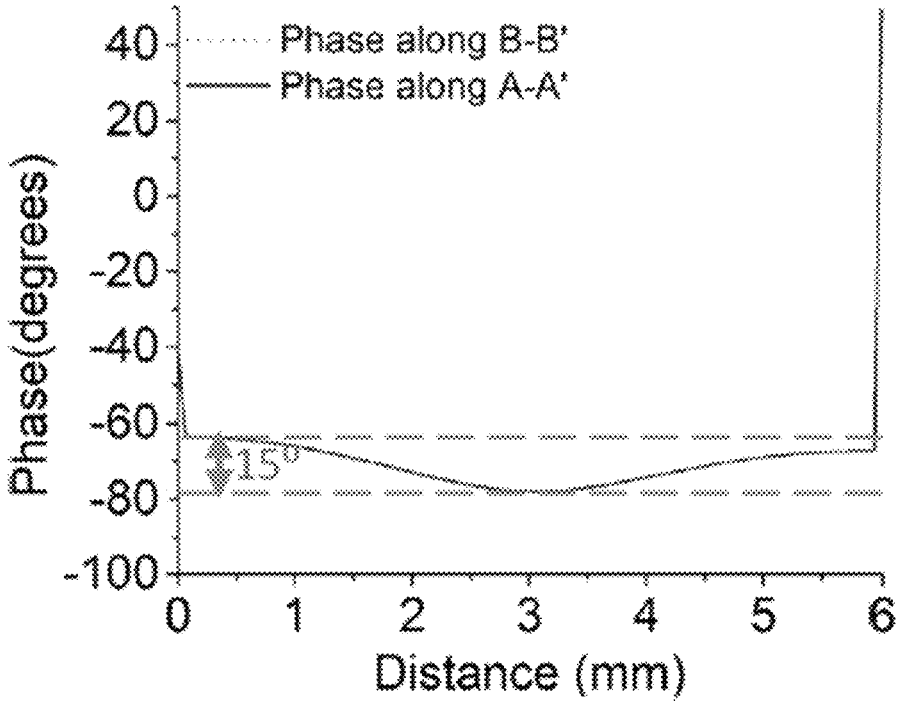

FIGS. 41*a*-41*b* illustrate near field results in reference plane, in accordance with one or more techniques of this disclosure. FIG. 41*a* illustrates an E-field magnitude plot. FIG. 41*b* illustrates an E-field phase plot. FIGS. 41*a*-41*b* show the near-field E-plane magnitude and phase, respectively. It is located along the A-A' and B-B' cuts shown in FIG. 36. The magnitude and phase have identical responses for both paths. The beam is symmetric around the peak E-field which is centrally located along the length. The beam phase variation is around 15 degrees. The sharp rise in phase near the end points of the path are due to connector location near the edges. In the next section, a scale model design at 13.5 GHz is realized to validate the design approach. This design frequency requires all dimensions to be scaled up by 4.5.

Figure 42A:
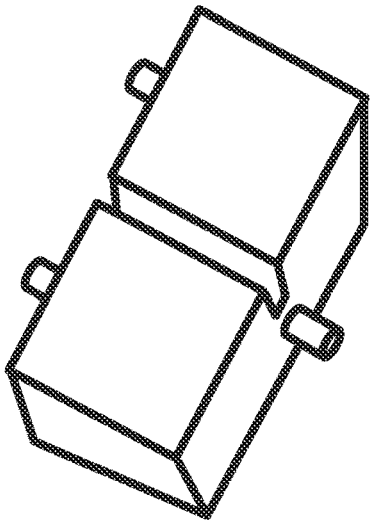
FIGS. 42*a*-42*c* illustrates measured vs simulated responses for a 13.5 GHz scale model, in accordance with one or more techniques of this disclosure.
Figure 42B:
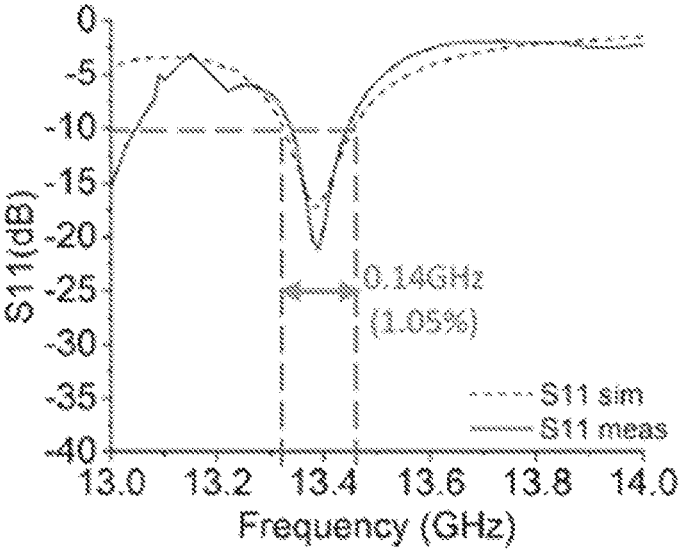
Figure 42C:
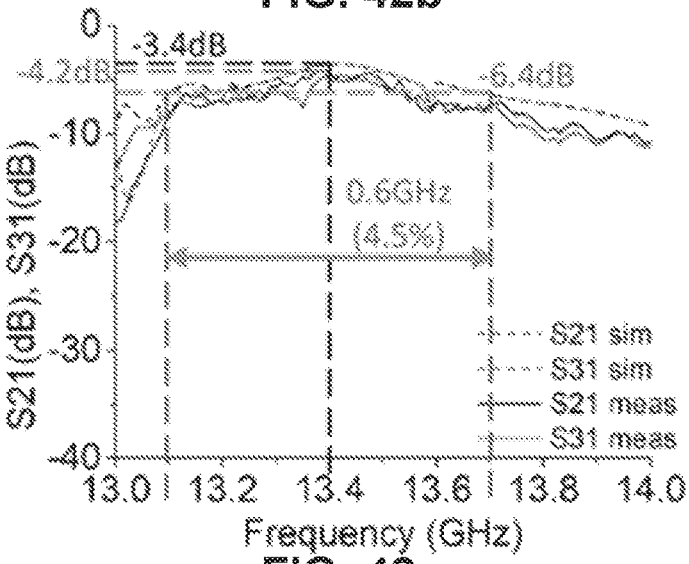

FIGS. 42*a*-42*c* illustrates measured vs simulated responses for a 13.5 GHz scale model, in accordance with one or more techniques of this disclosure. FIG. 42*a* illustrates an image of a wireless equal split 3D power divider. FIG. 42*b* illustrates an $S_{11}$ plot for an equal split power divider. FIG. 42*c* illustrates an $S_{21}$ plot and an $S_{31}$ plot for equal split power divider.

The 13.5 GHz design is developed on Rogers Duroid 5880 substrate with $\varepsilon_r$=2.2 with a thickness of substrate 0.75 mm for the antennas and of 0.51 mm for the FSS. The antennas are fabricated with a LPKF Protomat S103 Milling Machine. The enclosed structure has metal surfaces on the side walls and in the cavity below the antenna. All cavities are air-filled. FIG. 42*a* shows the fabricated structure. The measurements are performed on the Anritsu 37369D VNA with a full two-port calibration using K-type connectors from 13 GHz to 14 GHz.

FIG. 42*b* and FIG. 42*c* compare measured and simulated S-parameters for the equal split power divider. FIG. 42*b* shows the frequency of the $S_{11}$ nulls almost exactly coincides. The 10 dB S11 bandwidth is 1.05% and similar to the 60 GHz model. In FIG. 42*c*, the modelled insertion loss is 0.4 dB higher than the ideal −3 dB value. This is attributed to the SMA connectors and the microstrip lines. For measured insertion loss, however, an additional 0.8 dB is observed that is attributed to leakage from the metallic side walls edges misalignment of the antenna and the FSS. The 6 dB S21 bandwidth observed in simulation is 4.5%, close to the 5.5% bandwidth obtained at 60 GHz.

The techniques described herein may be implemented in hardware, software, firmware, or any combination thereof. Various features described as modules, units or components may be implemented together in an integrated logic device or separately as discrete but interoperable logic devices or other hardware devices. In some cases, various features of electronic circuitry may be implemented as one or more integrated circuit devices, such as an integrated circuit chip or chipset.

If implemented in hardware, this disclosure may be directed to an apparatus such as a processor or an integrated circuit device, such as an integrated circuit chip or chipset. Alternatively or additionally, if implemented in software or firmware, the techniques may be realized at least in part by a computer-readable data storage medium including instructions that, when executed, cause a processor to perform one or more of the methods described above. For example, the computer-readable data storage medium may store such instructions for execution by a processor.

A computer-readable medium may form part of a computer program product, which may include packaging materials. A computer-readable medium may include a computer data storage medium such as RAM, read-only memory (ROM), non-volatile random access memory (NVRAM), EEPROM, Flash memory, magnetic or optical data storage media, and the like. In some examples, an article of manufacture may include one or more computer-readable storage media.

In some examples, the computer-readable storage media may include non-transitory media. The term "non-transitory" may indicate that the storage medium is not embodied in a carrier wave or a propagated signal. In certain examples, a non-transitory storage medium may store data that can, over time, change (e.g., in RAM or cache).

The code or instructions may be software and/or firmware executed by processing circuitry including one or more processors, such as one or more digital signal processors (DSPs), general purpose microprocessors, application-specific integrated circuits (ASICs), field-programmable gate arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, functionality described in this disclosure may be provided within software modules or hardware modules.

What is claimed is:

1. An antenna system, comprising:

a source antenna;

a first receive antenna;

a second receive antenna;

a frequency selective surface (FSS) comprising a first section including a first set of horizontally oriented unit cells, a second section including a second set of horizontally oriented unit cells, and a third section between the first section and the second section, the third section including a set of vertically oriented unit cells, wherein the first section is substantially square in shape, wherein the second section is substantially square in shape, wherein the FSS is separated from the source antenna by a defined distance; and an enclosure that is configured to at least partially enclose the source antenna, the first receive antenna, the second receive antenna, and the FSS, wherein the enclosure includes a first enclosure area configured to at least partially enclose the first section and the first receive antenna, and wherein the enclosure includes a second enclosure area configured to at least partially enclose the second section and the second receive antenna;

wherein the source antenna is configured to emit one or more electromagnetic signals through the FSS, wherein the FSS causes the one or more electromagnetic signals to form at least a first beam corresponding to the first section, and wherein the FSS causes the one or more electromagnetic signals to form at least a second beam corresponding to the second section, wherein the first receive antenna is configured to receive the first beam, and wherein the second receive antenna is configured to receive the second beam.

2. The antenna system of claim 1, wherein the source antenna is a first source antenna, wherein the FSS is a first FFS, wherein the enclosure is a first enclosure, wherein the set of vertically oriented unit cells is a first set of vertically oriented unit cells, wherein the defined distance is a first defined distance, wherein the one or more electromagnetic signals are first one or more electromagnetic signals, and wherein the antenna system further comprises:

a second source antenna;

a second FSS comprising a fourth section including a third set of horizontally oriented unit cells, a fifth section including a fourth set of horizontally oriented unit cells, and a sixth section between the fourth section and the fifth section, the sixth section including a second set of vertically oriented unit cells, wherein the fourth section is substantially square in shape, wherein the fifth section is substantially square in shape, wherein the second FSS is separated from the second source antenna by a second defined distance, and wherein the second source antenna is configured to:

emit second one or more electromagnetic signals through the second FSS, wherein the second FSS causes the second one or more electromagnetic signals to form at least a third beam corresponding to the fourth section, and wherein the second FSS causes the one or more electromagnetic signals to form at least a fourth beam corresponding to the fifth section; and a second enclosure that is configured to at least partially enclose the second source antenna and the second FSS.

3. The antenna system of claim 1, wherein the antenna system further comprises a microstrip line that is configured to feed the source antenna.

4. The antenna system of claim 3, wherein the source antenna comprises a slot antenna, and wherein the antenna system further comprises:

an aperture coupled to the microstrip line, the microstrip line configured to feed the slot antenna via the aperture, and wherein the slot antenna comprises:

an elongated member that faces the third section of the FSS, the elongated member extending substantially parallel to each unit cell of the set of vertically oriented unit cells.

5. The antenna system of claim 3, wherein the source antenna comprises a patch antenna, wherein the patch antenna comprises:

an elongated member that faces the third section of the FSS, the elongated member extending substantially parallel to each unit cell of the set of vertically oriented unit cells; and an antenna head placed at a distal end of the elongated member, wherein a width of the antenna head is greater than a width of the elongated member.

6. The antenna system of claim 1, wherein the source antenna is configured to emit the one or more electromagnetic signals through the FSS according to a fifth generation (5G) technology standard at a frequency within a range from 24 gigahertz (GHz) to 100 GHz.

7. The antenna system of claim 1, wherein the source antenna is configured to emit the one or more electromagnetic signals through the FSS at a frequency within a range from 10 gigahertz (GHz) to 100 GHz.

8. The antenna system of claim 7, wherein the antenna system provides one or more wireless interconnects, and wherein the source antenna is configured to emit the one or more electromagnetic signals through the FSS via the one or more wireless interconnects.

9. The antenna system of claim 1, wherein the first set of horizontally oriented unit cells are placed in a first pattern including three or more columns of unit cells and nine or more rows of unit cells, wherein the second set of horizontally oriented unit cells are placed in a second pattern including three or more columns of unit cells and nine or more rows of unit cells, and wherein the set of vertically oriented unit cells are placed in a third pattern including three or more columns of unit cells and three or more rows of unit cells.

10. The antenna system of claim 9, wherein each unit cell of the first set of horizontally oriented unit cells, each unit cell of the second set of horizontally oriented unit cells, and each unit cell of the set of vertically oriented unit cells is rectangular in shape having a first dimension of 2 millimeters (mm) and a second dimension of 0.66 mm, and wherein each unit cell of the first set of horizontally oriented unit cells, each unit cell of the second set of horizontally oriented unit cells, and each unit cell of the set of vertically oriented unit cells defines an interior slot having a first dimension of 1.55 mm and a second dimension of 0.11 mm.

11. The antenna system of claim 9, wherein each unit cell of the first set of horizontally oriented unit cells, each unit cell of the second set of horizontally oriented unit cells, and each unit cell of the set of vertically oriented unit cells is rectangular in shape having a first dimension of 9 millimeters (mm) and a second dimension of 3 mm, and wherein each unit cell of the first set of horizontally oriented unit cells, each unit cell of the second set of horizontally oriented unit cells, and each unit cell of the set of vertically oriented unit cells defines an interior slot having a first dimension of 7 mm and a second dimension of 0.5 mm.

12. The antenna system of claim 1, wherein the enclosure comprises two or more metallic walls.

13. The antenna system of claim 1, wherein the first, second, and third sections each face the source antenna.

14. A method comprising:

emitting, using a source antenna of an antenna system, one or more electromagnetic signals through a frequency selective surface (FSS) comprising a first section including a first set of horizontally oriented unit cells, a second section including a second set of horizontally oriented unit cells, and a third section between the first section and the second section, the third section including a set of vertically oriented unit cells, wherein the first section is substantially square in shape, wherein the second section is substantially square in shape, wherein the FSS is separated from the source antenna by a defined distance, and wherein an enclosure is configured to at least partially enclose the source antenna and the FSS, wherein an enclosure is configured to at least partially enclose the source antenna, the first receive antenna, the second receive antenna, and the FSS, wherein the enclosure includes a first enclosure area configured to at least partially enclose the first section and the first receive antenna, and wherein the enclosure includes a second enclosure area configured to at least partially enclose the second section and the second receive antenna;

forming, by the FSS based on the one or more electromagnetic signals, at least a first beam corresponding to the first section;

forming, by the FSS based on the one or more electromagnetic signals, at least a second beam corresponding to the second section;

receiving, by the first receive antenna, the first beam, and receiving, by the second receive antenna, the second beam.

15. The method of claim 14, further comprising feeding, using a microstrip line of the antenna system, the source antenna.

16. The method of claim 15, wherein the source antenna comprises a slot antenna, and wherein feeding the slot antenna comprises:

feeding the slot antenna via an aperture coupled to the microstrip line, wherein the slot antenna comprises an elongated member that faces the third section of the FSS, the elongated member extending substantially parallel to each unit cell of the set of vertically oriented unit cells.

17. The method of claim 15, wherein the source antenna comprises a patch antenna, wherein the patch antenna comprises:

an elongated member that faces the third section of the FSS, the elongated member extending substantially parallel to each unit cell of the set of vertically oriented unit cells; and an antenna head placed at a distal end of the elongated member, wherein a width of the antenna head is greater than a width of the elongated member.

18. An antenna system, comprising:

a first source antenna;

a second source antenna;

a first frequency selective surface (FSS) comprising a first section including a first set of horizontally oriented unit cells, a second section including a second set of horizontally oriented unit cells, and a third section between the first section and the second section, the third section including a first set of vertically oriented unit cells, wherein the first section is substantially square in shape, wherein the second section is substantially square in shape, wherein the first FSS is separated from the first source antenna by a first defined distance a second FSS comprising a fourth section including a third set of horizontally oriented unit cells, a fifth section including a fourth set of horizontally oriented unit cells, and a sixth section between the fourth section and the fifth section, the sixth section including a second set of vertically oriented unit cells, wherein the fourth section is substantially square in shape, wherein the fifth section is substantially square in shape, wherein the second FSS is separated from the second source antenna by a second defined distance, wherein the first source antenna is configured to:

emit a first one or more electromagnetic signals through the first FSS, wherein the first FSS causes the one or more electromagnetic signals to form at least a first beam corresponding to the first section, and wherein the first FSS causes the one or more electromagnetic signals to form at least a second beam corresponding to the second section, and wherein the second source antenna is configured to:

emit a second one or more electromagnetic signals through the second FSS, wherein the second FSS causes the second one or more electromagnetic signals to form at least a third beam corresponding to the fourth section, and wherein the second FSS causes the one or more electromagnetic signals to form at least a fourth beam corresponding to the fifth section;

a first enclosure that is configured to at least partially enclose the first source antenna and the first FSS; and a second enclosure that is configured to at least partially enclose the second source antenna and the second FSS.

19. The antenna system of claim 18, wherein the antenna system further comprises:

a first microstrip line that is configured to feed the first source antenna; and a second microstrip line that is configured to feed the second source antenna.

20. The antenna system of claim 18, wherein the first enclosure comprises a first two or more metallic walls, and wherein the second enclosure comprises a second two or more metallic walls.

* * * * *